US006696907B1

(12) United States Patent
Iwaya et al.

(10) Patent No.: US 6,696,907 B1
(45) Date of Patent: Feb. 24, 2004

(54) CORE FOR DEFLECTION YOKE AND ITS PRODUCTION METHOD

(75) Inventors: Hitoshi Iwaya, Tokyo (JP); Shinichiro Ito, Tokyo (JP); Minoru Anbo, Tokyo (JP); Masahiro Ono, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/926,155

(22) PCT Filed: Mar. 14, 2000

(86) PCT No.: PCT/JP00/01551

§ 371 (c)(1),
(2), (4) Date: Sep. 14, 2001

(87) PCT Pub. No.: WO00/55883

PCT Pub. Date: Sep. 21, 2000

(30) Foreign Application Priority Data

| | | |
|---|---|---|
| Mar. 15, 1999 | (JP) | 11-069014 |
| Mar. 15, 1999 | (JP) | 11-069015 |
| Mar. 15, 1999 | (JP) | 11-069173 |
| Mar. 15, 1999 | (JP) | 11-069174 |
| Mar. 15, 1999 | (JP) | 11-069175 |
| Mar. 15, 1999 | (JP) | 11-069278 |
| Mar. 15, 1999 | (JP) | 11-069317 |
| Mar. 15, 1999 | (JP) | 11-069318 |

(51) Int. Cl.[7] ..... H01J 29/70; H01F 3/12
(52) U.S. Cl. ..... 335/210; 313/440; 335/211
(58) Field of Search ..... 335/210–214; 313/440

(56) References Cited

U.S. PATENT DOCUMENTS 4,754,190 A 6/1988 Hinotami et al.
6,281,623 B1 8/2001 Suzuki et al.

FOREIGN PATENT DOCUMENTS

| | | |
|---|---|---|
| JP | 48-85030 | 11/1973 |
| JP | 50-28652 | 8/1975 |
| JP | 57-11092 | 3/1982 |
| JP | 60-745 | 1/1985 |
| JP | 60-40660 | 9/1985 |
| JP | 62-10846 | 1/1987 |
| JP | 64-5814 | 2/1989 |
| JP | 1-62639 | 4/1989 |
| JP | 1-283740 | 11/1989 |
| JP | 1-319226 | 12/1989 |
| JP | 4-79133 | 3/1992 |
| JP | 7-11751 | 2/1995 |
| JP | 2000-57969 | 2/2000 |

*Primary Examiner*—Ramon M. Barrera
(74) *Attorney, Agent, or Firm*—Oblon, Spivak, McClelland, Maier & Neustadt, P.C.

(57) ABSTRACT

A deflecting yoke core with which magnetic saturation is prevented by optimizing the relationship between the core sectional area and the density of the magnetic flux distribution. The deflecting yoke core to be mounted between a neck and a funnel of a cathode ray tube has a hole 2 extending from an opening end of a neck portion 3 to an opening end of a funnel portion 1. The hole 2 at the funnel portion 1 widens toward the opening end of the funnel portion 1. An outer shape at the opening end of the funnel portion 1 has a short diameter Dx1 along a minor axis X and a long diameter Dy1 along a major axis Y. Core sectional areas along a plane parallel to and passing through a core axis O1 are largest within an angular range of 30° to 65° measured around the core axis O1 from a 0° reference angle at the minor axis X.

84 Claims, 70 Drawing Sheets

CORE FOR DEFLECTION YOKE AND ITS PRODUCTION METHOD

TECHNICAL FIELD

Background Art

The type of deflecting yoke core to which the present invention relates is used to constitute a deflecting yoke. A deflecting yoke, which is constituted by providing a horizontal deflection coil and a vertical deflection coil at a deflecting yoke core, is mounted between a neck and a funnel of a cathode ray tube (CRT). An electron beam emitted from an electron gun provided at the neck is deflected along horizontal and vertical directions. In a standard deflecting yoke core, the shape of an opening end at the neck portion and the shape of an opening end at the funnel portion are both circular.

Another deflecting yoke core in the prior art is disclosed in Japanese Examined Patent Publication No. 1996-28194 and adopts a structure having a circular opening end at the neck portion and an oval opening end at the funnel portion. In addition, Japanese Unexamined Patent Publication No. 1995-37525 discloses a technology whereby the deflection efficiency is improved without compromising moldability, by forming the inner surface of the deflecting yoke core in an almost oval shape and forming the outer surface of the deflecting yoke core in an almost completely circular shape. Japanese Examined Patent Publication No. 1996-7781 also discloses a similar deflecting yoke core.

However, these prior art technologies, which do not take into consideration the relationship between the core sectional area and the density of the core internal magnetic flux distribution, present a concern in that the density of the core internal magnetic flux is not consistent, and magnetic saturation may occur over an area of the core where the density of the core internal magnetic flux is high, resulting in an image plane distortion.

These types of deflecting yoke cores are formed by molding ferrite powder or the like into a tube achieving a specific finished shape. The molded product may have dividing grooves formed in advance so that it can be divided into two core pieces along the dividing grooves so as to allow the horizontal deflection coil and the vertical deflection coil to be provided with ease.

As disclosed in Japanese Unexamined Patent Publication No. 1995-37525, Japanese Unexamined Utility Model Publication No. 1996-194, and U.S. Pat. No. 4,754,190, the dividing grooves in a deflecting yoke in the prior art are normally provided at two positions facing opposite each other over a horizontal axis.

However, the dividing grooves in this structure are provided at areas where the horizontal deflection magnetic field is the most intense. While the vertical deflection magnetic field has a low frequency of approximately 60 to 100 Hz, the horizontal deflection magnetic field has a high frequency of approximately 20 to 120 KHz, and thus, the horizontal deflection magnetic field may become a predominant cause of core loss. In addition, the presence of the dividing grooves provided at areas where the horizontal deflection magnetic field is the most intense, reduces the core sectional area of these areas and, as a result, the density of the magnetic flux attributable to the horizontal deflection magnetic field becomes extremely high, further increasing core loss. As is well known, core loss manifesting under these circumstances increases in proportion to the density of the magnetic flux to the power of 2 to 2.5. Thus, a problem arises in that the core temperature rises on the two positions facing opposite each other over the horizontal axis where the dividing grooves are provided.

In addition, if the opening end facing toward the funnel has a long diameter along a major axis and a short diameter along a minor axis, as disclosed in Japanese Examined Patent Publication No. 1996-28194 and Japanese Unexamined Patent Publication No. 1995-37525, the core density becomes lower near the minor axis due to the structure of the forming die. This results in a lower degree of core strength manifesting near the minor axis, and induces chipping of the core and the like.

Since there is an area with a low core density in the core as described above, the core shrinks unevenly during the baking process, resulting in a significant degree of deformation.

Clip grooves are formed at two sides of the dividing grooves in advance in an actual molded product. When forming a deflecting yoke by using such a deflecting yoke core, the deflecting yoke core is first divided into two pieces along the dividing grooves, after which a separator, a horizontal deflection coil and a vertical deflection coil are provided and then the divided core pieces are assembled. Subsequently, clips are provided at the clip grooves at the two sides of the dividing grooves to couple the two core pieces. This process tends to cause an increase in core temperature and chipping of the core or the like even more readily.

While the shape of the opening end at the funnel portion is either oval or rectangular, the shape of the opening end at the neck portion is circular in the prior art. Such a structure does not adequately support an in-line type cathode ray tube achieved by linearly providing three electron guns corresponding to the three primary colors.

Japanese Examined Patent Publication No. 1996-28194 discloses a deflecting yoke core adopting a slot structure, which is constituted by providing a plurality of projecting portions continuously and in a radial pattern along the inner surface of the core, extending from a neck portion to a funnel portion, and providing a horizontal deflection coil and a vertical deflection coil at grooves formed between the projecting portions. However, since the positions of the horizontal deflection coil and the vertical deflection coil are determined in conformance to the positions of the projecting portions, magnetic field distribution cannot be adjusted. Thus, a means other than the deflecting yoke must be employed to implement adjustment, such as a ballast operation distortion correction, a pincushion graphic distortion correction or a convergence characteristics correction.

As a means for solving the problem described above, Utility Model Registration No. 2580242 discloses a deflecting yoke core having coil guide grooves and projecting portions formed in a non-radial pattern, corresponding to the wiring pattern of a vertical deflection coil and a horizontal deflection coil designed in advance.

However, after the molding process, the deflecting yoke core disclosed in this Utility Model Registration cannot be rapped out along the direction of the core axis (tube axis), since projecting portions must be formed in a radial pattern relative to the core axis in order to allow the deflecting yoke core to be rapped out along the direction of the core axis.

When this type of deflecting yoke core is used to constitute a deflecting yoke, the core must achieve a high degree of dimensional accuracy, and the core and the cathode ray tube must be assembled with a high degree of accuracy to ensure that an electron beam is deflected as designed, because the electron beam is deflected along the inner surface of the deflecting yoke core. Since the core is mounted at the cathode ray tube via a separator, the core must be mounted at the separator with great accuracy in order to ensure that the core and the cathode ray tube are assembled with a high degree of accuracy.

However, since the deflecting yoke core is a baked product formed by baking a ferrite powder molding, it is bound to become deformed due to baking shrinkage. The rate of thermal contraction occurring at this time is fairly high at approximately 10% to 20%, resulting in a reduction of the volume of the baked core which is only approximately 60% of the volume of the unbaked core. Thus, the assembly accuracy with which the core and the cathode ray tube are assembled becomes poor, which prevents an electron beam from being accurately deflected as designed. Consequently, problems arise, such as a poor image quality attributable to misconvergence.

The problems attributable to the deformation of the baked core discussed above may be solved by grinding the core. However, it is difficult to grind the inner surface of the core if the shape of the opening end at the funnel portion is not circular. For this reason, the core inner surface is not ground, either at the funnel portion or at the neck portion, at a deflecting yoke core having the opening end at the funnel portion formed in a non-circular shape in the prior art. Thus, the problems attributable to baking deformation remain unsolved.

In addition, if the opening end at the funnel portion is formed in a non-circular shape as described above, there is no distinctive mark at the outer surface of the core that may be used as a positioning reference when mounting the core at the separator. For this reason, it is difficult to mount the deflecting yoke core at the separator accurately and thus, it is difficult to align the core axis of the deflecting yoke core with the tube axis of the cathode ray tube, presenting a limit to the extent to which assembly accuracy can be improved.

This problem may be eliminated by grinding the inner surface of the deflecting yoke core. Grinding methods that may be adopted for this purpose include a method disclosed in Japanese Unexamined Patent Publication No. 1989-319226 in which the neck portion is held from the inside and the outer surface is ground by using a rotating grindstone or the like. However, this prior art publication does not mention inner surface grinding in any way whatsoever.

Furthermore, a deflecting yoke core having an opening end at the funnel portion formed in a roughly rectangular shape cannot be ground with a rotating grindstone. Thus, it is difficult to align the core axis of the deflecting yoke core with the tube axis of the cathode ray tube when assembling such a deflecting yoke core and cathode ray tube, presenting a limit to the extent to which assembly accuracy can be improved.

Since the outer shape of the funnel portion at an opening end is normally circular, oval, roughly rectangular or the like, the outer surface continuous to the opening end of the funnel portion has a curved shape. For instance, Japanese Unexamined Patent Publication No. 1996-7781 discloses a core with an outer shape of the funnel portion at an opening end being roughly oval by combining a plurality of circular arcs with different radiuses.

Such a core does not have any distinctive mark at its outer surface to be used when positioning the deflecting yoke core relative to the cathode ray tube. For this reason, it is difficult to position the deflecting yoke core at the separator accurately and thus, it is difficult to align the core axis of the deflecting yoke core with the tube axis of the cathode ray tube, presenting a limit to the extent to which assembly accuracy can be improved.

It is necessary to hold the deflecting yoke core with a jig or the like when grinding the deflecting yoke core in order to improve deflection sensitivity as well as the accuracy with which the deflecting yoke core is positioned relative to the cathode ray tube. The deflecting yoke core may be held at the neck portion or at the opening end at the funnel portion. The neck portion, which has an almost consistent external diameter over a specific length along the core axis, can be used as a mechanical holding portion. However, the funnel portion is subject to the following restrictions when it is to be used as a mechanical holding portion.

Namely, there is a band-like portion constituted of a curved surface extending almost parallel to the core axis over the entire circumference of the opening end at the funnel portion, and this band-like portion may be used as a holding portion. The width of the band-like portion is usually 5 mm or smaller. If the outer shape of the funnel portion at an opening end is almost circular, a sufficient degree of mechanical holding strength can be assured even with a band-like portion having a width of 5 mm or smaller.

However, a core with an outer shape of the funnel portion at an opening end being rectangular cannot withstand the external force applied thereto during the machining process by using the band-like portion with a width of 5 mm or smaller as a holding portion, resulting in the core to fall, or a chip or crack or the like to occur. Ultimately, an area at the neck portion having an almost consistent external diameter over a specific length along the core axis must be used as a mechanical holding portion in this type of deflecting yoke core.

In such a situation, the correct selection of the length of the neck portion along the core axis which affects the core characteristics, the holding stability and the core volume, are crucial. For instance, in order to achieve a more lightweight core, the length of the neck portion which has an almost consistent external diameter along the core axis becomes excessively long when the core sectional area at the funnel portion is reduced, presenting a concern in that heat generation and magnetic saturation may occur.

If, on the other hand, no area achieving an almost consistent external diameter is provided at the neck portion or if such an area extends only over a very short distance, as shown in FIG. 1 of Japanese Unexamined Patent Publication No. 1995-37525 and in FIG. 2 of Japanese Unexamined Patent Publication No. 1996-7781, for instance, the deflecting yoke core cannot be held in a sufficiently stable manner during the machining process and thus, the deflecting yoke core cannot withstand the external force applied thereto during the machining process, resulting in the core to fall, or a chip or crack or the like to occur.

DISCLOSURE OF THE INVENTION

It is a first object of the present invention to provide a deflecting yoke core that optimizes the relationship between the core sectional area and the density of the core internal magnetic flux distribution and makes it possible to prevent magnetic saturation from occurring.

It is a second object of the present invention to provide a deflecting yoke core that makes it possible to minimize core loss and reduce the core temperature.

It is a third object of the present invention to provide a deflecting yoke core that eliminates the risk of core chipping.

It is a fourth object of the present invention to provide a deflecting yoke core that does not readily become deformed during the baking process.

It is a fifth object of the present invention to provide a deflecting yoke core that makes it possible to minimize core loss and reduce the core temperature.

It is a sixth object of the present invention to provide a deflecting yoke core that eliminates the risk of core chipping.

It is a seventh object of the present invention to provide a deflecting yoke core that does not readily become deformed during the baking process.

It is an eighth object of the present invention to provide a deflecting yoke core having a shape optimized for application in an in-line type cathode ray tube having three electron guns corresponding to the three primary colors, linearly provided.

It is a ninth object of the present invention to provide a deflecting yoke core that affords a high degree of freedom with regard to the positions of coils and makes it possible to improve deflection sensitivity, distortion characteristics, convergence characteristics and the like by adjusting the magnetic field distribution.

It is a tenth object of the present invention to provide a deflecting yoke core that can be rapped out with a high degree of reliability along the core axis.

It is an eleventh object of the present invention to provide a deflecting yoke core of which an opening end at the funnel portion is non-circular shaped, having a circular hole at an area toward the neck portion, and which achieves a high degree of dimensional accuracy.

It is a twelfth object of the present invention to provide a deflecting yoke core that can be positioned relative to a cathode ray tube with a high degree of accuracy, and a manufacturing method thereof.

It is a thirteenth object of the present invention to provide a deflecting yoke core that facilitates accurate positioning relative to a cathode ray tube.

It is a fourteenth object of the present invention to provide a deflecting yoke core that can be held in a stable manner during the machining process while maintaining a volume necessary to assure specific characteristics.

In order to achieve the first object described above, the deflecting yoke core according to the present invention to be mounted between a neck and a funnel of a cathode ray tube, has a hole extending from an opening end of a neck portion to an opening end of a funnel portion. The hole at the funnel portion widens toward the opening end of the funnel portion. An outer shape at the opening end of the funnel portion has a short diameter along a minor axis and a long diameter along a major axis. Core sectional areas along a plane parallel to and passing through a core axis are largest within an angular range of 30° to 65° measured around the core axis from a 0° reference angle at the minor axis.

Research conducted by the inventors of the present invention has revealed that when a deflecting yoke is constituted by providing a horizontal deflection coil and a vertical deflection coil at a deflecting yoke core, and a vertical deflection magnetic field and a horizontal deflection magnetic field are created by the individual coils, the resulting magnetic flux does not achieve consistency in the core.

In more specific terms, the highest degree of core internal magnetic flux density is achieved within an angular range of 30° to 65° measured around the core axis from a 0° reference angle at a position at which the density of the core internal magnetic flux attributable to the horizontal deflection magnetic field is the lowest, when the density of the core internal magnetic flux is measured at various sectional planes parallel to and passing through the core axis, with an opening end at the neck portion and the opening end at the funnel portion both formed in a circular shape, in the prior art.

Accordingly, it is ensured in the deflecting yoke core according to the present invention that the core sectional areas along a plane parallel to and passing through a core axis are largest within an angular range of 30° to 65° measured around the core axis from a 0° reference angle at the minor axis.

Thus, consistency is achieved with regard to the density of the core internal magnetic flux over the entire core, thereby preventing local magnetic saturation. If the core assumes a shape achieving the largest core sectional area outside the angular range of 30° to 65°, magnetic saturation may occur over the angular range of 30° to 65° in which the density of the core internal magnetic flux is high. While magnetic saturation can be prevented by increasing the core sectional area over the entire core, the resulting core is bound to have an inefficient shape.

Another means for achieving the first object, i.e., prevention of magnetic saturation, is provided by ensuring that the core density at core sectional areas along a plane parallel to and passing through a core axis is largest within an angular range of 30° to 65° measured around the core axis from a 0° reference angle at the minor axis.

Through this means, local magnetic saturation over the angular range of 30° to 65°, in which the density of the core internal magnetic flux is the highest, can be prevented. If the core assumes a shape in which the core density is the highest at a core section outside the angular range of 30° to 65°, magnetic saturation may occur over the angular range of 30° to 65° in which the density of the core internal magnetic flux is high. If, on the other hand, the core sectional area is increased for the entire core, the core is bound to have an inefficient shape.

In order to achieve the second object mentioned earlier, the deflecting yoke core according to the present invention to be mounted between a neck and a funnel of a cathode ray tube, has a hole extending from an opening end of a neck portion to an opening end of a funnel portion. The hole at the funnel portion widens toward the opening end of the funnel portion. An outer shape at the opening end of the funnel portion has a short diameter along a minor axis and a long diameter along a major axis. The deflecting yoke core is further provided with dividing grooves extending along the core axis at a core surface near the minor axis.

In an application in a deflecting yoke, a horizontal deflection coil and a vertical deflection coil are provided so as to set the position of the minor axis in correspondence to a position at which the density of the magnetic flux attributable to the horizontal deflection magnetic field, is the lowest. With this structure, having dividing grooves provided at the position at which the density of the magnetic flux attributable to the horizontal deflection magnetic field is the lowest, the density of the magnetic flux attributable to the horizontal deflection magnetic field is least affected by the dividing grooves, and reductions in core loss and heat generated at the core are thus achieved.

It is desirable to form the dividing grooves in a linear shape and to allow the dividing grooves to open at an opening end edge at the neck portion. Such a structure allows the core, which is constituted by molding magnetic powder such as ferrite powder or magnetic metal powder, to be rapped out smoothly.

In another desirable mode, dividing grooves are provided at positions facing opposite each other at an outer circumferential surface and an inner circumferential surface. By adopting this structure, it becomes possible to divide the core constituted of a ferrite molding with ease.

The dividing grooves formed at the outer circumferential surface and the dividing grooves formed at the inner circumferential surface are continuous to each other at the opening end edge at the neck portion. This structure allows the core to be divided with ease. The dividing grooves should preferably be V-shaped, since a V-shape effectively allows the core to be divided into two pieces with ease.

In order to achieve the third and fourth objects mentioned earlier, the deflecting yoke core according to the present invention is formed as a tube to be mounted between a neck and a funnel of a cathode ray tube, and has an outer circumferential surface. The outer circumferential surface at a funnel portion widens toward an opening end of the funnel portion. An outer shape at the opening end of the funnel portion has a short diameter along a minor axis and a long diameter along a major axis. At least one first indented portion is provided at the outer circumferential surface near the minor axis.

Research conducted by the inventors of the present invention has revealed that when the outer shape of the funnel portion at an opening end has a short diameter along a minor axis and a long diameter along a major axis, the core density is lower near the minor axis.

Accordingly, the first indented portion is provided at the outer circumferential surface of the deflecting yoke core according to the present invention. During the pressurized molding process implemented by using magnetic powder such as ferrite powder, the magnetic powder can be pressurized with a projecting portion provided at the molding die in correspondence to the first indented portion. As a result, the core density around the first indented portion corresponding to the projecting portion can be increased.

In addition, since the first indented portion is located at the outer circumferential surface near the minor axis, the core density ultimately increases near the minor axis. Thus, the core strength improves near the minor axis, so that core chipping is prevented.

Furthermore, since the core density increases near the minor axis, as described above, a more uniform core density distribution is achieved. As a result, the deflecting yoke core according to the present invention shrinks in an even manner and does not become deformed readily during the baking process.

In order to achieve the fifth, sixth and seventh objects mentioned earlier, the deflecting yoke core according to the present invention to be mounted between a neck and a funnel of a cathode ray tube, has a hole extending from an opening end of a neck portion to an opening end of a funnel portion. The hole at the funnel portion widens toward the opening end of the funnel portion. An outer shape at the opening end of the funnel portion has a short diameter along a minor axis and a long diameter along a major axis. The deflecting yoke core according to the present invention is provided with dividing grooves extending along a core axis at a core surface near the minor axis, and clip grooves are provided at the outer circumferential surface at two ends of the minor axis.

In an application in a deflecting yoke, a horizontal deflection coil and a vertical deflection coil are provided so as to set the position of the minor axis in correspondence to a position at which the density of the magnetic flux attributable to the horizontal deflection magnetic field is the lowest. In this structure, having dividing grooves provided at the positions at which the density of the magnetic flux attributable to the horizontal deflection magnetic field is the lowest, the density of the magnetic flux attributable to the horizontal deflection magnetic field is least affected by the dividing grooves, to achieve reductions in core loss and heat generated at the core.

Research conducted by the inventors of the present invention has revealed that when the outer shape of the funnel portion at an opening end has a short diameter along a minor axis and a long diameter along a major axis, the core density is lower near the minor axis.

Accordingly, the clip grooves are formed at the outer circumferential surface of the deflecting yoke core according to the present invention. During the pressurized molding process implemented by using magnetic powder such as ferrite powder, the magnetic powder can be pressurized with projecting portions provided in correspondence to the clip grooves. As a result, the core density around the clip grooves corresponding to the projecting portions can be increased.

In addition, since the clip grooves are located at the outer circumferential surface on the two ends of the minor axis, the core density ultimately increases near the minor axis. Thus, the core strength improves near the minor axis, so that core chipping is prevented.

Furthermore, since the core density increases near the minor axis, as described above, a more uniform core density distribution is achieved. As a result, the deflecting yoke core according to the present invention shrinks in an even manner and does not become deformed readily during the baking process.

In order to achieve the eighth object mentioned earlier, the deflecting yoke core according to the present invention to be mounted between a neck and a funnel of a cathode ray tube, has a hole extending from an opening end of a neck portion to an opening end of a funnel portion. The hole at the funnel portion widens toward the opening end of the funnel portion. The hole at the opening end of the funnel portion is curved along an entire circumference, and the hole at both the funnel portion and the neck portion has a short diameter along a minor axis and a long diameter along a major axis.

Since the deflecting yoke core has a hole having a short diameter along a minor axis and a long diameter along a major axis at the neck portion as well as at the funnel portion, the neck portion, too achieves a shape suitable for application in an in-line type cathode ray tube having three linearly positioned electron guns in correspondence to the three primary colors. Thus, a deflecting yoke core achieving an optimal shape for application in an in-line type cathode ray tube is provided.

In order to achieve the ninth and tenth objects, the deflecting yoke core according to the present invention is formed as a tube to be mounted between a neck and a funnel of a cathode ray tube and has a plurality of projecting portions provided in a radial pattern along an inner surface from a neck portion toward a funnel portion, with a plurality of grooves formed between the plurality of projecting portions.

The projecting portions are provided separately at the neck portion and the funnel portion, and each include a surface that faces opposite the core axis and inclines over an increasingly greater distance from the core axis viewed along a direction extending from the neck portion toward the funnel portion.

As described above, since a plurality of projecting portions are provided in a radial pattern along the inner surface from the neck portion to the funnel portion and a plurality of grooves are formed between the projecting portions, windings of the deflection coils are prevented from becoming misaligned at the bottom surfaces of the grooves between the projecting portions.

In addition, since the projecting portions are provided separately at the neck portion and the funnel portion, the winding distribution can be adjusted in, for instance, a radial pattern and a non-radial pattern, to facilitate correction of distortion or misconvergence manifesting after the deflecting yoke is assembled.

Furthermore, since the plurality of projecting portions are provided in a radial pattern along the inner surface and their surfaces facing opposite the core axis incline over increasingly greater distances from the core axis when viewed along the direction extending from the neck portion to the funnel portion, the deflecting yoke core constituted by molding magnetic powder such as ferrite powder can be easily rapped out with a high degree of reliability along the direction in which the core axis (tube axis) extends after it is molded.

In order to achieve the eleventh and twelfth objects mentioned earlier, the deflecting yoke core according to the present invention to be mounted between a neck and a funnel of a cathode ray tube, has a hole extending from an opening end of a neck portion to an opening end of a funnel portion. The hole at the funnel portion widens toward the opening end of the funnel portion. The hole at the funnel portion has a short diameter along a minor axis and a long diameter along a major axis. The hole at the neck portion has a circular shape and a ground inner surface.

Since the inner surface of the hole at the neck portion is ground in the deflecting yoke core with the hole at the funnel portion formed in a non-circular shape and the hole in the neck portion formed in a circular shape, the dimensional accuracy at the neck portion is improved. This, in turn, ensures a high degree of assembly accuracy when mounting a deflecting yoke constituted by using the deflecting yoke core, at a cathode ray tube. The hole at the neck portion is formed in a circular shape and can be ground with ease by employing, for instance, a rotary grinder.

With the dimensional accuracy of the hole at the neck portion improved as described above, the core axis, i.e., the central axis of the hole, can be set with a high degree of accuracy, which, in turn, makes it possible to surface-grind the outer surface of the funnel portion relative to the core axis and then to use the flat surface obtained through grinding as a positioning reference when positioning the core relative to the separator. Thus, the core is positioned relative to a separator with a high degree of accuracy and, ultimately, the deflecting yoke core can be positioned with a high degree of accuracy relative to the cathode ray tube.

Another deflecting yoke core according to the present invention to be mounted between a neck and a funnel of a cathode ray tube, has a hole extending from an opening end of a neck portion to an opening end of a funnel portion. The hole at the funnel portion widens toward the opening end of the funnel portion. The hole at least at the funnel portion has a short diameter along a minor axis and a long diameter along a major axis and a ground inner surface.

Since the deflecting yoke core has a hole at a funnel portion widening toward an opening end of the funnel portion with the hole at the funnel portion having a short diameter along a minor axis and a long diameter along a major axis, the core can be utilized in a cathode ray tube for a color television image receiver having a wide display panel.

In addition, since the inner surface of the hole is ground at the funnel portion, the dimensional accuracy of the core at the funnel portion is improved to achieve better assembly accuracy when mounting the deflecting yoke core at a cathode ray tube.

In a desirable mode, the inner surface of the hole may be ground at the neck portion as well, so that the assembly accuracy with which the deflecting yoke core is mounted at the cathode ray tube is further improved by assuring a higher degree of dimensional accuracy at the neck portion as well as at the funnel portion.

In order to achieve the thirteenth object mentioned earlier, the deflecting yoke core according to the present invention is formed as a tube to be mounted between a neck and a funnel of a cathode ray tube, and has an outer shape. The outer shape at a funnel portion widens toward an opening end of the funnel portion. The outer shape at the opening end of the funnel portion has a short diameter along a minor axis and a long diameter along a major axis and includes at least one ground flat surface at an outer circumferential surface at the opening end of the funnel portion.

As described above, the deflecting yoke core has an outer shape at a funnel portion widening toward an opening end of the funnel portion, with the outer shape at the opening end of the funnel portion having a short diameter along a minor axis and a long diameter along a major axis. This structure improves the deflection efficiency when adopted in conjunction with a cathode ray tube for a color television image receiver with a wide display panel.

In addition, there is at least one ground flat surface at the outer circumferential surface toward the opening end of the funnel portion. The ground flat surface extends parallel to the core axis. This structure facilitates alignment of the core axis with the tube axis of the cathode ray tube by allowing the ground flat surface to be used as a reference surface. Thus, accurate positioning of the core relative to the cathode ray tube is facilitated.

Japanese Unexamined Patent Publication No. 1989-319226 discloses a means for grinding the outer surface of a deflecting yoke core, through which the neck portion is held from the inside and the outer surface is ground by using a rotary grindstone or the like. However, the grinding process is implemented to improve the dimensional accuracy of the outer surface in this prior art technology rather than to achieve accurate positioning of the core relative to the cathode ray tube.

In a desirable mode, two or more ground flat surfaces may be provided, with two consecutive surfaces set over angular intervals of approximately 90° or approximately 180°, to realize even more reliable alignment of the core with the cathode ray tube with the plurality of reference surfaces.

In order to achieve the fourteenth object described above, the deflecting yoke core according to the present invention is formed as a tube to be mounted between a neck and a funnel of a cathode ray tube. An outer shape at an opening end of a funnel portion has a short diameter along a minor axis and a long diameter along a major axis. In addition, $5\ \text{mm} \leqq B \leqq A/2\ \text{mm}$ is satisfied, with A representing an entire length of the core along the core axis which is the sum of a length B of the neck portion along the core axis and a length of the funnel portion along the core axis.

According to the present invention, the neck portion refers to an area positioned toward the neck of the cathode ray tube, over which the external diameter essentially remains constant. The funnel portion refers to the remaining portion of the core excluding the neck portion. The length along the core axis refers to the length of the deflecting yoke core formed in a tubular shape, which is measured along the core axis.

The neck portion is utilized as a holding portion when machining the inner surface and the like of the deflecting yoke core. If the length B of the neck portion along the core axis is less than 5 mm (B<5 mm), the neck portion cannot be fully held by the processing machine and the force with which the neck portion is held may not be large enough to withstand the force of the machine performing the process or to withstand the weight of the deflecting yoke core resulting in a chip or crack to occur.

If, on the other hand, the length B of the neck portion along the core axis is equal to or larger than 5 mm (B≧5 mm), the neck portion can be held by the processing machine in a fully stable manner. Thus, a sufficient degree of holding force to withstand the mechanical working force imparted while abrading the core inner surface and the like and to withstand the weight of the deflecting yoke core is assured to prevent the core from falling, or a chip or crack or the like from occurring. As a result, the inner surface and the like of the deflecting yoke core can be machined with a high degree of accuracy and stability to improve the positioning accuracy when the deflecting yoke core is mounted at the cathode ray tube, so that, ultimately, a deflecting yoke capable of accurately controlling the electron beams in the cathode ray tube and achieving a high degree of deflection sensitivity is obtained. Problems of heat generation and magnetic saturation do not arise as long as the length B of the neck portion along the core axis is equal to or larger than 5 mm and equal to or smaller than (A/2) mm.

Once the length B of the neck portion along the core axis exceeds (A/2) mm, the sectional area of the funnel portion becomes small and, as a result, problems of heat generation and magnetic saturation may arise.

A further explanation is given on other objects, structural features and advantages of the present invention in reference to the attached drawings. The attached drawings present examples only.

BEST MODE FOR CARRYING OUT THE INVENTION

Figure 1:
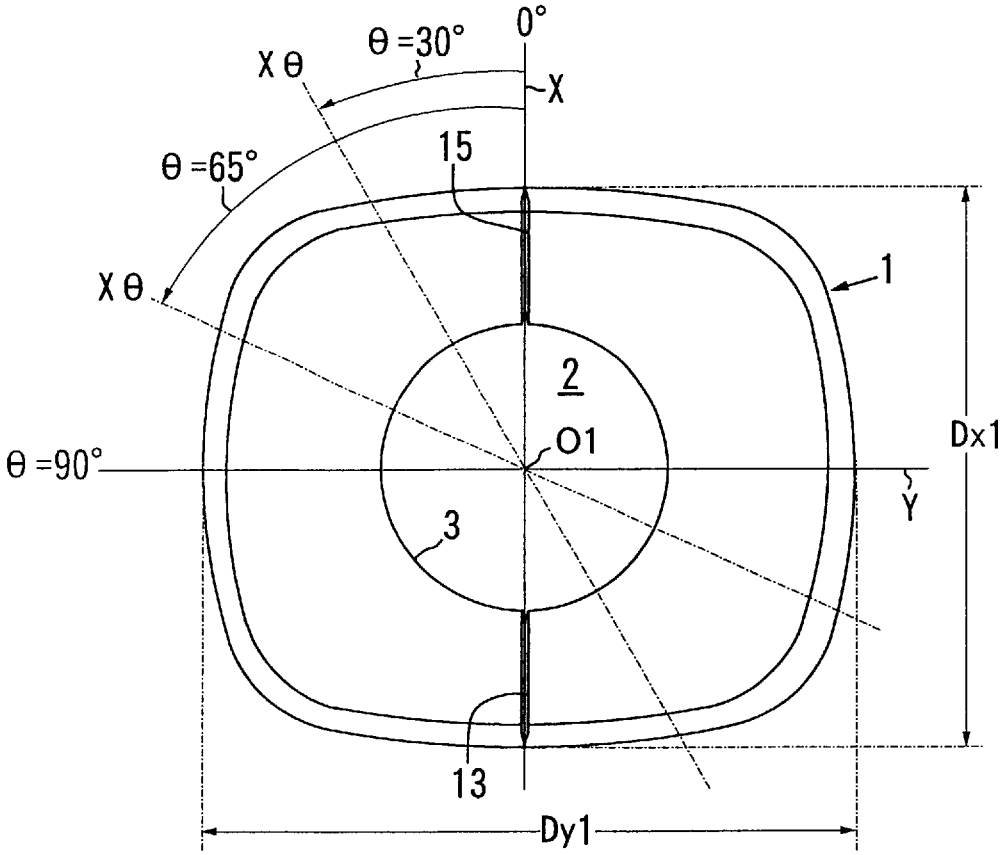
FIG. 1 is a plan view of a deflecting yoke core according to the present invention.
Figure 2:
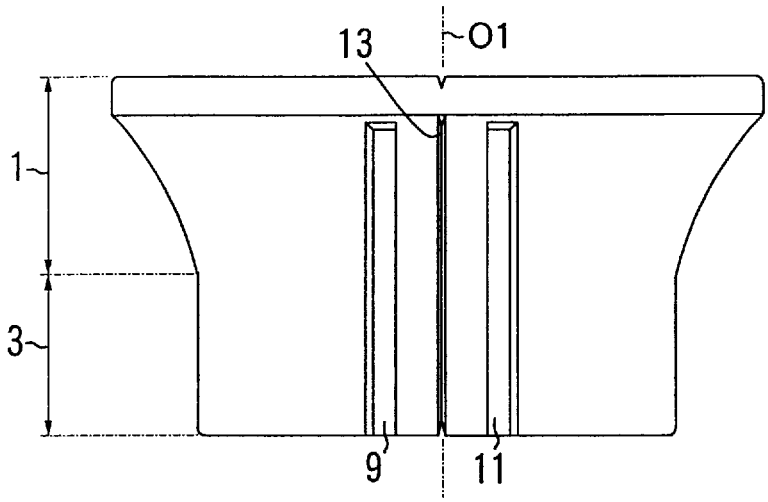
FIG. 2 is a front view of the deflecting yoke core shown in FIG. 1.

FIG. 1 is a plan view of a deflecting yoke core according to the present invention and FIG. 2 is a front view of the deflecting yoke core shown in FIG. 1. The deflecting yoke core is formed as a tube to be mounted between a neck and a funnel of a cathode ray tube and has a hole 2 extending from an opening end of a neck portion 3 to an opening end of a funnel portion 1. The hole 2 at the funnel portion 1 widens toward the opening end of the funnel portion 1.

The outer shape at the opening end of the funnel portion 1 has a short diameter Dx1 along a minor axis X and a long diameter Dy1 along a major axis Y. The short diameter Dx1 along the minor axis X and the long diameter Dy1 along the major axis Y have a relationship expressed as Dy1>Dx1. More specifically, the outer shape of the funnel portion 1 is a quadrilateral shape with arched sides, i.e., a rounded quadrilateral shape having two sides facing opposite each other over the minor axis X and which are longer than two sides facing opposite each other over the major axis Y. Alternatively, the outer shape may be an oval or the like as well. The shape of the hole 2 formed in the funnel portion 1, too, may be changed in conformance to the outer shape assumed at the funnel portion 1.

The outer shape of the neck portion 3 and the shape of the hole 2 formed at the neck portion 3 may be circular or they may assume a shape identical to that adopted in the funnel portion 1. The minor axis X and the major axis Y pass through the core axis O1 and intersect each other at a right angle.

In the structure described above, the core sectional areas along a plane parallel to and passing through the core axis O1 are largest within an angular range of 30° to 65° measured around the core axis O1 from a 0° reference angle at the minor axis X passing through the core axis O1. The position of the minor axis X passing through the core axis O1 corresponds to the position at which the density of the core internal magnetic flux attributable to the horizontal deflection magnetic field is the lowest.

Figure 3:
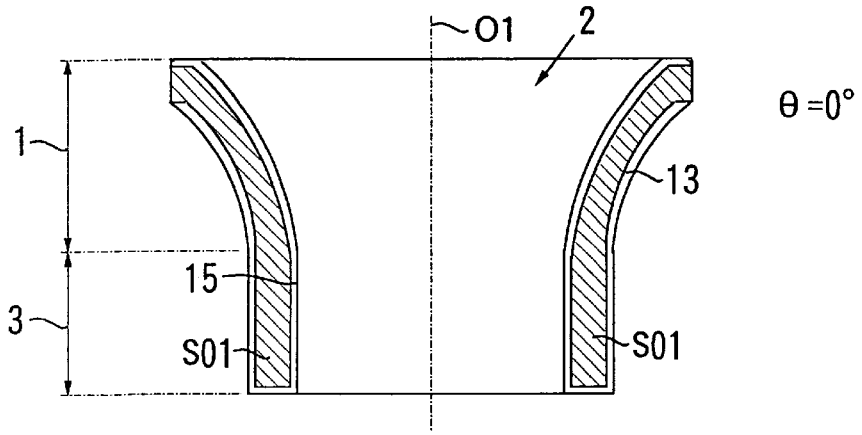
FIG. 3 is a cross-sectional view (θ=0°) taken along the minor axis X.
Figure 4:
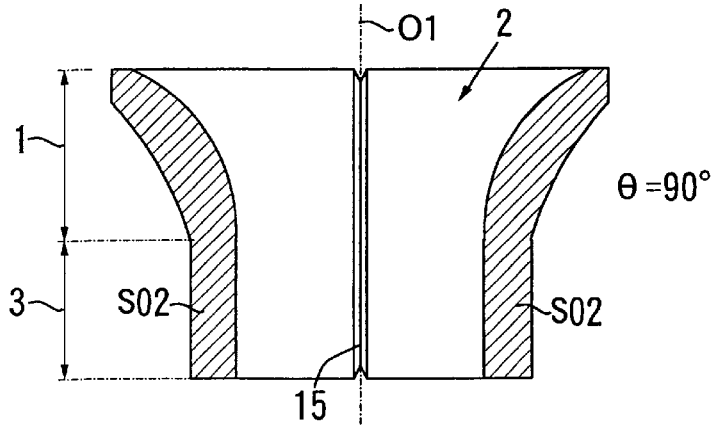
FIG. 4 is a cross-sectional view (θ=90°) taken along the major axis Y passing through the core axis O1.
Figure 5:
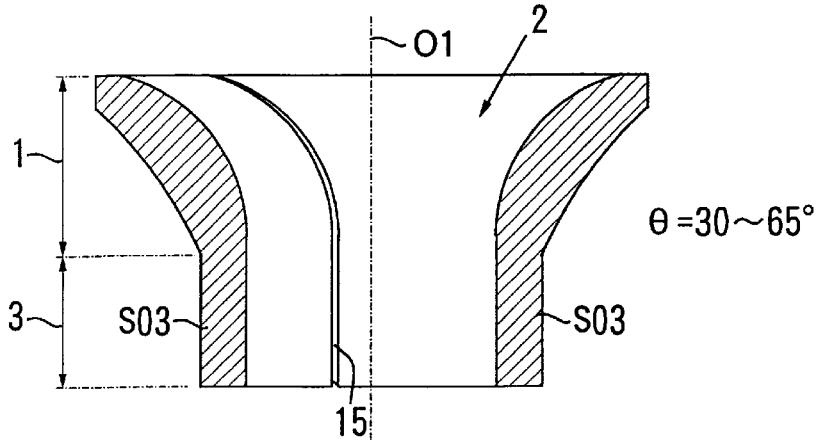
FIG. 5 is a cross-sectional view taken along a plane Xθ set within an angular range of 30° to 65°.

FIG. 3 is a cross-sectional view taken along a plane achieving a 0° angle, i.e., taken along the minor axis X, FIG. 4 is a cross-sectional view taken along the major axis Y passing through the core axis O1 (θ=90°), and FIG. 5 is a cross-sectional view taken along a plane Xθ set within the angular range of 30° to 65°. As shown in the figures, the core sectional areas S01 (see FIG. 3) taken along the minor axis X, the core sectional areas S02 taken along the major axis Y and passing through the core axis O1, and the core sectional areas S03 taken along a plane Xθ set within the angular range of 30° to 65°, achieve a relationship expressed as S03>S02>S01.

In the embodiment, the hole 2 at the neck portion 3 has a circular shape, the inner surface of the funnel portion 1 is continuous to the inner surface of the neck portion 3 and the hole 2 widens toward the opening end at the funnel portion 1. Thus, the distance from the hole 2 at the neck portion 3 to the opening end edge at the funnel portion 1 is the largest within the angular range of 30° to 65° measured around the core axis O1 with regard to the angle θ. This means that the core sectional areas are the largest when the angle θ is within the angular range of 30° to 65°. In addition to the increase in the core sectional areas achieved by adopting the shape described above, the thickness of the funnel portion 1 is increased over the angular range of 30° to 65° with regard to the angle θ in the embodiment, to further increase the core sectional areas. This feature may be clearly ascertained by comparing FIGS. 3 to 5.

In addition, two indented grooves 9 and 11 are provided at the outer circumferential surface along the direction of the minor axis X, with dividing grooves 13 and 15 provided between the indented grooves 9 and 11. The dividing grooves 13 and 15 are each formed on the minor axis X and are V-shaped.

A deflecting yoke constituted of the deflecting yoke core described above may be assembled by dividing the deflecting yoke core along the dividing grooves 13 and 15, providing a vertical deflection coil and a horizontal deflection coil and then refitting the divided core pieces. The horizontal deflection coil is provided by ensuring that the density of the core internal magnetic flux is the lowest on the minor axis X on which the dividing grooves 13 and 15 are formed. The vertical deflection coil generates a vertical deflection magnetic field which intersects at a right angle the horizontal deflection magnetic field generated by the horizontal deflection coil. The two core pieces are coupled by using clips (not shown) that are hooked at the area between the indented grooves 9 and 11.

Figure 6:
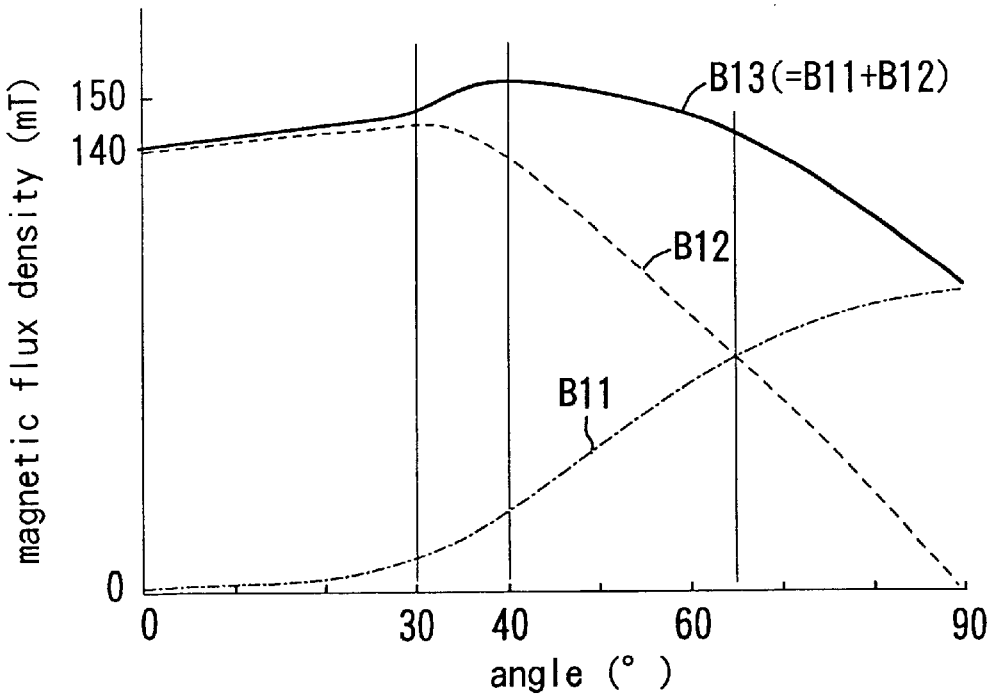
FIG. 6 is a graph showing the characteristics of the core internal magnetic flux density achieved with a deflecting yoke in the prior art.

FIG. 6 is a graph showing the characteristics of the core internal magnetic flux density achieved with a deflecting yoke in the prior art, with its funnel portion and neck portion both formed in a circular shape. In FIG. 6, the horizontal axis represents the angle (°) and the vertical axis represents the density of the core internal magnetic flux (mT). The angle (°) along the horizontal axis indicates values taken around the core axis O1 relative to the 0° reference angle at the minor axis X. Curve B11 represents core internal magnetic flux density characteristics attributable to the horizontal deflection magnetic field, curve B12 represents core internal magnetic flux density characteristics attributable to the vertical deflection magnetic field, and curve B13 represents the combined magnetic flux density characteristics obtained by incorporating the density of the core internal magnetic flux characteristics B11 attributable to the horizontal deflection magnetic field and the density of the core internal magnetic flux characteristics B12 attributable to the vertical deflection magnetic field.

As shown in FIG. 6, when a vertical deflection magnetic field and a horizontal deflection magnetic field are generated with a deflecting yoke constituted by using a deflecting yoke core in the prior art, with its core sectional area around the core axis essentially remaining constant, the combined magnetic flux density does not achieve consistency within the core, as indicated by the characteristics curve B13.

More specifically, the combined magnetic flux density increases drastically as the angle taken around the core axis O1 nears 30° and reaches its maximum around the 40° angle to a level exceeding 150 (mT). This means that when the deflecting yoke core is constituted by using a material having a saturation core internal magnetic flux density of approximately 150 (mT) at a service temperature, a magnetic saturation occurs around the 40° angle which may result in distortion in the image plane. According to the present invention, in which the core sectional area is increased over the range equal to or exceeding the 30° angle, such magnetic saturation can be prevented.

While the density of the core internal magnetic flux becomes lower after the angle exceeds 40°, it still remains fairly high as long as the angle is less than approximately 65°. In addition, in a quadrangle constituted of a long diameter along the major axis Y and a short diameter along the minor axis X formed at the outer shape at the opening end of the funnel portion 1, with the ratio of the long diameter along the major axis Y and a short diameter along the minor axis X at the opening end in the funnel portion 1 set to 4:3 in conformance to the shape of a standard cathode ray tube, the angle formed by the line connecting a corner and the core axis O1 and the short diameter, is approximately 53°.

In a quadrangle constituted of the long diameter along the major axis Y and a short diameter along the minor axis X at the outer shape at the opening end of the funnel portion 1, with the ratio of the long diameter along the major axis Y and a short diameter along the minor axis X at the opening end of the funnel portion 1 set to 16:9 in conformance to another shape often assumed in a cathode ray tube, the angle formed by the line connecting a corner and the core axis O1 and the short diameter, is approximately 60.6°.

In such a deflecting yoke core, it is logical to achieve the largest core sectional areas at the 53° angle or the 60.6° angle relative to the 0° reference angle at the minor axis X. Furthermore, it is necessary to assure core sectional areas which disallow magnetic saturation up to approximately 65° by allowing for the required margin in actual application.

For these reasons, it is ensured in the present invention that the core sectional areas along a plane parallel to and passing through a core axis O1 are largest within an angular range of 30° to 65° measured around the core axis O1 from a 0° reference angle at the minor axis X.

Figure 7:
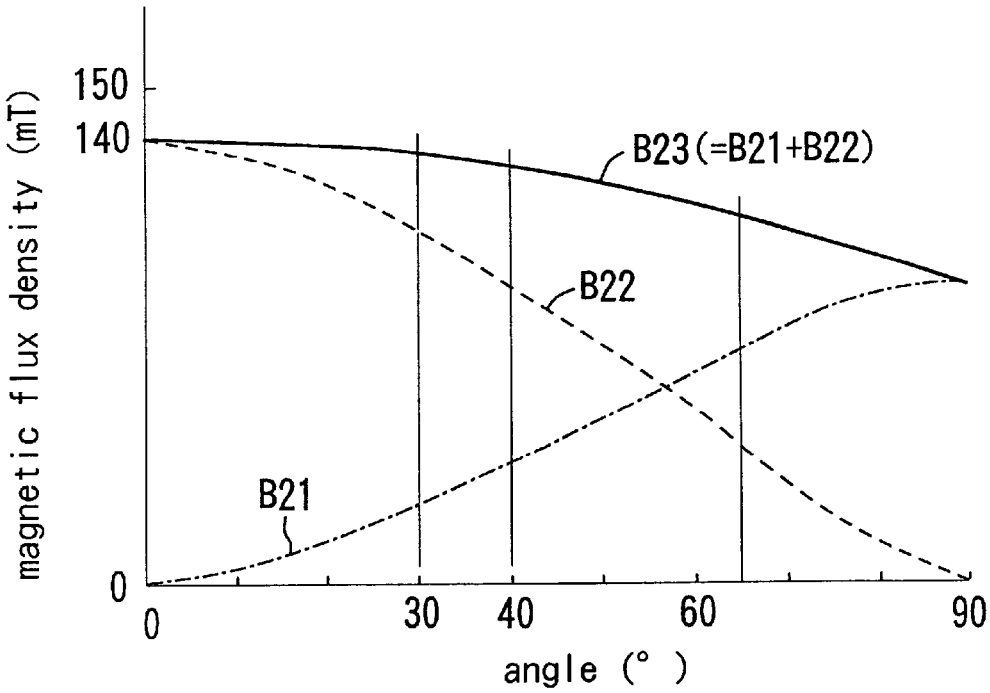
FIG. 7 is a graph showing the characteristics of the core internal magnetic flux density of a deflecting yoke constituted by utilizing a deflecting yoke core according to the present invention.

FIG. 7 is a graph showing the characteristics of the core internal magnetic flux density of a deflecting yoke constituted by utilizing a deflecting yoke core according to the present invention. In FIG. 7, the horizontal axis represents the angle (°) and the vertical axis represents the density of the core internal magnetic flux (mT). The angle (°) indicates values taken around the core axis O1 relative to the 0° reference angle assumed at the minor axis X passing through the core axis O1 in FIG. 1. Curve B21 represents core internal magnetic flux density characteristics attributable to the horizontal deflection magnetic field, curve B22 represents a core internal magnetic flux density characteristics attributable to the vertical deflection magnetic field, and curve B23 represents the combined magnetic flux density characteristics obtained by incorporating the density of the core internal magnetic flux characteristics B21 attributable to the horizontal deflection magnetic field and the density of the core internal magnetic flux characteristics B22 attributable to the vertical deflection magnetic field.

As the combined magnetic flux density characteristics curve B23 in FIG. 7 clearly indicates, the combined magnetic flux density achieved according to the present invention does not increase and is flattened even over the angular range 30° to 65° within which the combined magnetic flux density drastically increases in the prior art. Thus, consistency is achieved in the density of the core internal magnetic flux over the entire core according to the present invention, to prevent the occurrence of local magnetic saturation.

In addition, since the highest combined magnetic flux density never exceeds 140 (mT), as shown in FIG. 7, magnetic saturation does not occur even when a deflecting yoke core is formed by using a material having a saturation core internal magnetic flux density of approximately 150 (mT) at its service temperature. Furthermore, since the core does not need to include any additional portion that is superfluous and added in the prior art only in order to prevent magnetic saturation, the adoption of the present invention will contribute to a reduction in the core weight, miniaturization of the core and a reduction in the production costs, as well.

Another means for preventing magnetic saturation in the deflecting yoke core shown in FIGS. 1 and 2 is provided by ensuring that the core density at core sectional areas along a plane parallel to and passing through a core axis O1 are largest within an angular range of 30° to 65° measured around the core axis O1 from a 0° reference angle at the minor axis X. The position of the minor axis X passing through the core axis O1 corresponds to the position at which the density of the core internal magnetic flux attributable to the horizontal deflection magnetic field is the lowest.

Figure 8:
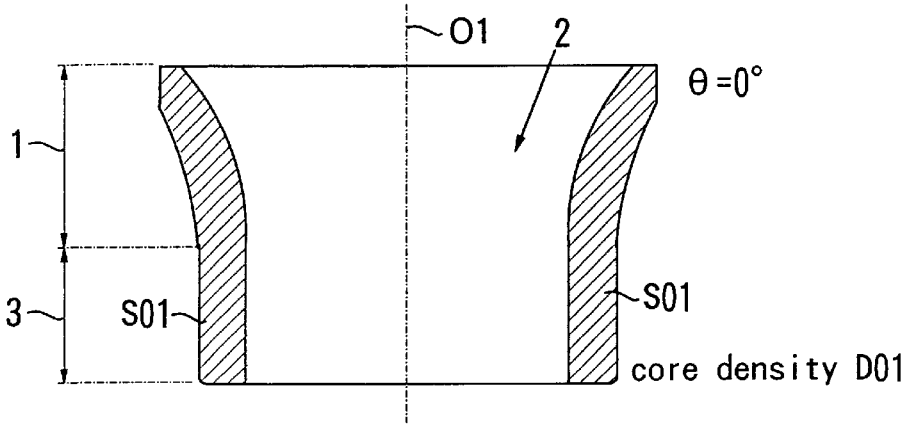
FIG. 8 is a cross-sectional view (θ=0°) along the minor axis X.
Figure 9:
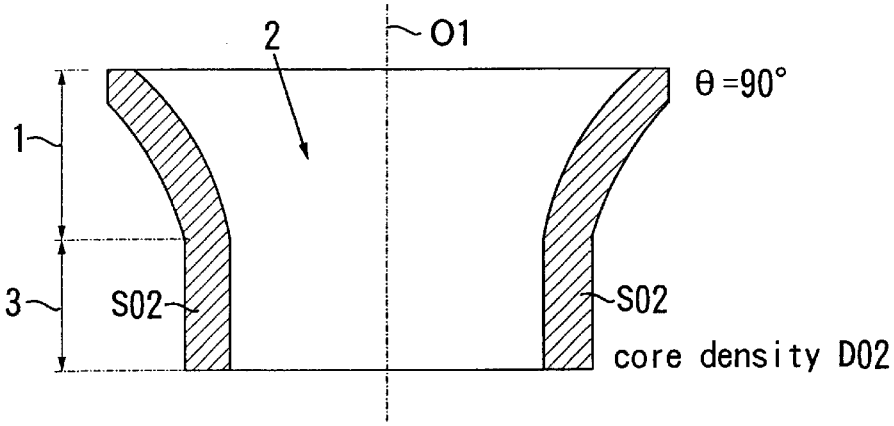
FIG. 9 is a cross-sectional view (θ=90°) along the major axis Y passing through the core axis O1.
Figure 10:
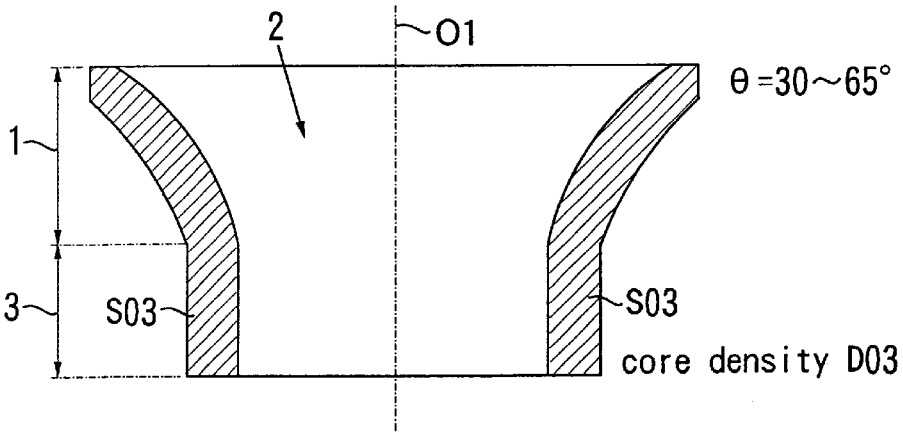
FIG. 10 is a cross-sectional view along a plane Xθ set within an angular range of 30° to 65°.

FIG. 8 is a cross-sectional view taken along a plane achieving a 0° angle, i.e., taken along the minor axis X, FIG. 9 is a cross-sectional view taken along the major axis Y passing through the core axis O1 ($\theta$=90°), and FIG. 10 is a cross-sectional view taken along a plane X$\theta$ set within the angular range of 30° to 65°.

In the figures, the core density D01 at the core sectional areas S01 taken along the minor axis X, the core density D02 at the core sectional areas S02 taken along the major axis Y and passing through the core axis O1 and the core density D03 at the core sectional areas S03 taken along the plane X$\theta$ set within the angular range of 30° to 65° achieve a relationship expressed as D03>D02>D01. The core densities D01 to D03 at the core sectional areas S01 to S03 can be controlled by adopting a specific method for charging the material during the molding process. The thickness of the core may remain essentially the same at the various core sectional areas or it may vary at different core sectional areas.

In the embodiment, the hole 2 at the neck portion 3 has a circular shape, the inner surface of the funnel portion 1 is continuous to the inner surface of the neck portion 3 and the hole 2 widens toward an opening end surface S1. As a result, the distance from the hole 2 at the neck portion 3 to the inner edge of an opening end surface 5 at the funnel portion 1 is the largest within the angular range of 30° to 65° with regard to the angle θ taken around the core axis O1. Thus, the core sectional areas are the largest with respect to the angular range of 30° to 65°.

As explained earlier in detail in reference to FIG. 6, the combined magnetic flux density indicated by the characteristics curve B13 resulting from the vertical deflection magnetic field and the horizontal deflection magnetic field generated in a deflecting yoke formed by using a deflecting yoke core having core sectional areas passing through the core axis that are essentially constant, does not achieve consistency in the core.

More specifically, the combined magnetic flux density increases drastically as the angle taken around the core axis O1 nears 30° and reaches its maximum around the 40° angle to a level exceeding 150 (mT). This means that when the deflecting yoke core is constituted by using a material having a saturation core internal magnetic flux density of approximately 150 (mT) at a service temperature, magnetic saturation occurs around the 40° angle which may result in distortion in the image plane. According to the present invention, in which the core density is increased over the range equal to or exceeding the 30° angle, such magnetic saturation can be prevented.

While the density of the core internal magnetic flux becomes lower after the angle exceeds 40°, it still remains fairly high as long as the angle is less than approximately 65°. In addition, in a quadrangle constituted of the long diameter along the major axis Y and a short diameter along the minor axis X at the outer shape at the opening end of the funnel portion 1, with the ratio of the long diameter along the major axis Y and a short diameter along the minor axis X at the opening end in the funnel portion 1 set to 4:3 in conformance to the shape of a standard cathode ray tube, the angle formed by the line connecting a corner and the core axis O1 and the short diameter is 53°.

In a quadrangle constituted of the long diameter along the major axis Y and a short diameter along the minor axis X at the outer shape at the opening end of the funnel portion 1, with the ratio of the long diameter along the major axis Y and a short diameter along the minor axis X at the opening end of the funnel portion 1 set to 16:9 in conformance to another shape often assumed in a cathode ray tube, the angle formed by the line connecting a corner and the core axis O1 and the short diameter is 60.6°.

When forming such a deflecting yoke core, it is logical to achieve the highest core density at the angle of 53° or the angle of 60.6° relative to the 0° reference angle at the minor axis X. Furthermore, it is necessary to assure a core density which disallows magnetic saturation up to approximately 65° by allowing for the required margin in actual application.

For these reasons, it is ensured in the present invention that the core density at the core sectional areas along a plane parallel to and passing through a core axis O1 is largest within an angular range of 30° to 65° measured around the core axis O1 from a 0° reference angle at the minor axis X.

Any of numerous methods may be adopted to change the core density around the core axis O1 as described above. An example of those methods is presented in FIGS. 11 to 14. The method illustrated in FIGS. 11 to 14 may be adopted in a standard application in which a deflecting yoke core is molded by using ferrite powder.

Figure 11:
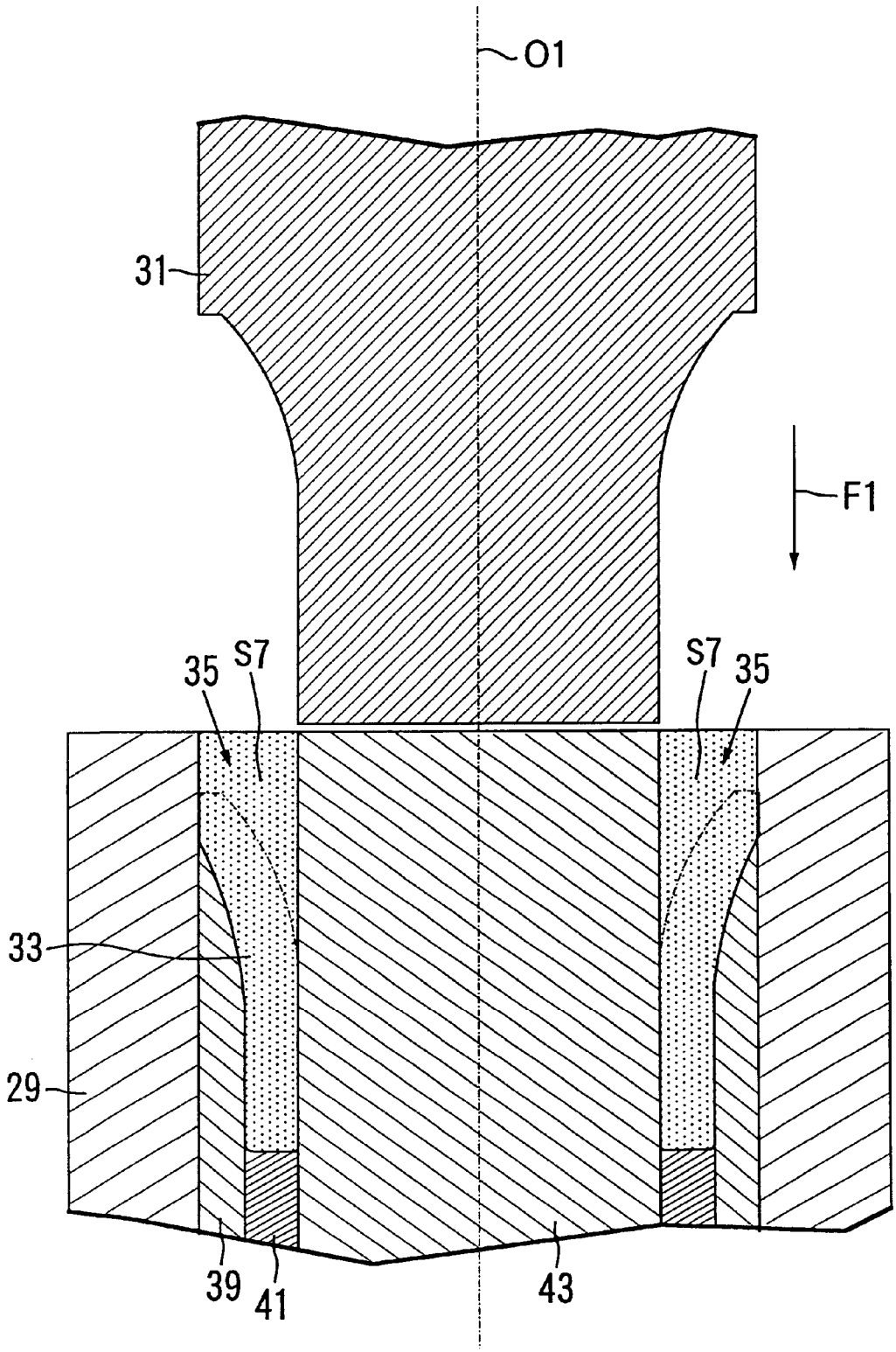
FIG. 11 presents an example of a molding step that may be implemented to manufacture the deflecting yoke core shown in FIGS. 1 and 2.
Figure 12:
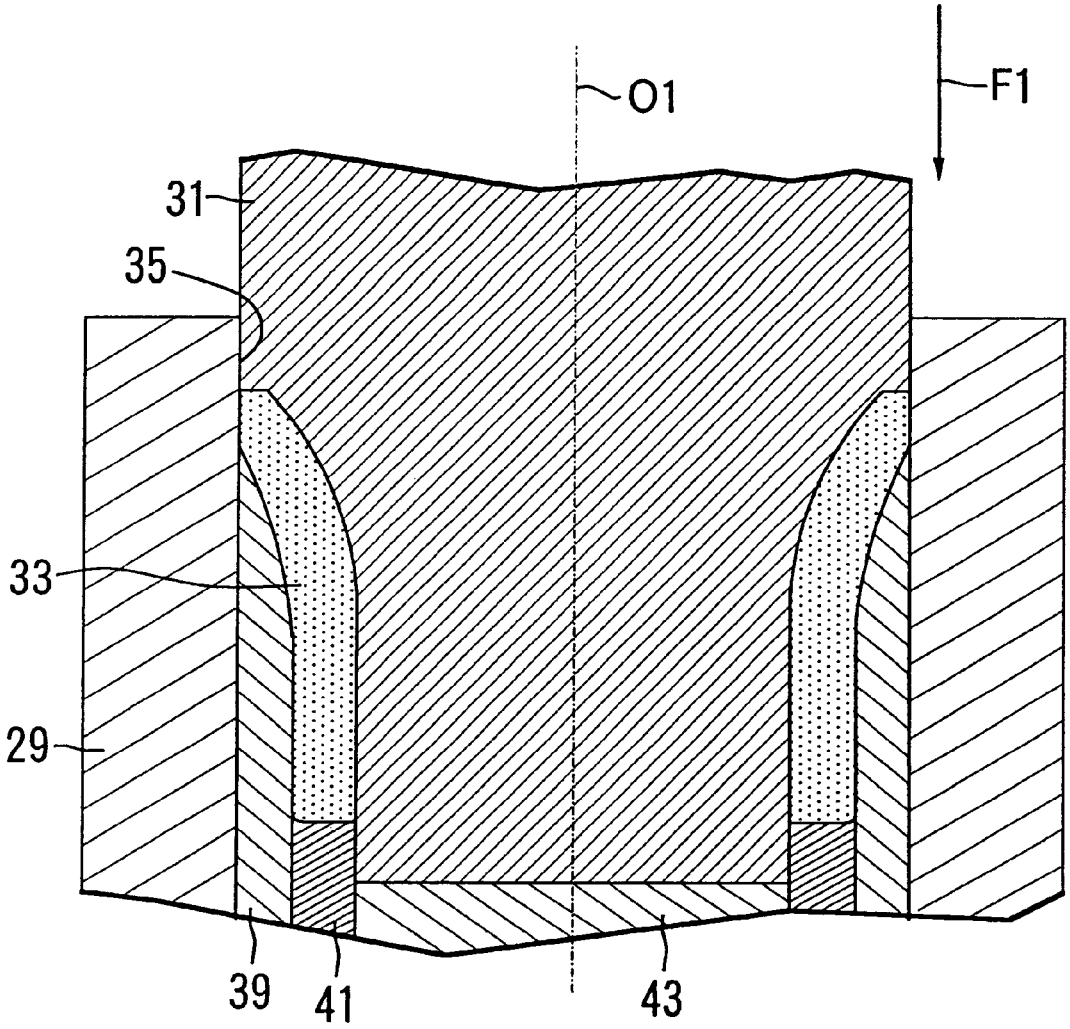
FIG. 12 shows a molding step implemented after the step shown in FIG. 11.

FIGS. 11 and 12 show the molding process viewed on the minor axis X in FIG. 1, with unnecessary details omitted in the illustration. First, as shown in FIG. 11, ferrite powder 33 is charged into a cavity 35 formed by combining lower dies 29, 39, 41 and 43. The area under the one-point chain line in the magnetic powder 33 indicates a molded area that is ultimately achieved, with the area above the one-point chain line indicating a compression area S7 which becomes compressed during the molding process.

An upper die 31 is caused to move along the direction indicated by the arrow F1 to become interlocked with the lower dies 29, 39, 41 and 43, and thus, the magnetic powder 33 becomes pressurized. As a result, the compression area S7 in FIG. 11 is compressed, as illustrated in FIG. 12, thereby molding a deflecting yoke core having the funnel portion 1 and the neck portion 3.

Figure 13:
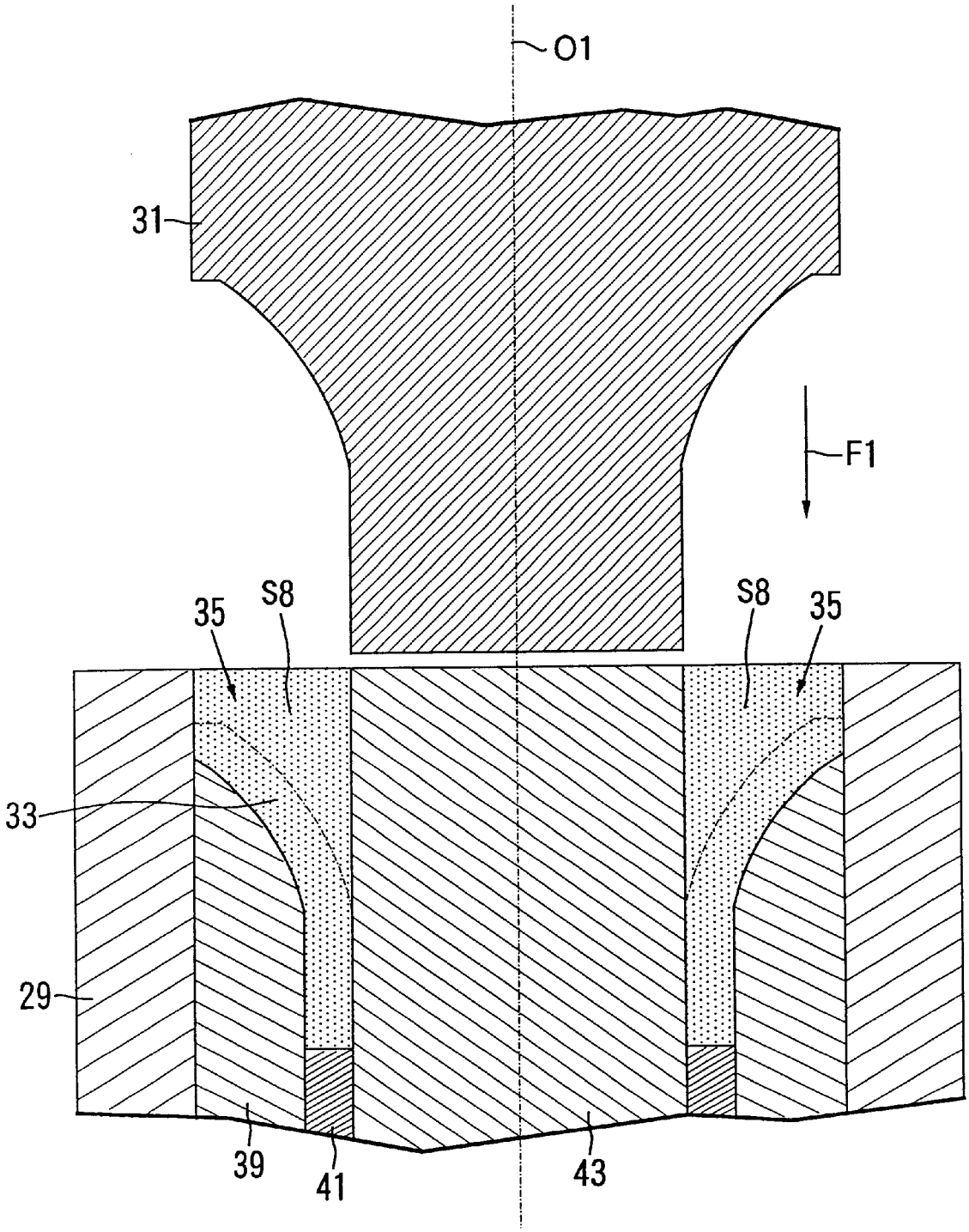
FIG. 13 presents an example of a molding step implemented to manufacture of the deflecting yoke core shown in FIGS. 1 and 2.
Figure 14:
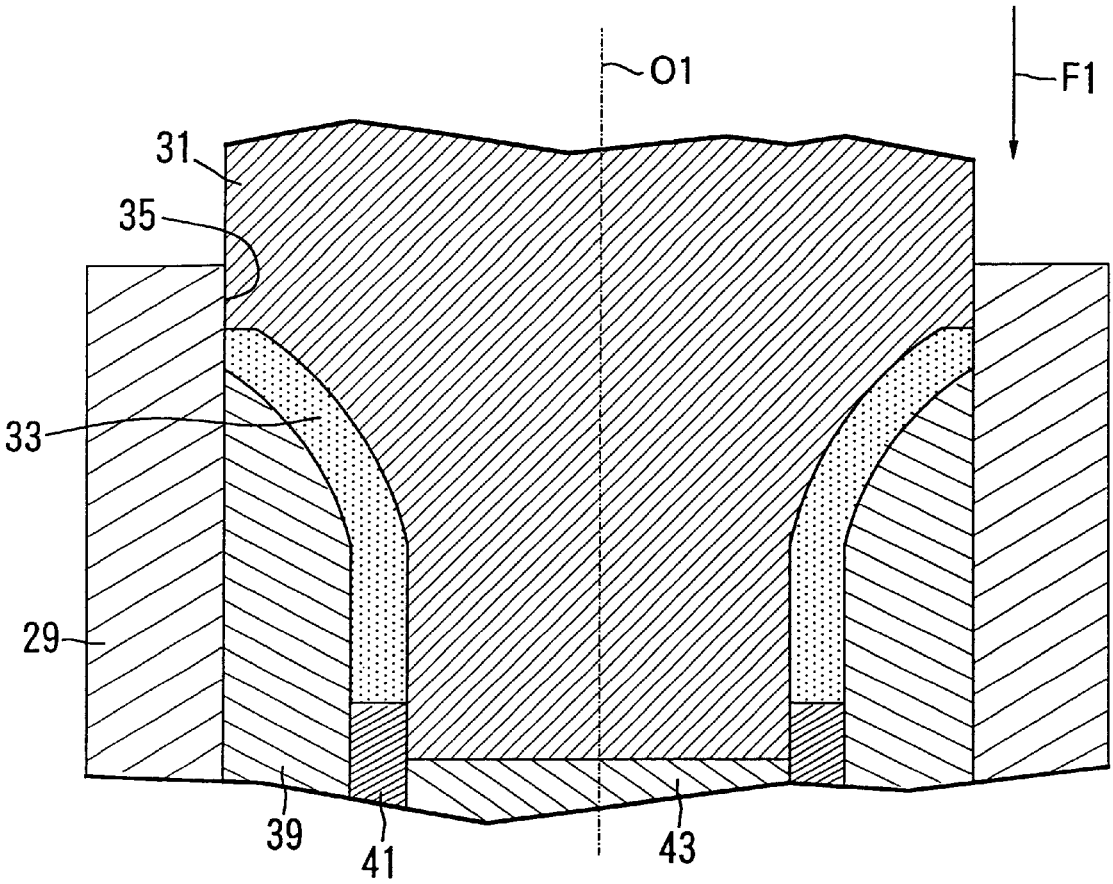
FIG. 14 shows a molding step implemented after the step shown in FIG. 13.

FIGS. 13 and 14 illustrate the molding process viewed with the angle θ in FIG. 1 set at 65°. As shown in FIG. 13, the area below the one-point chain line in the magnetic powder 33 having been charged to fill the cavity 35 indicates the ultimate molded area and the area above the one-point chain line indicates a compression area S8 that becomes compressed through the molding process. This compression area S8 is larger than the compression area S7 (see FIG. 11) viewed on the minor axis X. Thus, when the deflecting yoke core having the funnel portion 1 and the neck portion 3 is molded as illustrated in FIG. 14 by moving the upper die 31 along the direction indicated by the arrow F1 to become interlocked with lower dies 29, 39, 41 and 43 and pressurizing the magnetic powder 33, the core density of the deflecting yoke core is increased.

As explained above, the deflecting yoke core achieving the highest core density within the angular range of 30° to 65° over which the density of the magnetic flux attributable to the combined deflection magnetic field increases, the occurrence of magnetic saturation is prevented within the angular range of 30° to 65° over which the density of the magnetic flux attributable to the combined deflection magnetic field is high (see FIG. 1).

In addition, the occurrence of magnetic saturation is prevented by increasing the core density over the area where the density of the magnetic flux due to the combined deflection magnetic field increases, without changing the core shape. In other words, since it is not necessary for the core to include any portion that is redundant but added in the prior art to prevent magnetic saturation, the adoption of the present invention contributes to a reduction in the core weight, miniaturization of the core and a reduction in the production costs, as well.

FIGS. 11 to 14 simply present an example of a molding method that may be adopted to increase the core density. It is obvious that the deflecting yoke core according to the present invention may be molded through a method other than the method presented in this example.

In the embodiment shown in FIGS. 1 and 2, the core is provided with the dividing grooves 13 and 15 extending in the direction of the core axis O1, roughly on the minor axis X at which the density of the core internal magnetic flux attributable to the horizontal deflection magnetic field is the lowest. Thus, the adverse affect of the presence of the dividing grooves 13 and 15 on the density of the core internal magnetic flux attributable to the horizontal deflection magnetic field which is a high frequency magnetic field is minimized, to reduce the core loss and the quantity of heat generated at the core.

When a structure in which the dividing grooves 13 and 15 are provided at positions facing opposite each other at the outer circumferential surface and the inner circumferential surface, the core constituted of a ferrite molding can be divided with ease. In addition, by forming the dividing grooves 13 and 15 in a V-shape, the core can be divided with further ease.

Figure 15:
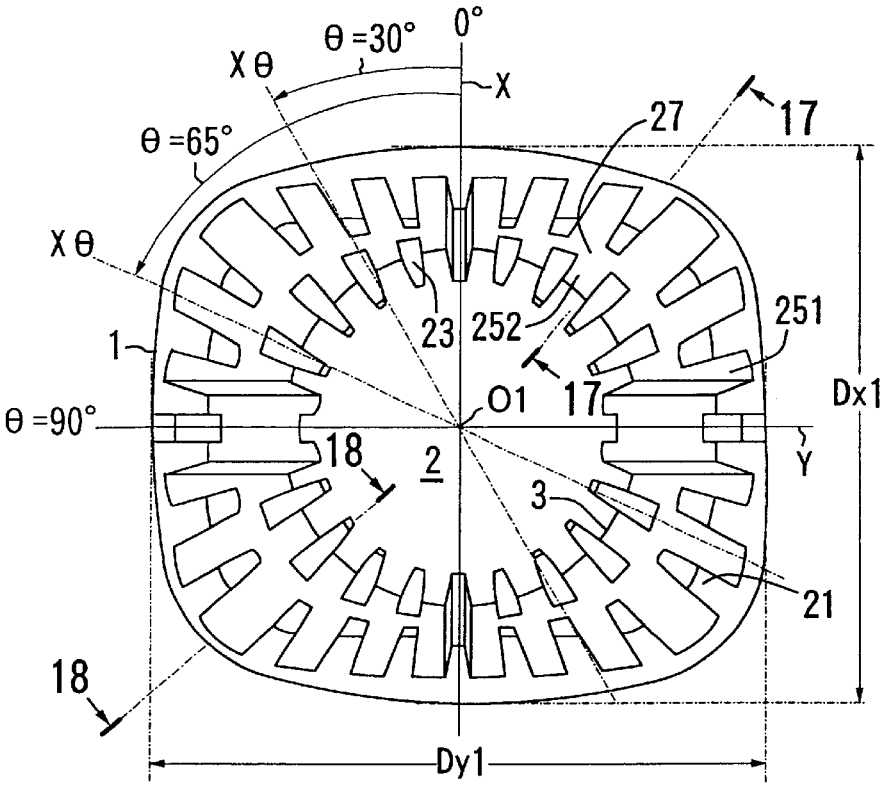
FIG. 15 is a plan view of another embodiment of the deflecting yoke core according to the present invention.
Figure 16:
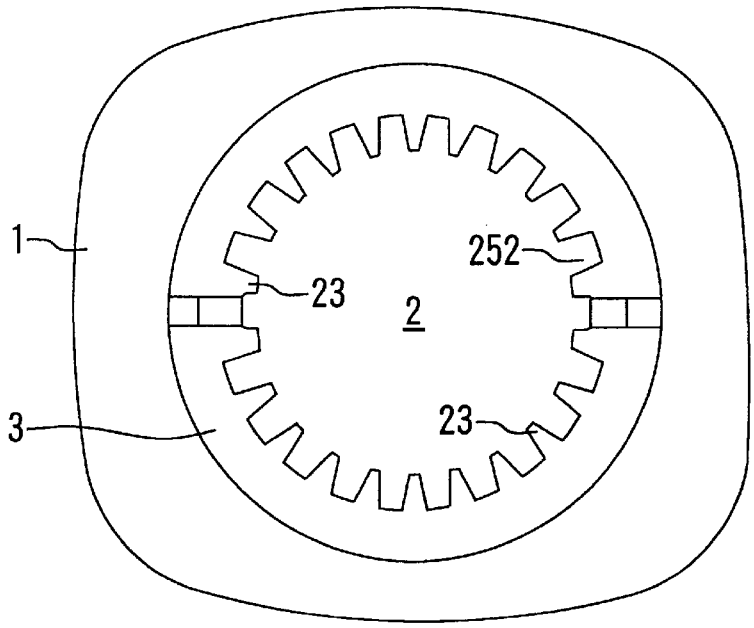
FIG. 16 is a bottom view of the deflecting yoke core shown in FIG. 15.
Figure 17:
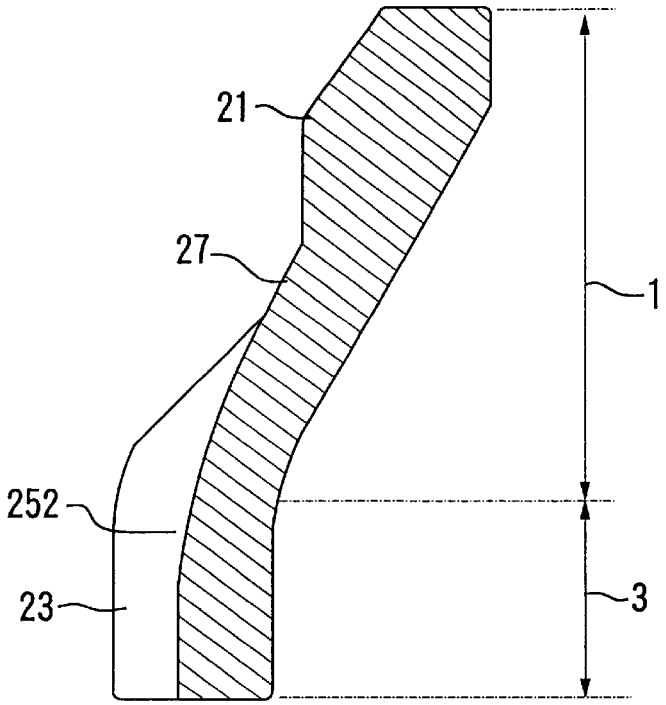
FIG. 17 is an enlarged partial cross-sectional view taken along line 17—17 in FIG. 15.
Figure 18:
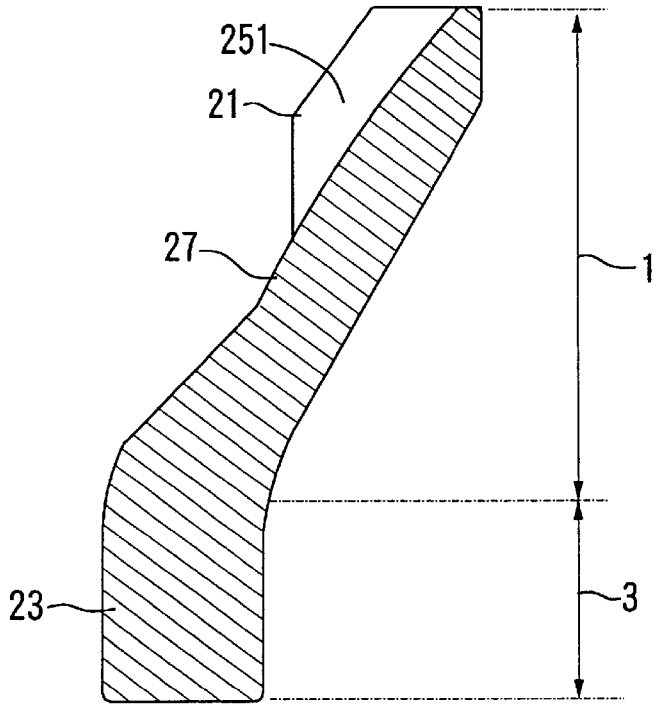
FIG. 18 is an enlarged partial cross-sectional view taken along line 18—18 in FIG. 15.

FIG. 15 is a plan view of a deflecting yoke core according to the present invention, FIG. 16 is a bottom view of the deflecting yoke core shown in FIG. 15, FIG. 17 is an enlarged view of the end surface along line 17—17 in FIG. 15, and FIG. 18 is an enlarged view of the end surface along line 18—18 in FIG. 15. The outer shape of the funnel portion 1 at an opening end is a rounded quadrilateral shape, i.e., a roughly quadrilateral shape with arched sides having two sides facing opposite each other over the minor axis X and which are longer than two sides facing opposite each other over the major axis Y.

In this embodiment, too, the core sectional areas along a plane parallel to and passing through a core axis O1 are largest within an angular range of 30° to 65° measured around the core axis O1 from a 0° reference angle at the minor axis X. The position of the minor axis X passing through the core axis O1 corresponds to the position of the diameter at which the density of the core internal magnetic flux attributable to the horizontal deflection magnetic field is the lowest.

The deflecting yoke core illustrated in the figures includes a plurality of projecting portions 21 and 23 provided in a radial pattern along the inner surface from the neck portion 3 toward the funnel portion 1 with a plurality of grooves 251 and 252 formed between the plurality of projecting portions 21 and between the plurality of projecting portions 23, as shown in the enlarged views of the end surface presented in FIGS. 17 and 18. The projecting portions 21 are provided at the inner surface in the funnel portion 1. The projecting portions 23 are provided at the inner surface in the neck portion 3, separated from the projecting portions 21 by a separating portion 27.

Figure 19:
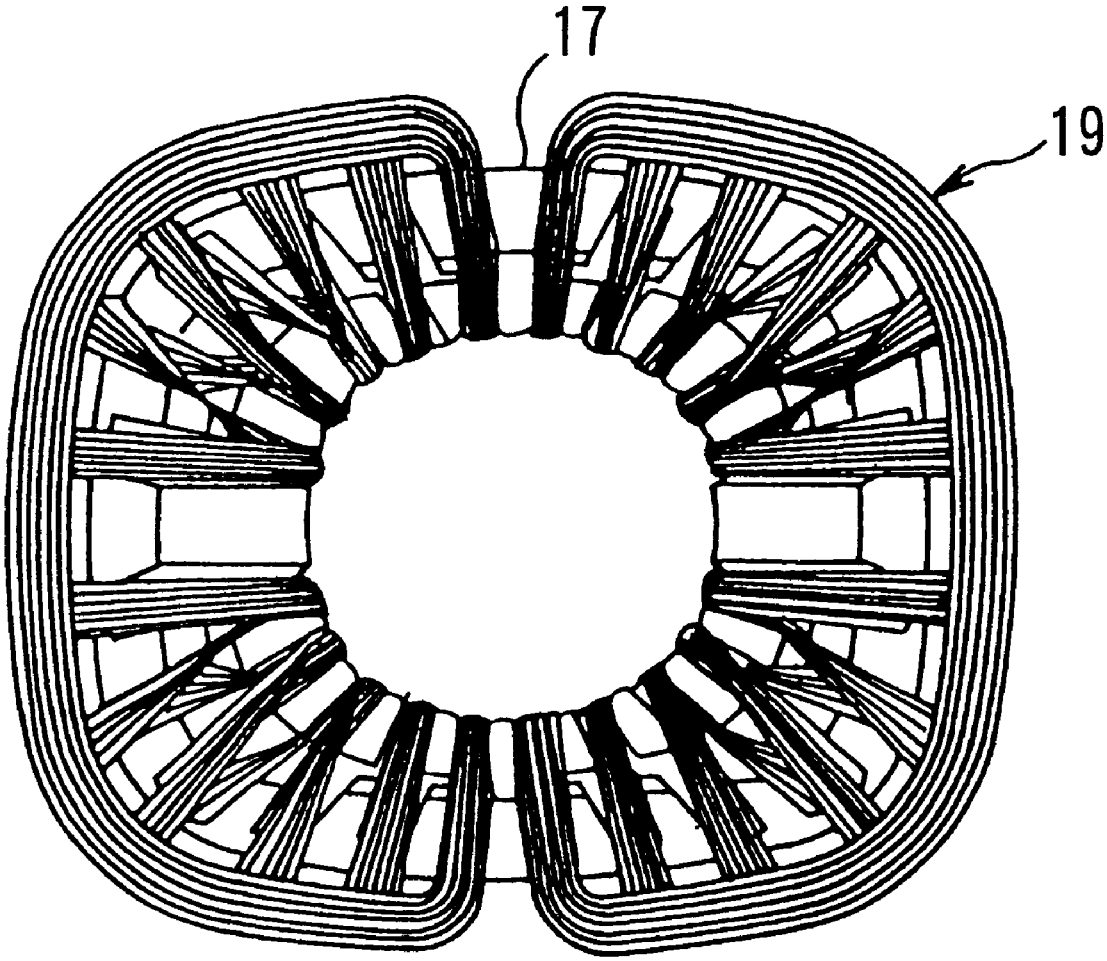
FIG. 19 is a plan view showing a deflecting yoke constituted by using the deflecting yoke core shown in FIGS. 15 to 18.

FIG. 19 shows a deflecting yoke constituted by using the deflecting yoke core shown in FIGS. 15 to 18. As shown in FIG. 19, the vertical deflection coil of the deflection coils 19 is positioned via the separating portion 27 located between the separated projecting portions 21 and 23, as shown in FIG. 19 (see also FIGS. 15 to 18). Although not shown, the deflecting yoke is also provided with a horizontal deflection coil.

Since the grooves 251 and 252 are formed between the projecting portions 21 and 21 and between the projecting portions 23 and 23, the deflection coils 19 can be wound inside the grooves 251 and 252 formed between the projecting portions 21 and 21 and between the projecting portions 23 and 23, to ensure that the deflection coils 19 cannot become misaligned.

In addition, since the outer shape of the funnel portion 1 is roughly rectangular in the embodiment, the deflection sensitivity can be effectively improved and, at the same time, the magnetic flux can be concentrated with a high degree of efficiency by providing the coil at the grooves 251 and 252 formed between the projecting portions 21 and 21 and between the projecting portions 23 and 23, to further improve the deflection sensitivity.

Furthermore, since the projecting portions 23 at the neck portion 3 and the projecting portions 21 at the funnel portion 1 are separated from each other by the separating portion 27, it is possible to adjust the distribution of the deflection coils 19 in a radial pattern and in a non-radial pattern, for instance, to facilitate correction of distortion or misconvergence manifesting after the deflecting yoke is assembled.

In the embodiment, the number of the projecting portions 21 at the funnel portion 1 is equal to or larger than the number of the projecting portions 23 at the neck portion 3. In such a structure, part of the vertical deflection coil provided at the plurality of grooves 251 and 252 formed between the plurality of projecting portions 23 and 23 at the neck portion 3 can be branched at the separating portion 27 to set the branched portion at the plurality of grooves 251 and 252 formed at the funnel portion 1. Thus, the vertical deflection coil can be positioned differently on the funnel portion from the positioning arrangement on the neck portion, to afford a higher degree of freedom in the positioning arrangement. This is extremely desirable in terms of deflecting yoke design.

In this embodiment, too, the core density at the core sectional areas along a plane parallel to and passing through a core axis O1 is largest within an angular range of 30° to 65° measured around the core axis O1 from a 0° reference angle at the minor axis X. The position of the minor axis X passing through the core axis O1 corresponds to the position of the diameter at which the density of the core internal magnetic flux attributable to the horizontal deflection magnetic field is the lowest.

A further explanation is given in reference to FIGS. 1 and 2. In the embodiment shown in FIGS. 1 and 2, the dividing grooves 13 and 15 are provided along the direction of the core axis O1 roughly on the minor axis X at which the density of the core internal magnetic flux attributable to the horizontal deflection magnetic field is the lowest. The minor axis X corresponds to the diameter at which the density of the magnetic flux attributable to the horizontal deflection magnetic field is the lowest, whereas the major axis Y corresponds to the diameter at which the density of the magnetic flux attributable to the horizontal deflection magnetic field is the highest.

Dividing grooves are provided on the major axis Y in the prior art, which means that the positions of the dividing grooves 12 to 15 according to the present invention are shifted from the positions assumed in the prior art by approximately 90°. In FIGS. 1 and 2, two indented grooves 9 and 11 are provided at the outer circumferential surface along the direction of the minor axis X, with the dividing grooves 13 and 15 provided between the indented grooves 9 and 11. The dividing grooves 13 and 15 on the minor axis X are each V-shaped.

A deflecting yoke constituted of the deflecting yoke core described above may be assembled by dividing the deflecting yoke core along the dividing grooves 13 and 15, providing a vertical deflection coil and a horizontal deflection coil and then refitting the divided core pieces. The horizontal deflection coil is provided by ensuring that the density of the core internal magnetic flux is the lowest on the minor axis X on which the dividing grooves 13 and 15 are formed. The vertical deflection coil generates a vertical deflection magnetic field which intersects at a right angle the horizontal deflection magnetic field generated by the horizontal deflection coil. The two core pieces are coupled by using clips (not shown) that are hooked at the area between the indented grooves 9 and 11.

Since the dividing grooves 13 and 15 are provided roughly on the minor axis X at which the density of the core internal magnetic flux attributable to the horizontal deflection magnetic field is the lowest, the adverse effect of the presence of the dividing grooves 13 and 15 on the density of the core internal magnetic flux attributable to the horizontal deflection magnetic field which is a high-frequency magnetic field is minimized, to reduce core loss and the quantity of heat generated at the core.

The dividing grooves 13 and 15 are provided at positions facing opposite each other at the outer circumferential surface and the inner circumferential surface. By adopting such a structure, the core constituted of a magnetic powder molding such as a ferrite powder molding can be divided with ease. In addition, by forming the dividing grooves 13 and 15 in a V-shape, the core can be divided with further ease.

Figure 20:
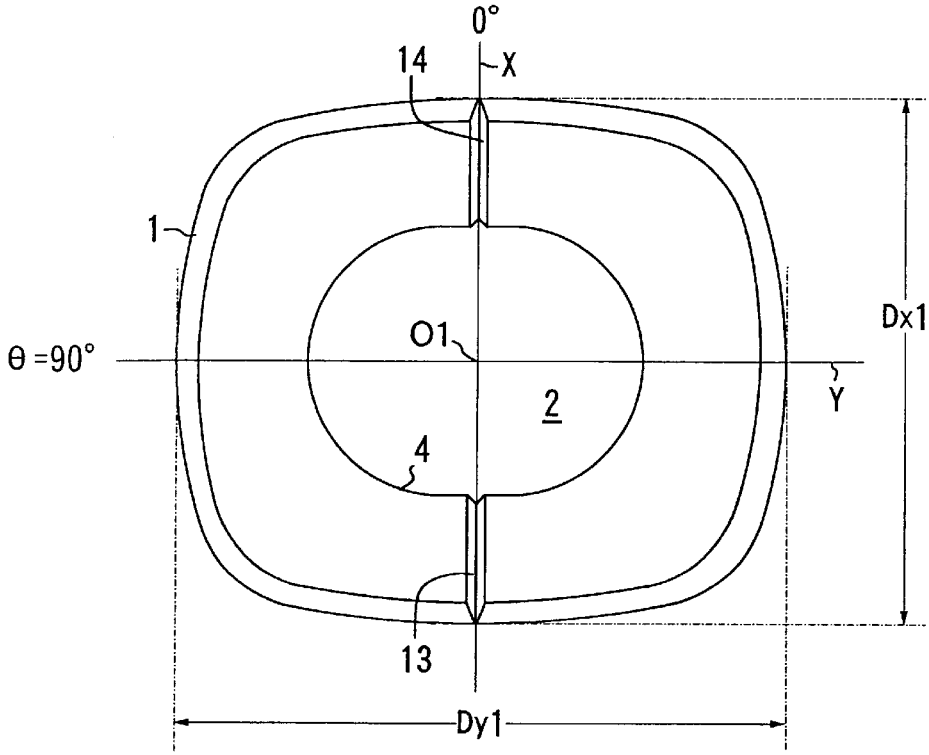
FIG. 20 is a plan view of yet another embodiment of the deflecting yoke core according to the present invention.
Figure 21:
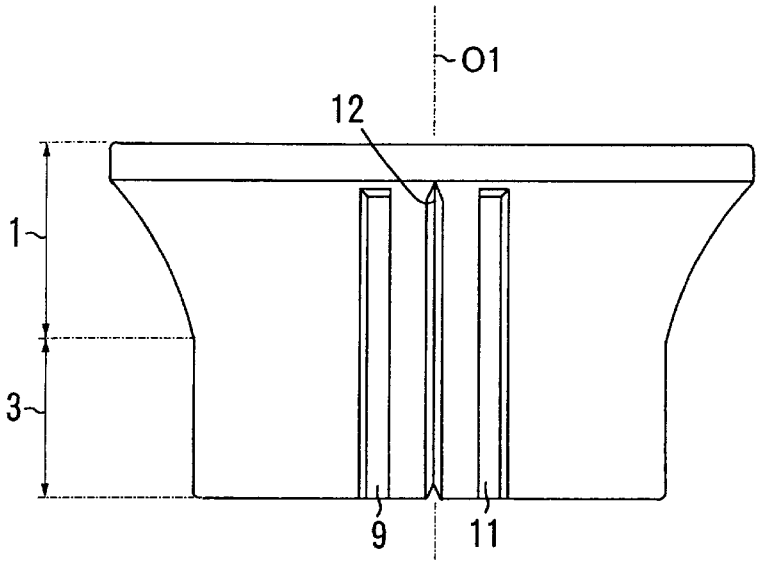
FIG. 21 is a front view of the deflecting yoke core shown in FIG. 20.
Figure 22:
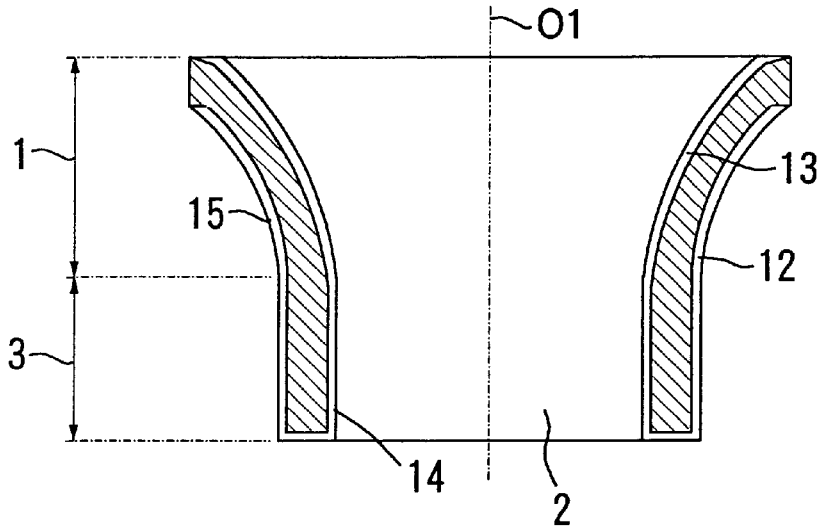
FIG. 22 is a cross-sectional view of the deflecting yoke core shown in FIG. 20.
Figure 23:
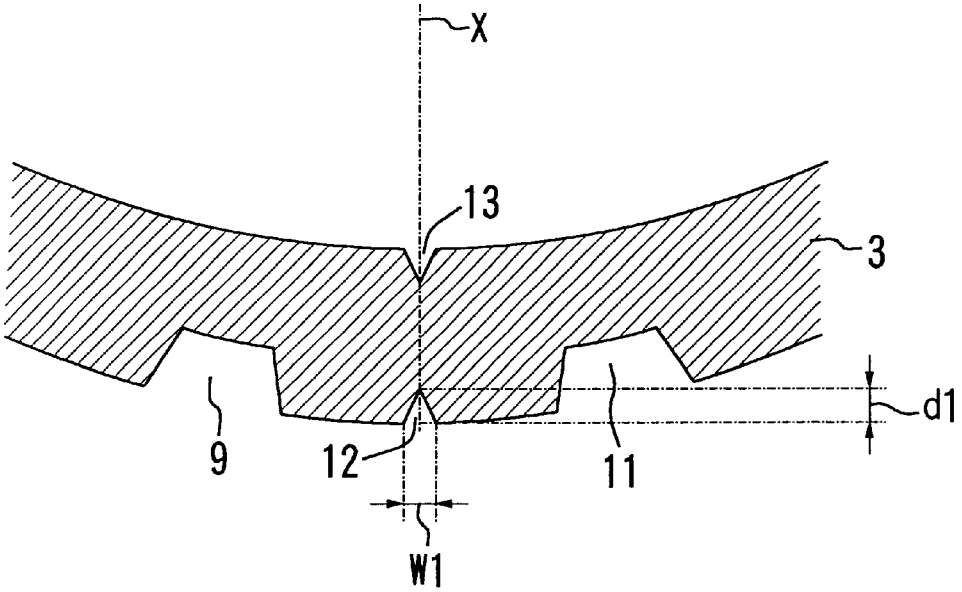
FIG. 23 is an enlarged lateral section of the deflecting yoke core shown in FIG. 20.

FIG. 20 is a plan view of another embodiment of the deflecting yoke core according to the present invention, FIG. 21 is a front view of the deflecting yoke core in FIG. 20, FIG. 22 is a cross-sectional view taken along the minor axis X in FIG. 20, and FIG. 23 is an enlarged lateral section of FIG. 20. In the figures, the same reference numerals are assigned to components identical to those shown in FIGS. 1 and 2. In the embodiment, the neck portion 3 is formed in an elliptic-like shape having a long diameter along the major axis Y and a short diameter along the minor axis X that align with the long diameter along the major axis Y and a short diameter along the minor axis X at the funnel portion 1. This deflecting yoke core is suitable for application in a color television image receiver having three electron guns corresponding to the three primary colors in an in-line structure. The hole 2 at the neck portion 3 may have a circular shape.

At its opening end, the funnel portion 1 achieves a rounded quadrilateral shape, i.e., a roughly quadrilateral shape with arched sides having two sides facing opposite each other over the minor axis X and which are longer than two sides facing opposite each other over the major axis Y, as in the embodiment illustrated in FIGS. 1 and 2. Alternatively, the outer shape may be an oval or the like as well. The shape of the hole 2 formed in the funnel portion 1, too, may be changed in conformance to the outer shape assumed at the funnel portion 1.

The outer shape of the neck portion 3 and the shape of the hole 2 formed at the neck portion 3 may be circular or they may assume a shape identical to that adopted in the funnel portion 1. The minor axis X and the major axis Y pass through the core axis O1 and intersect each other at a right angle.

At the core surface near the minor axis X, dividing grooves 12 to 15 extending in the direction of the core axis O1 are provided. In the embodiment, the dividing grooves 12 to 15 extend linearly and are made to open at the opening end edge at the neck portion 3. In addition, the dividing grooves 12 to 15 are provided at positions facing opposite each other at the outer circumferential surface and the inner circumferential surface. The dividing grooves 12 to 15 are each formed in a V-shape. Their depth d1 and width W1 (see FIG. 23) may both be set at, for instance, approximately 1 mm.

The dividing groove 12 provided at the outer circumferential surface and the dividing groove 13 provided at the inner circumferential surface are formed continuous to each other via a linking groove provided at the opening end surface of the neck portion 3. The dividing groove 15 provided at the outer circumferential surface and the dividing groove 14 provided at the inner circumferential surface are also formed continuous to each other via a linking groove provided at the opening end surface of the neck portion 3. However, unlike the dividing grooves in the figures, the dividing groove 12 and the dividing groove 13 need not be continuous to each other. Likewise, the dividing groove 14 and the dividing groove 15 need not be continuous to each other.

In the embodiment, indented grooves 9 and 11 are provided on the two sides of each dividing groove 12 to 15 formed at the outer circumferential surface along the dividing grooves 12 to 15.

As explained earlier, when a vertical deflection magnetic field and a horizontal deflection magnetic field are created by constituting a deflecting yoke with a deflecting yoke core, the magnetic flux density B11 attributable to the horizontal deflection magnetic field assumes the smallest value near the minor axis X corresponding to the 0° reference angle.

In the embodiment of the invention, the dividing grooves 12 to 15 extending in the direction of the core axis O1 are provided roughly on the minor axis X at which the density of the magnetic flux attributable to the horizontal deflection magnetic field is the lowest. As a result, the adverse effect of the presence of the dividing grooves 12 to 15 on the density of the magnetic flux attributable to the horizontal deflection magnetic field is minimized, to achieve reductions in the core loss and the heat generated at the core.

Since the dividing grooves 12 to 15 extend linearly and open at the opening end edge at the neck portion 3 in the embodiment, the core constituted by molding magnetic powder such as ferrite powder or magnetic metal powder can be rapped out smoothly.

In addition, since the dividing grooves 12 to 15 are provided at positions facing opposite each other at the outer circumferential surface and the inner circumferential surface, the core constituted of a magnetic powder molding can be divided with ease. Furthermore, since the dividing groove 12 (15) provided at the outer circumferential surface and the dividing groove 13 (14) provided at the inner circumferential surface are made continuous to each other via a linking groove formed at the opening end surface of the neck portion 3, the core can be divided with further ease. The core division is even further facilitated by forming the dividing grooves 12 to 15 in a V-shape.

Figure 24:
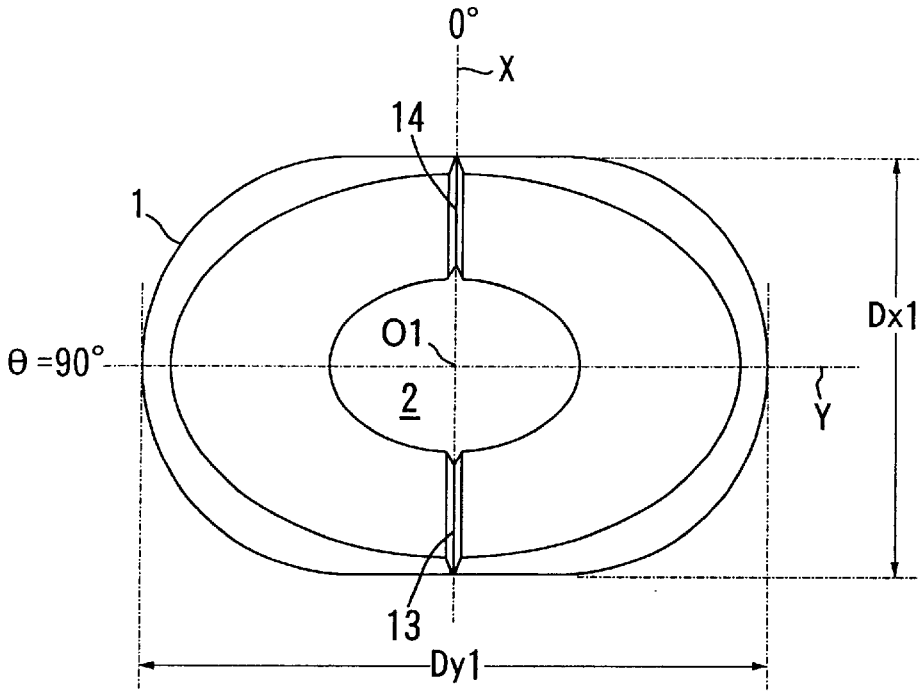
FIG. 24 is a plan view of yet another embodiment of the deflecting yoke core according to the present invention.
Figure 25:
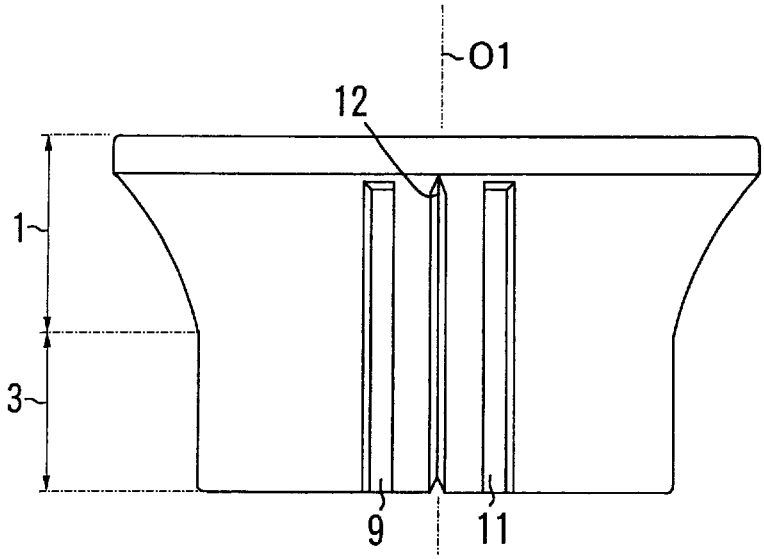
FIG. 25 is a front view of the deflecting yoke core shown in FIG. 24.

FIG. 24 is a plan view of yet another embodiment of the deflecting yoke core according to the present invention and FIG. 25 is a front view of the deflecting yoke core shown in FIG. 24. In this embodiment, the funnel portion 1 and the neck portion 3 are both formed in an oval-like shape. With the dividing grooves 12 to 15 provided roughly on the minor axis X at which the density of the magnetic flux attributable to the horizontal deflection magnetic field is the lowest, reductions in the core loss and the quantity of heat generated at the core are achieved.

Figure 26:
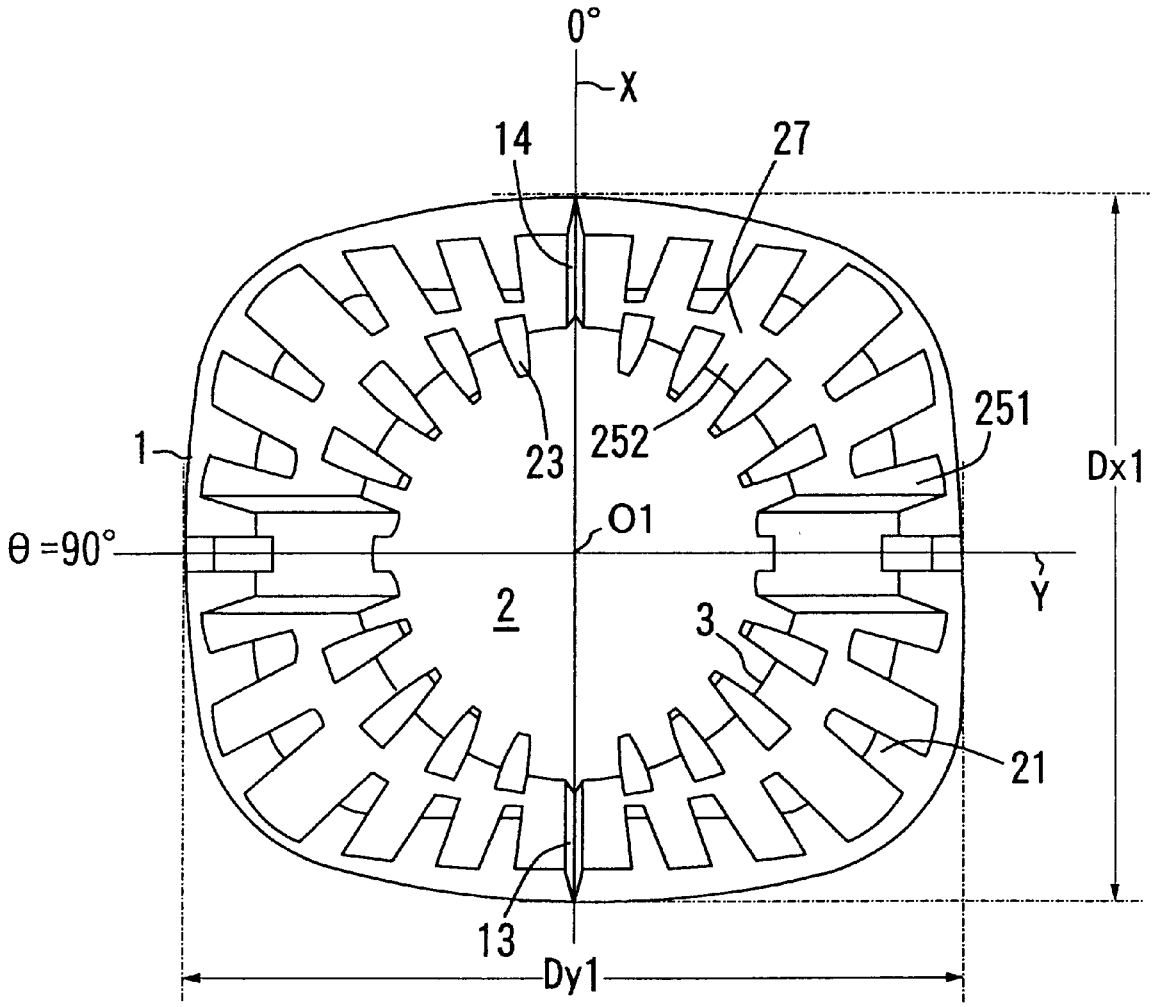
FIG. 26 is a plan view of yet another embodiment of the deflecting yoke core according to the present invention.
Figure 27:
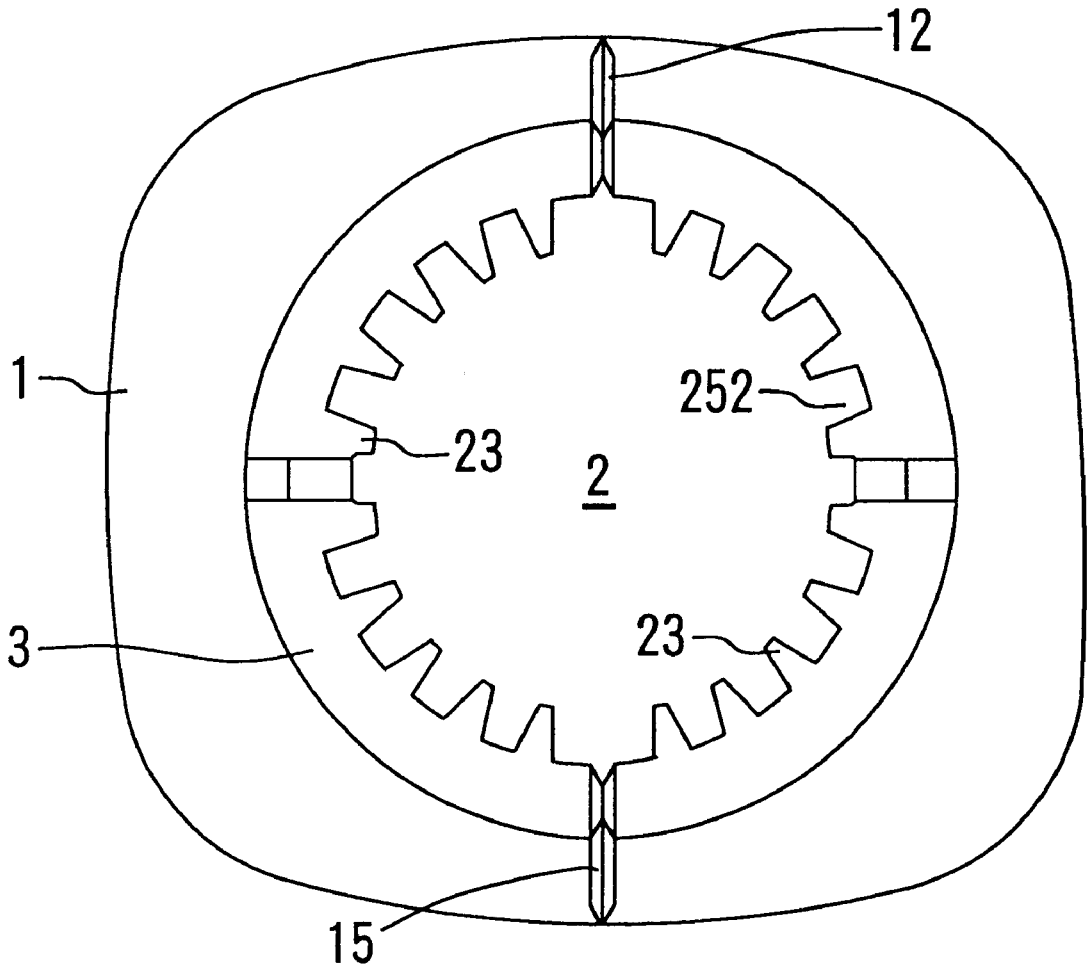
FIG. 27 is a bottom view of the deflecting yoke core shown in FIG. 26.

FIG. 26 is a plan view of yet another embodiment of the deflecting yoke core according to the present invention and FIG. 27 is a bottom view of the deflecting yoke core shown in FIG. 26. Since the basic structure assumed in the deflecting yoke core in FIGS. 26 and 27 is essentially identical to that illustrated in FIGS. 15 to 18, a repeated explanation is omitted. In addition, since the advantages of the deflecting yoke core in FIGS. 26 and 27 are the same as those explained earlier in reference to FIGS. 15 to 18, a repeated explanation is omitted.

The feature in FIGS. 26 and 27 that should be noted is that the dividing grooves 12 to 15 are formed on or near the minor axis X. By adopting such a structure, the adverse effect of the presence of the dividing grooves 12 to 15 on the density of the magnetic flux attributable to the horizontal deflection magnetic field is minimized to reduce the core loss and the heat generated at the core.

As mentioned above, an earlier explanation given in reference to FIGS. 15 to 18 precludes the necessity for a repeated explanation on the advantages achieved by the deflecting yoke core shown in FIGS. 26 and 27. In addition, core saturation may be prevented when a horizontal deflection magnetic field and a vertical deflection magnetic field are created in a deflecting yoke constituted of any of the deflecting yoke cores shown in FIGS. 20 to 27 and deflection coils by ensuring that the core sectional areas along a plane parallel to and passing through a core axis O1 are largest within an angular range of 30° to 65° measured around the core axis O1 from a 0° reference angle at the minor axis X, as explained earlier.

Figure 28:
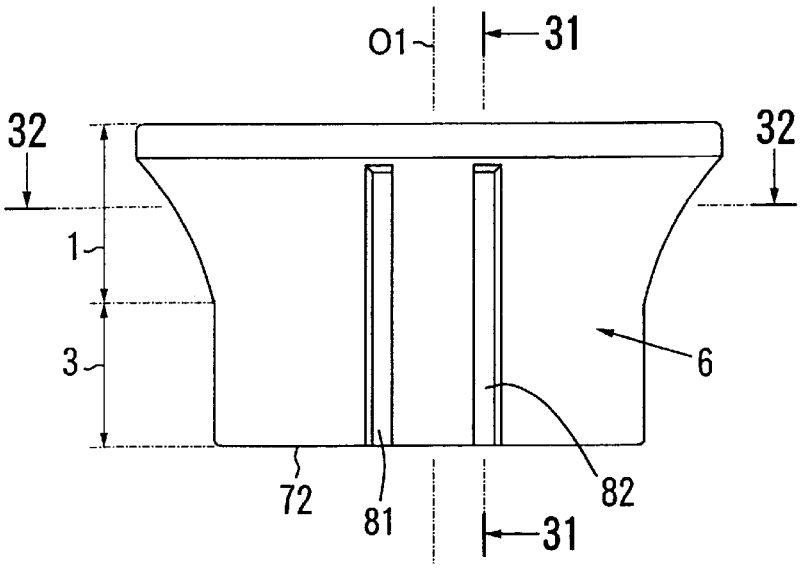
FIG. 28 is a front view of yet another embodiment of the deflecting yoke core according to the present invention.
Figure 29:
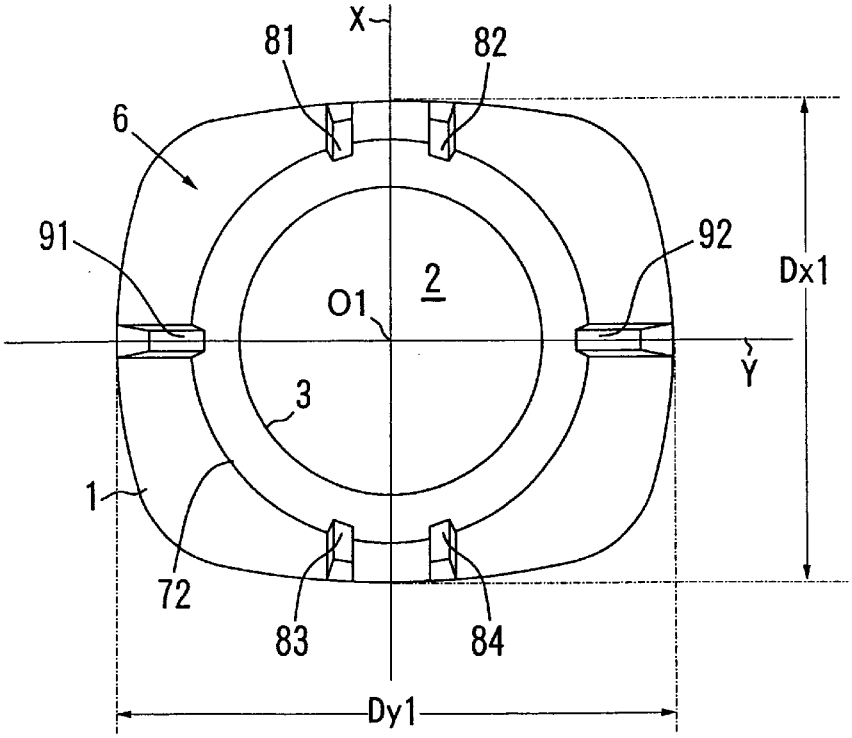
FIG. 29 is a bottom view of the deflecting yoke core shown in FIG. 28.
Figure 30:
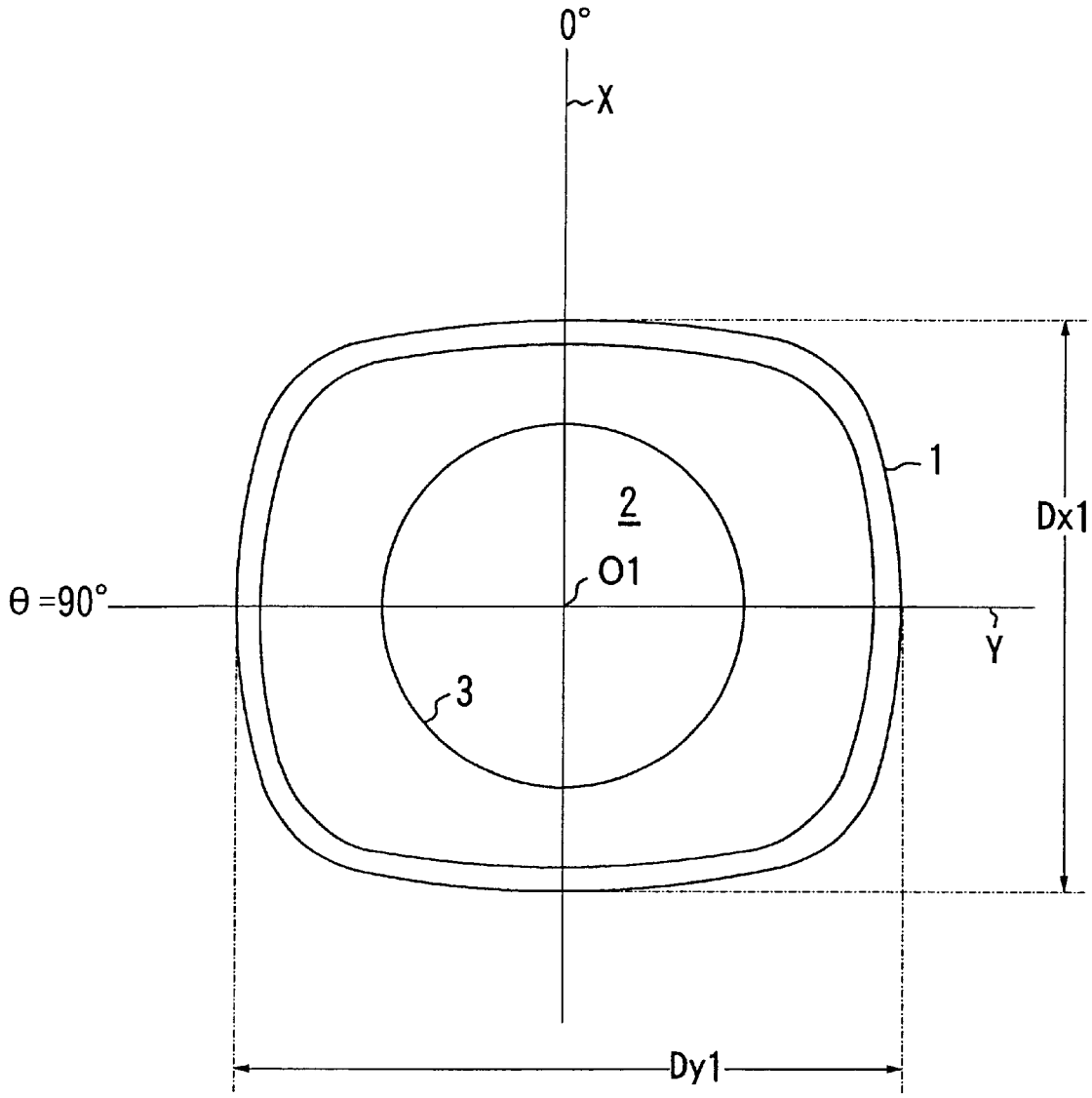
FIG. 30 is a plan view of the deflecting yoke core shown in FIG. 28.
Figure 31:
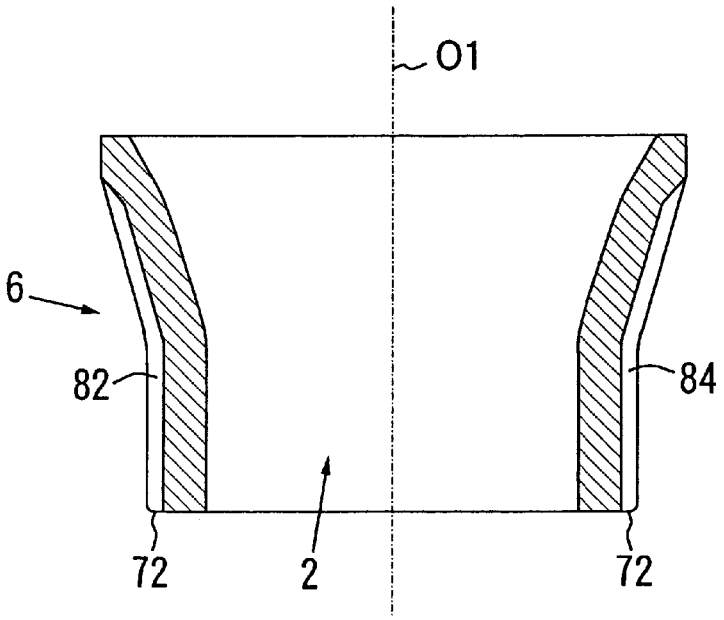
FIG. 31 is a cross-sectional view taken along line 31—31 in FIG. 28.
Figure 32:
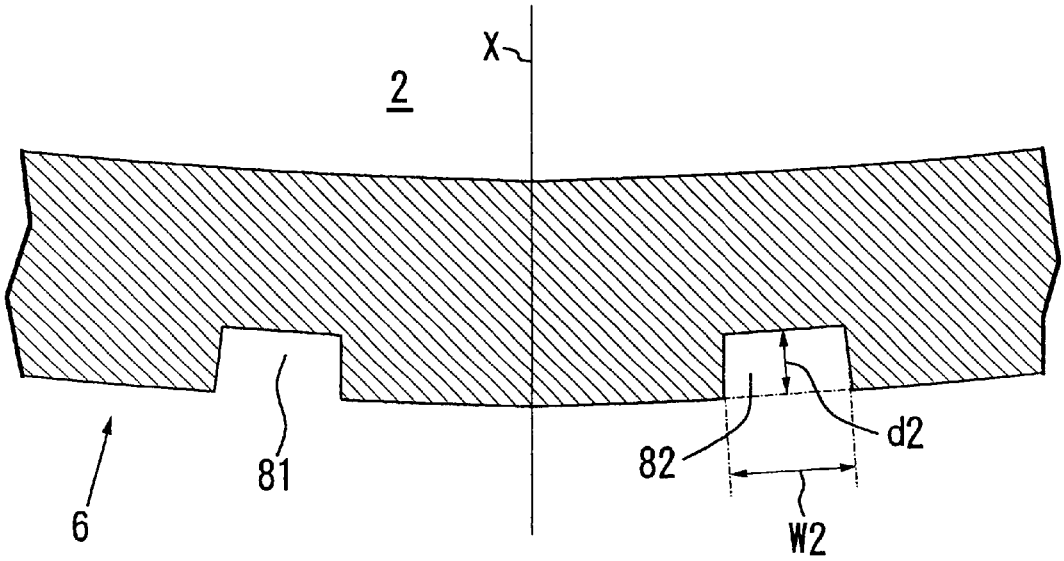
FIG. 32 is an enlarged partial cross-sectional view taken along line 32—32 in FIG. 28.

FIG. 28 is a front view of yet another embodiment of the deflecting yoke core according to the present invention, FIG. 29 is a bottom view of the deflecting yoke core shown in FIG. 28, and FIG. 30 is a plan view of the deflecting yoke core shown in FIG. 28. In addition, FIG. 31 is a cross-sectional view taken along line 31—31 in FIG. 28, and FIG. 32 is an enlarged cross-sectional view taken along line 32—32 in FIG. 28. Since the opening ends at the neck portion 3 and the funnel portion 1 in the deflecting yoke core in FIGS. 28 and 29 are formed in shapes identical to those assumed in the embodiment in FIGS. 1 and 2, the same reference numerals are assigned to components identical to those in FIGS. 1 and 2, to preclude the necessity for a repeated explanation thereof.

The deflecting yoke core in the figures is provided with, at least, one first indented portion 81 to 84 at an outer circumferential surface 6 near the minor axis X. The number of the first indented portions is arbitrary. The first indented portions 81 to 84 are provided at the outer circumferential surface 6 near the minor axis X. More specifically, the first indented portions 81 to 84 are provided at the outer circumferential surface 6 at two ends of the minor axis X. In even more specific terms, the first indented portions 81 and 82 among the first indented portions 81 to 84 are provided at the outer circumferential surface 6 at one end of the minor axis X whereas the first indented portions 83 and 84 are provided at the outer circumferential surface 6 at the other end of the minor axis X.

In addition, the first indented portions 81 and 82 are formed over a distance from each other at the outer circumferential surface 6 at one end of the minor axis X in the embodiment. Likewise, the first indented portions 83 and 84 are formed over a distance from each other at the outer circumferential surface 6 at the other end of the minor axis X.

The first indented portions 81 to 84 in the figures are formed as linear grooves extending in the direction of the core axis O1. These grooves open at an opening end edge 72 constituting the outer edge of the neck portion 3. The first indented portions 81 to 84 each constituted of a groove may have a depth d2 of 2 mm and a width W2 of 4 mm, for instance (see FIG. 32).

The deflecting yoke core in the figures is provided with, at least, one second indented portion 91 or 92 at the outer circumferential surface 6 near the major axis Y. The number of the second indented portions is arbitrary. The second indented portions are provided at the outer circumferential surface 6 near the major axis Y. In the embodiment, the second indented portions 91 and 92 are provided at the outer circumferential surface 6 at two ends of the major axis Y.

More specifically, the second indented portion 91 of the second indented portions 91 and 92 is provided at the outer circumferential surface 6 at end of the major axis Y, whereas the second indented portion 92 is provided at the outer circumferential surface 6 at the other end of the major axis Y. The second indented portions 91 and 92 in the figure are formed as linear grooves extending in a direction of the core axis O1. These grooves open at the opening end edge 72 constituting the outer edge of the neck portion 3.

The deflecting yoke core according to the present invention includes the first indented portions 81 to 84 formed at the outer circumferential surface 6. Thus, when molding the deflecting yoke core through pressurization by using magnetic powder such as ferrite powder, the molding die having projecting portions corresponding to the first indented portions 81 to 84 may be used to pressurize the magnetic powder with the projecting portions during the molding process, so that the core density is increased around the first indented portions 81 to 84 corresponding to the projecting portions.

In addition, since the first indented portions 81 to 84 are provided at the outer circumferential surface 6 near the minor axis X, the core density is ultimately increased near the minor axis X. As a result, the core strength is increased near the minor axis X, to prevent the core from becoming chipped.

Furthermore, since the core density increases near the minor axis X as described above, a more uniform core density distribution is achieved. Thus, the deflecting yoke core according to the present invention shrinks uniformly and it does not become deformed readily during the baking process.

The deflecting yoke core in the embodiment includes the second indented portions 91 and 92 at the outer circumferential surface 6 near the major axis Y. As a result, the core density is increased around the second indented portions 91 and 92 as well as around the first indented portions 81 to 84, to increase the core density near the major axis Y. Consequently, an even more uniform core density distribution is achieved in the deflecting yoke core in the embodiment to further reduce the likelihood of deformation occurring during the baking process.

Figure 33:
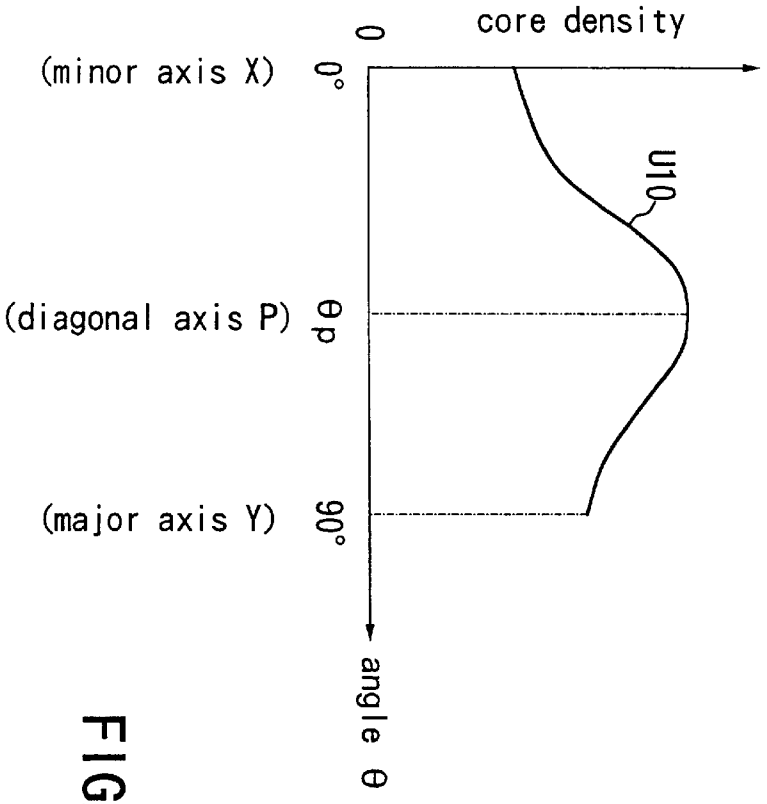
FIG. 33 is a graph showing the core density characteristics manifesting in a deflecting yoke core in the prior art.

FIG. 33 shows the core density characteristics manifesting in a deflecting yoke core in an example of the prior art. The outer shape of the neck portion is circular in this deflecting yoke core. In FIG. 33, the horizontal axis represents the angle (°) and the vertical axis represents the core density. The angle (°) along the horizontal axis indicates values taken around the core axis relative to a 0° reference angle at the minor axis. The curve U10 represents the core density characteristics manifesting in the example of the prior art.

As shown in the figure, in the deflecting yoke core in the prior art, having its funnel portion having a short diameter along the minor axis X and a long diameter along the major diameter Y, the core density near the minor axis X is low due to the structure of the molding die. In particular, the core density near the minor axis X is considerably lower than the core density near the diagonal axis P. In addition, the core density near the major diameter Y, too, is slightly lower than the core density near the diagonal axis P.

Figure 34:
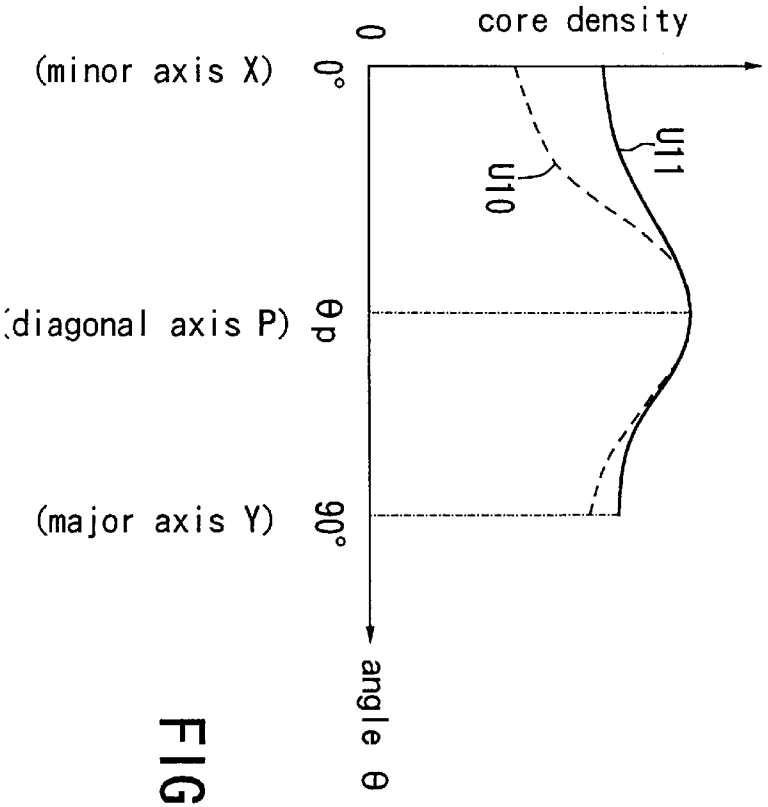
FIG. 34 is a graph showing the core density characteristics achieved in a deflecting yoke core according to the present invention.

FIG. 34 shows the core density characteristics achieved in the deflecting yoke core shown in FIGS. 28 to 32, with the horizontal axis representing the angle (°) and the vertical axis representing the core density. The solid curve U11 represents the core density characteristics achieved in the embodiment and the dotted curve U10 represents the characteristics manifesting in the prior art presented in FIG. 33.

As shown in FIG. 34, the core density near the minor axis X is considerably higher in the deflecting yoke core in the embodiment. As a result, a more uniform core density distribution is achieved. In addition, the core density near the major axis Y, too, is slightly higher. This results in an even more uniform core density distribution.

The deflecting yoke core according to the present invention is normally molded by using magnetic powder through a molding process as illustrated in FIGS. 35 to 38.

Figure 35:
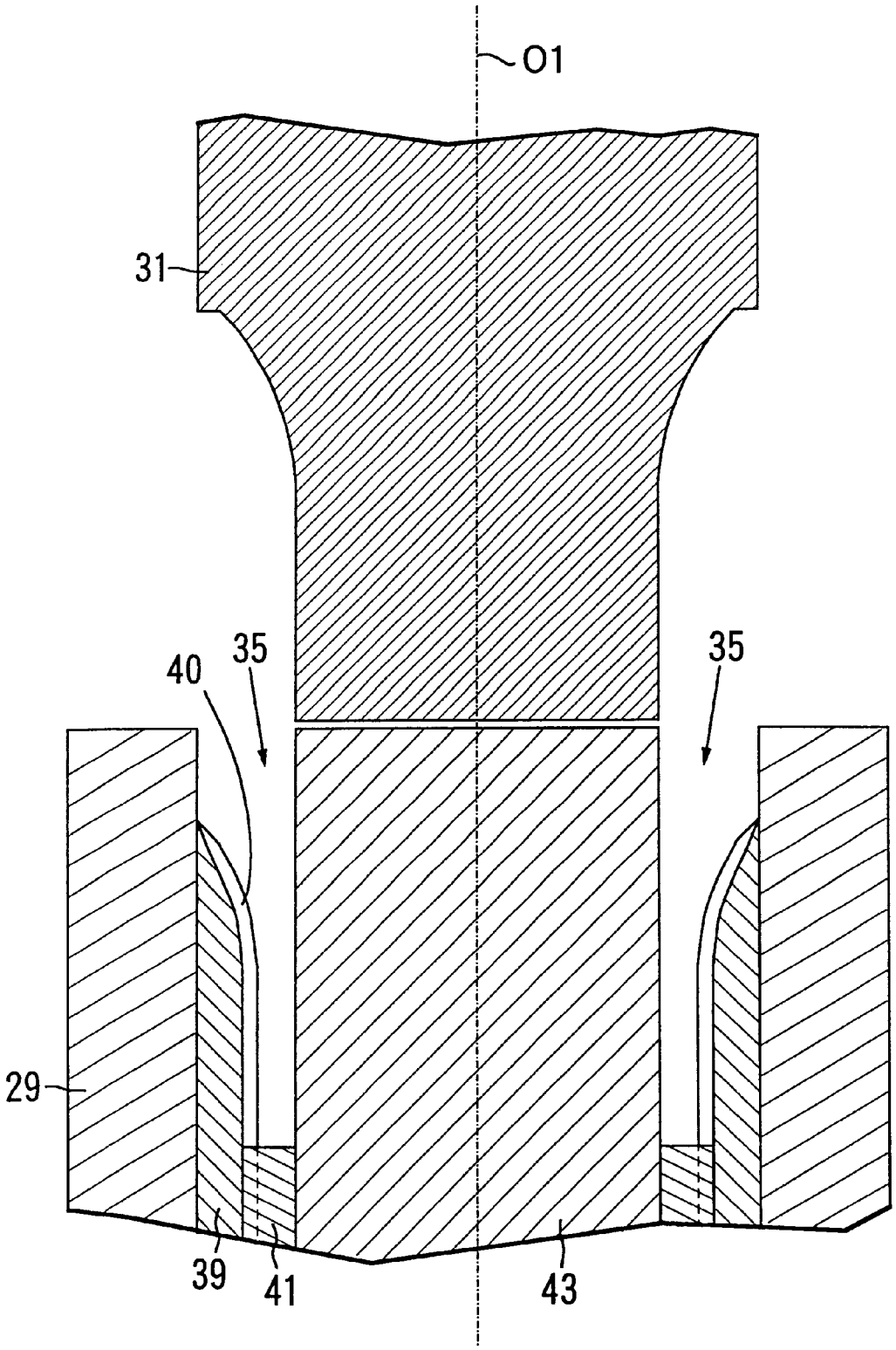
FIG. 35 presents an example of a molding step implemented to manufacture the deflecting yoke core shown in FIGS. 28 to 32.

FIG. 35 is a cross-sectional view taken along the minor axis X in FIG. 28. In the figure, lower dies 29, 39, 41 and 43 are combined so as to form a cavity 35. A projecting portion 40 projecting into the cavity 35 is formed at the lower die 39. The projecting portion 40 extends linearly in the direction of the core axis O1.

Figure 36:
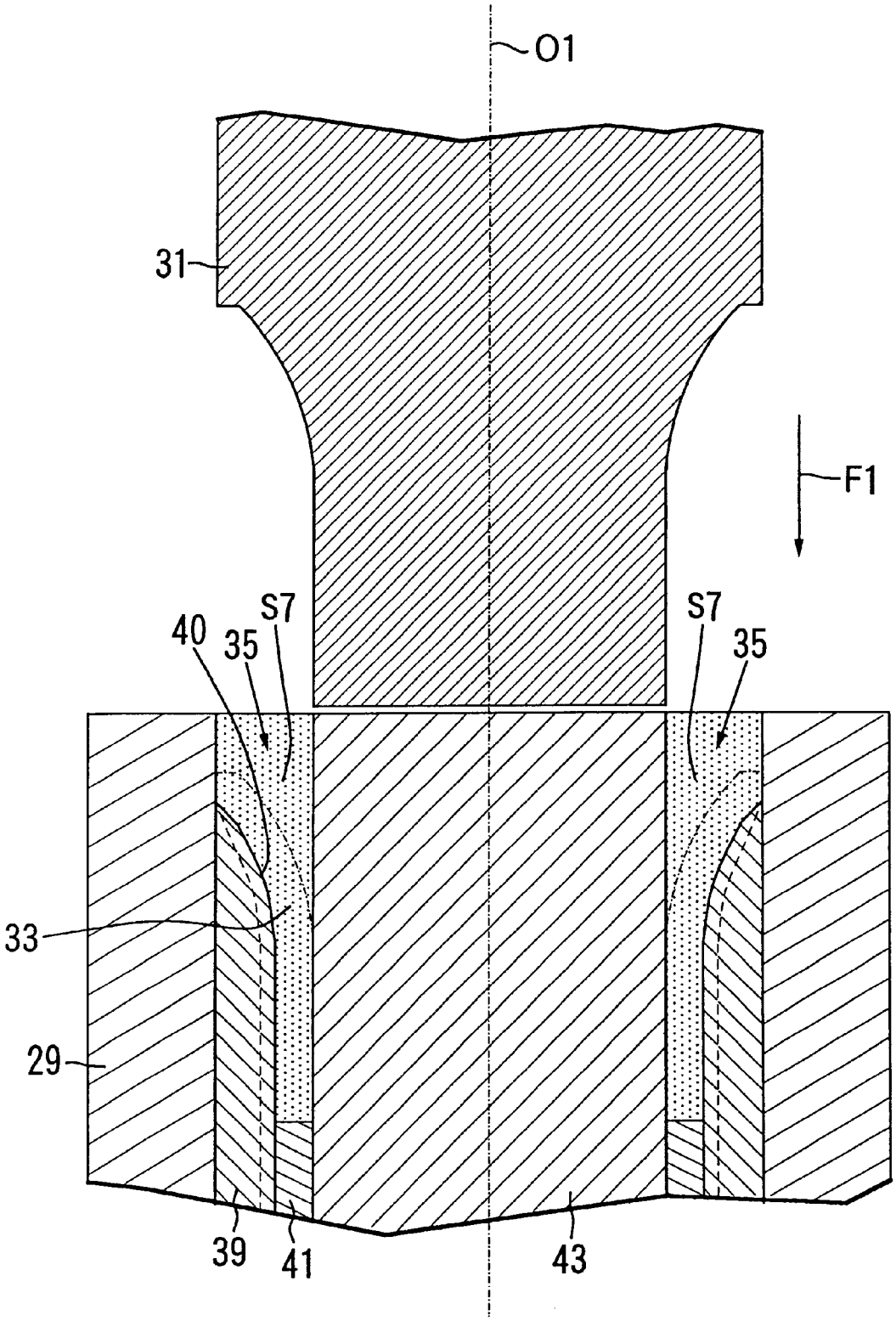
FIG. 36 shows a molding step implemented after the step shown in FIG. 35.

FIG. 36 shows a molding step implemented after the step shown in FIG. 35 and is a cross-sectional view taken along the minor axis X in FIG. 28. As shown in FIG. 36, magnetic powder 33 is charged into the cavity 35. The magnetic powder 33 may be, for instance, ferrite powder. The area below the one-point chain line shown within the magnetic powder 33 indicates the molded area that is ultimately achieved, with the area above the one-point chain line indicating a compressed powder area S7 that is compressed in the molding process.

Figure 37:
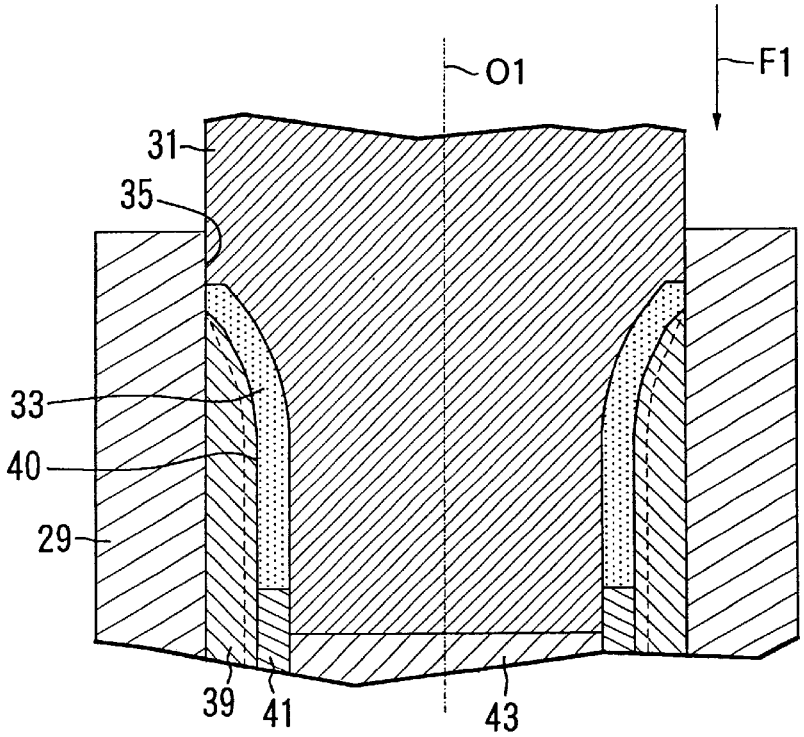
FIG. 37 shows a molding step implemented after the step shown in FIG. 36.
Figure 38:
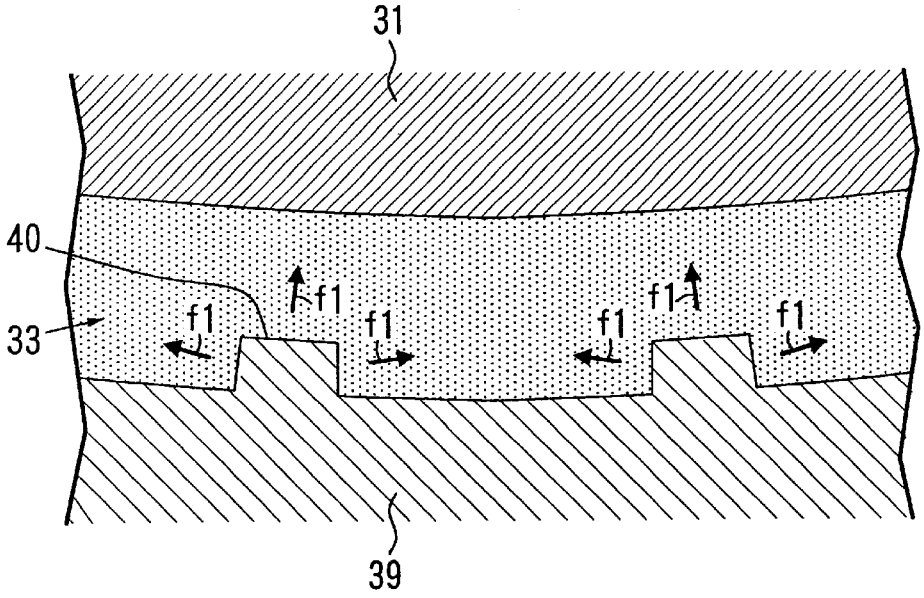
FIG. 38 is enlarged partial cross-sectional view illustrating the advantages achieved by implementing the step shown in FIG. 37.

FIG. 37 shows a molding step implemented after the step shown in FIG. 36 and is a cross-sectional view taken along the minor axis X in FIG. 28. FIG. 38 is an enlarged cross-sectional view taken along line 32—32 in FIG. 28.

As shown in FIG. 37, an upper die 31 is made to move along the direction indicated by the arrow F1 to become interlocked with the lower dies 29, 39, 41 and 43, so that the magnetic powder 33 is pressurized. At this time, a compression force F1 is applied to the magnetic powder 33 from the projecting portions 40 at the lower die 39, as shown in FIG. 38, resulting in the magnetic powder 33 around the projecting portions 40 becoming compressed. Thus, the core density increases around the first indented portions 81 to 84. Furthermore, since the first indented portions 81 to 84 are provided near the minor axis X, the core density increases near the minor axis X in the deflecting yoke core according to the present invention.

In the embodiment, the first indented portions 81 to 84 are each constituted as a linear groove extending in the direction of the core axis O1. By adopting this mode, the deflecting yoke core molded by using magnetic powder or the like can be easily rapped out along the direction of the core axis O1 (tube axis) after the molding process.

The molding method shown in FIGS. 35 to 38 simply represents an example and it is obvious that the deflecting yoke core according to the present invention may be molded through a method other than this.

Figure 39:
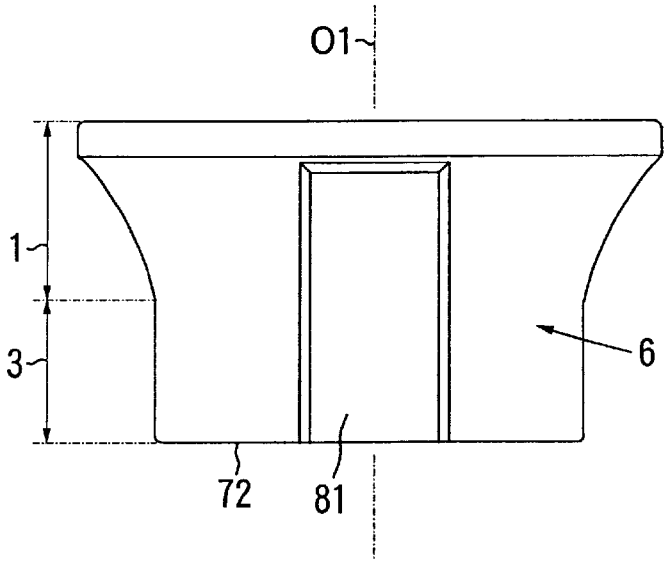
FIG. 39 is a front view of yet another embodiment of the deflecting yoke core according to the present invention.
Figure 40:
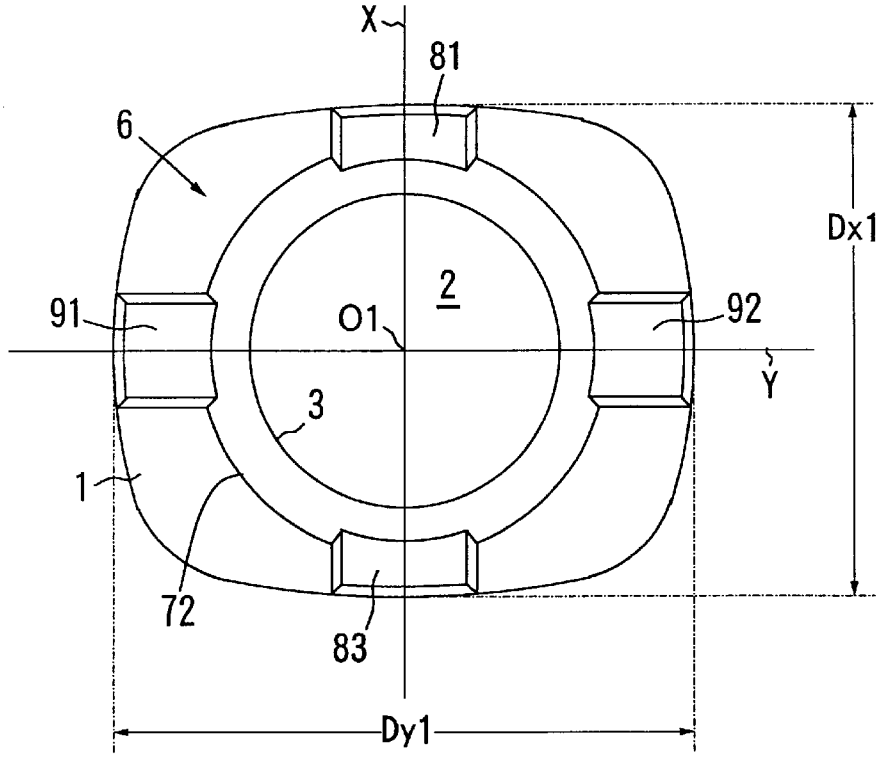
FIG. 40 is a bottom view of the deflecting yoke core shown in FIG. 39.

FIG. 39 is a front view of yet another embodiment of the deflecting yoke core according to the present invention and FIG. 40 is a bottom view of the deflecting yoke core shown in FIG. 39. In this embodiment, two first indented portions 81 and 83 are provided at the outer circumferential surface 6 near the minor axis X.

More specifically, the first indented portions 81 and 83 are provided at the outer circumferential surface 6 at two ends of the minor axis X. In even more specific terms, the first indented portion 81 is provided at the outer circumferential surface 6 at end of the minor axis X, whereas the first indented portion 83 is provided at the outer circumferential surface 6 at the other end of the minor axis X. In this embodiment, too, the core density increases near the minor axis X.

The bottom surfaces of the first indented portions 81 and 83 are formed in a curved shape in conformance to the shape of the hole 2. Thus, the core thickness is maintained at a constant value between the bottom surfaces of the first indented portions 81 and 83 and the hole 2. The same structural feature is adopted for the bottom surfaces of the second indented portions 91 and 92.

Alternatively, the bottom surfaces of the first indented portions 81 and 83 may each, in part, constitute a flat surface parallel to the core axis O1. In such a case, the flat surfaces parallel to the core axis O1 can be used as reference surfaces to facilitate the alignment of the core axis O1 of the deflecting yoke core with the tube axis of the cathode ray tube. Thus, the deflecting yoke core can be accurately positioned relative to a cathode ray tube with ease. The same principle applies with regard to the bottom surfaces of the second indented portions 91 and 92.

Figure 41:
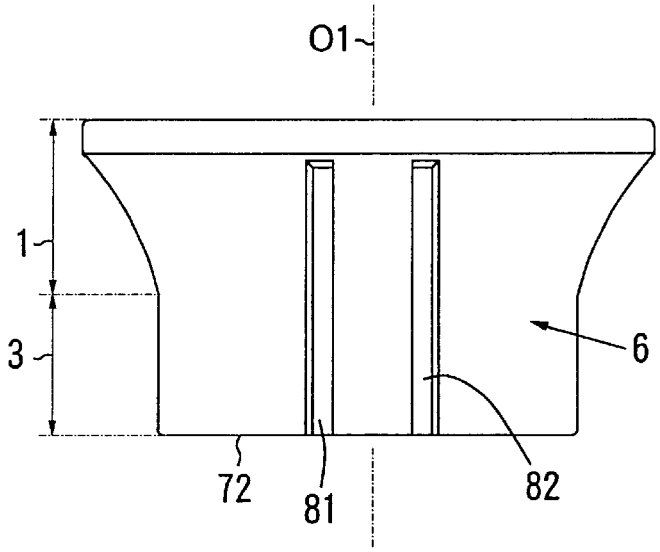
FIG. 41 is a front view of yet another embodiment of the deflecting yoke core according to the present invention.
Figure 42:
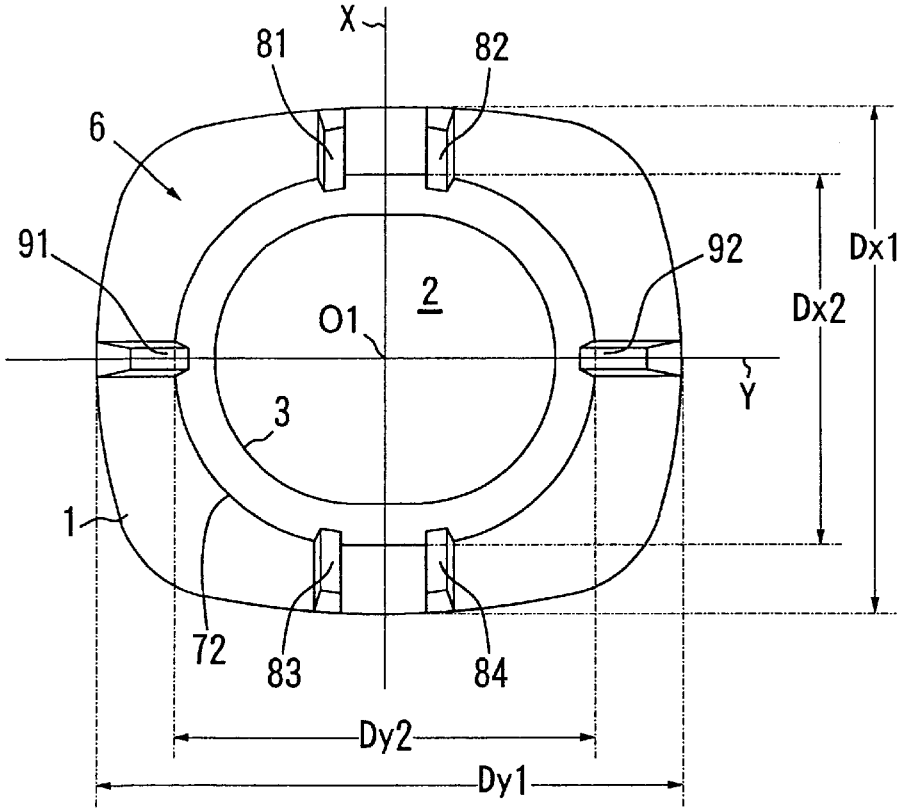
FIG. 42 is a bottom view of the deflecting yoke core shown in FIG. 41.
Figure 43:
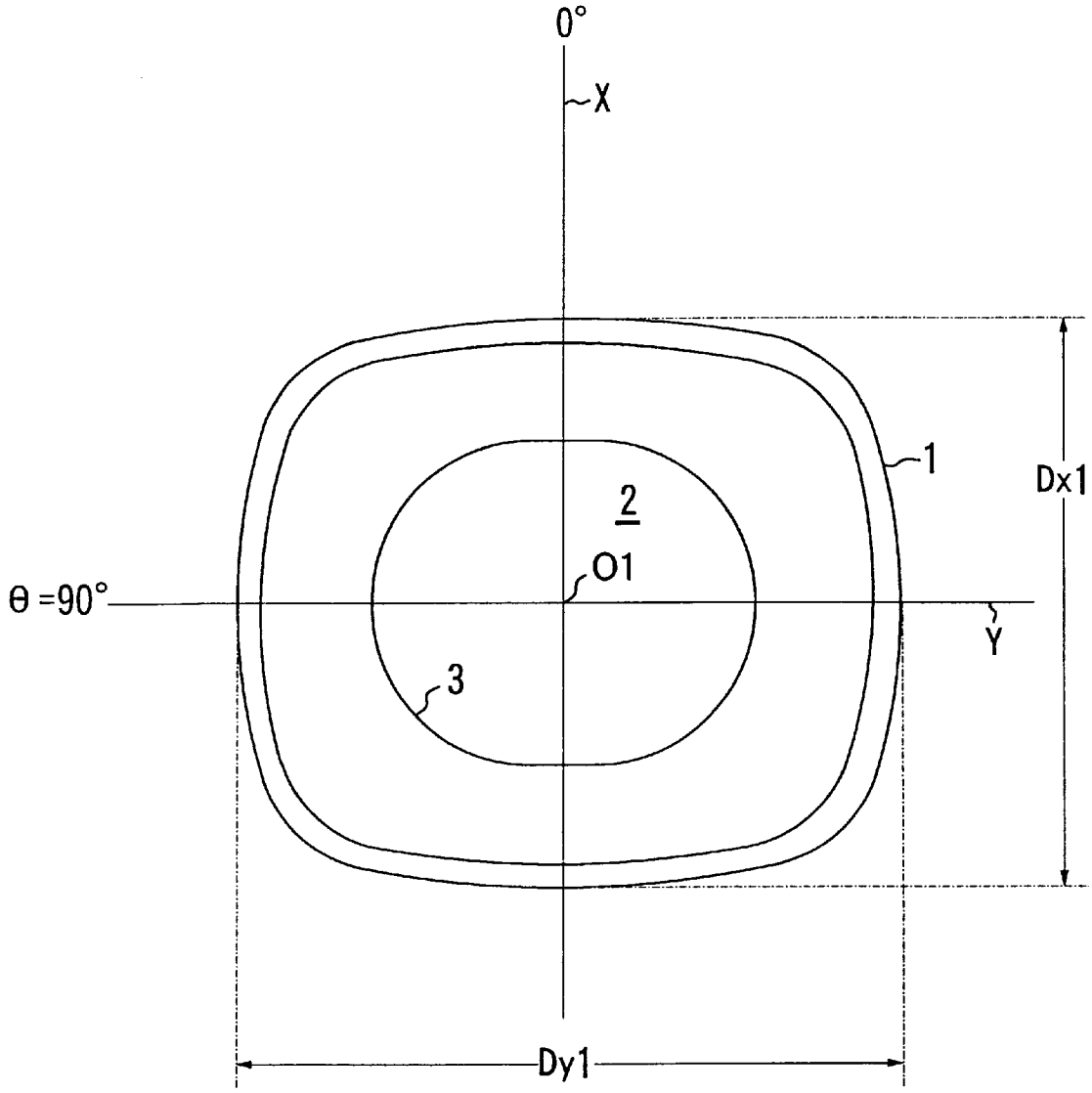
FIG. 43 is a plan view of the deflecting yoke core shown in FIGS. 41 and 42.

FIG. 41 is a front view of yet another embodiment of the deflecting yoke core, FIG. 42 is a bottom view of the deflecting yoke core shown in FIG. 41, and FIG. 43 is a plan view of the deflecting yoke core in FIGS. 41 and 42. In this embodiment, the outer shape of the neck portion 3 at an opening end has a short diameter Dx2 along the minor axis X and a long diameter Dy2 along the major axis Y. The minor axis X and the major axis Y pass through the core axis O1 and intersect each other at a right angle. The short diameter Dx2 along the minor axis X and the long diameter Dy2 along the major axis Y achieve a relationship expressed as Dy2>Dx2. More specifically, the outer shape of the neck portion 3 at its opening end is elliptic-like. The outer shape may be roughly rectangular or oval, instead.

The shape of the hole 2 formed in the funnel portion 1 and the neck portion 3 conforms to the outer shape. In more specific terms, the hole 2 widens so that the elliptic-like shape at the neck portion 3 becomes a quadrilateral shape at the funnel portion 1.

The first indented portions 81 to 84 are provided near the minor axis X and second indented portions 91 and 92 are provided near the major axis Y. The first indented portions 81 to 84 and the second indented portions 91 and 92 are positioned by assuming an arrangement identical to that adopted in FIGS. 28 and 29. In the embodiment shown in FIGS. 41 to 43, too, the core density near the minor axis X increases. As a result, a more uniform core density distribution is achieved. In addition, the core density also increases near the major axis Y, thereby achieving an even more uniform core density distribution.

Figure 44:
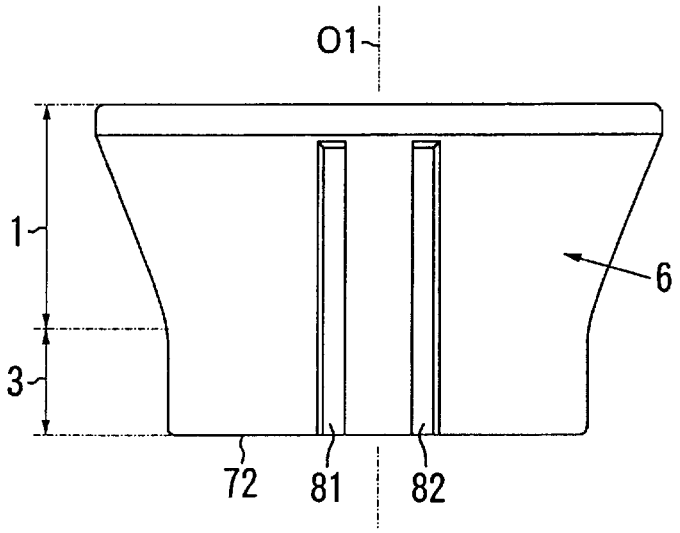
FIG. 44 is a front view of yet another embodiment of the deflecting yoke core according to the present invention.
Figure 45:
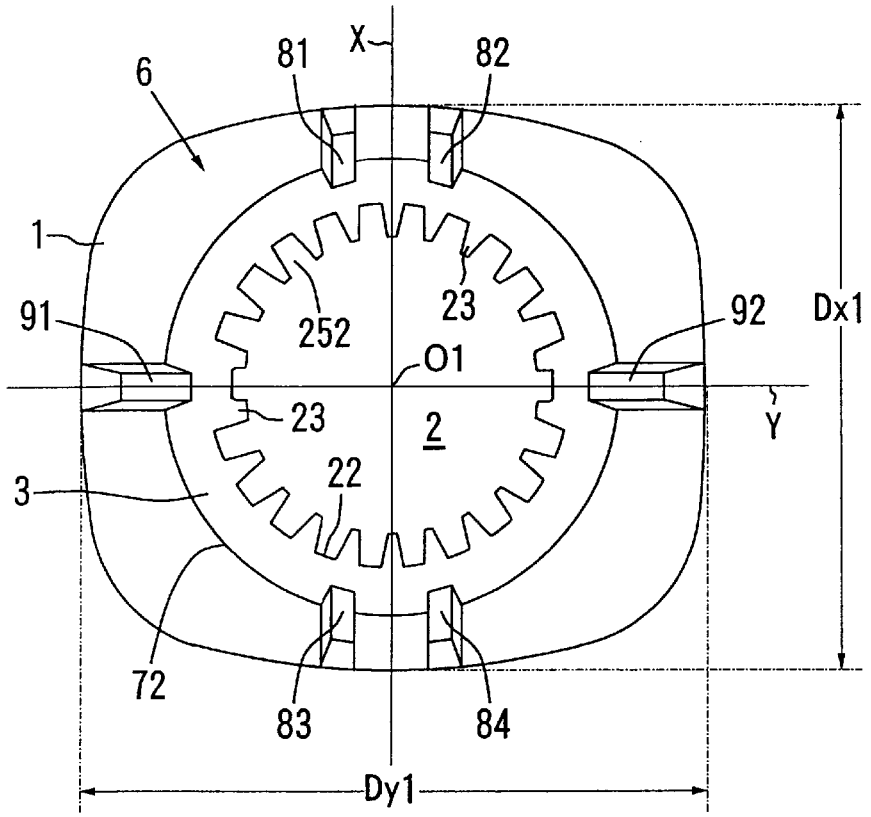
FIG. 45 is a bottom view of the deflecting yoke core shown in FIG. 44.
Figure 46:
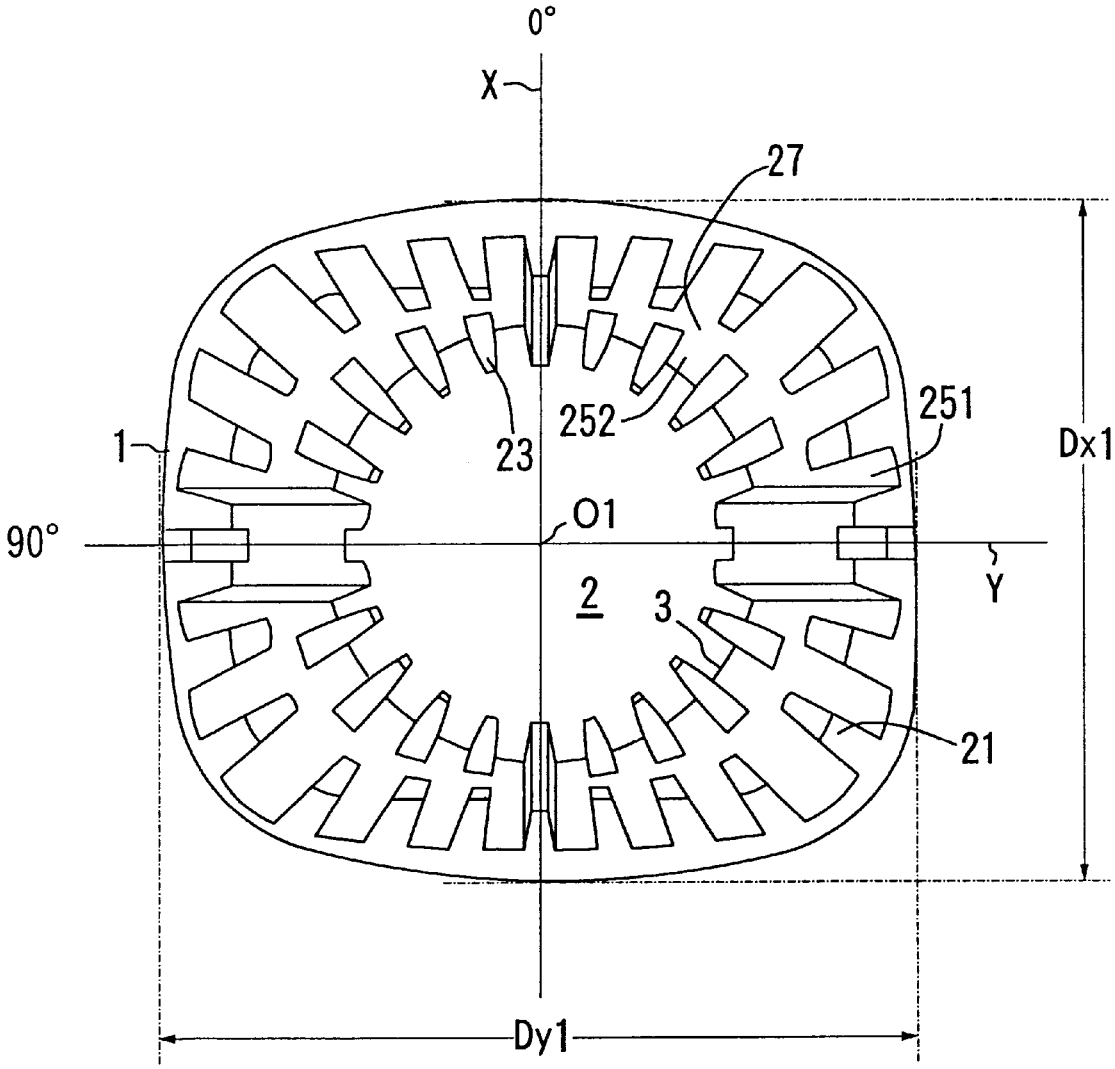
FIG. 46 is a plan view of the deflecting yoke core shown in FIGS. 44 and 45.

FIG. 44 is a front view of yet another embodiment of the deflecting yoke core according to the present invention, FIG. 45 is a bottom view of the deflecting yoke core shown in FIG. 44, and FIG. 46 is a plan view of the deflecting yoke core in FIGS. 44 and 45. The basic structure assumed in the deflecting yoke core in the figures is essentially identical to that of the deflecting yoke core shown in FIGS. 15 to 18. Thus, a repeated explanation of its basic structure and the resulting advantages is omitted.

In this embodiment, too, first indented portions 81 to 84 are provided at the outer circumferential surface 6 near the minor axis X. As a result, core chipping is prevented and deformation occurs less readily during the baking process, as in the embodiment explained in reference to FIGS. 28 to 32.

In this embodiment, too, the first indented portions 81 to 84 are provided at the outer circumferential surface 6 at two ends of the minor axis X. More specifically, the first indented portions 81 and 82 among the first indented portions 81 to 84 are provided at the outer circumferential surface 6 at one end of the minor axis X, whereas the first indented portions 83 and 84 are provided at the outer circumferential surface 6 at the other end of the minor axis X.

In addition, the first indented portions 81 and 82 are formed over a distance from each other at the outer circumferential surface 6 at one end of the minor axis X. Likewise, the first indented portions 83 and 84 are formed over a distance from each other at the outer circumferential surface 6 at another end of the minor axis X. The first indented portions 81 to 84 are formed as linear grooves extending in the direction of the core axis O1.

In addition, second indented portions 91 and 92 are provided at the outer circumferential surface 6 near the major axis Y in this embodiment, as well. The second indented portions 91 and 92 are provided at the outer circumferential surface 6 at two ends of the major axis Y. More specifically, the second indented portion 91 is provided at the outer circumferential surface 6 at one end of the major axis Y, whereas the second indented portion 92 is provided at the outer circumferential surface 6 at the other end of the major axis Y. The second indented portions 91 and 92 are formed as linear grooves extending in the direction of the core axis O1.

In addition, core saturation may be prevented when a horizontal deflection magnetic field and a vertical deflection magnetic field are created in a deflecting yoke constituted of any of the deflecting yoke cores shown in FIGS. 28 to 46 and deflection coils by ensuring that the core sectional areas along a plane parallel to and passing through a core axis O1 are largest within an angular range of 30° to 65° measured around the core axis O1 from a 0° reference angle at the minor axis X, as explained earlier.

Figure 47:
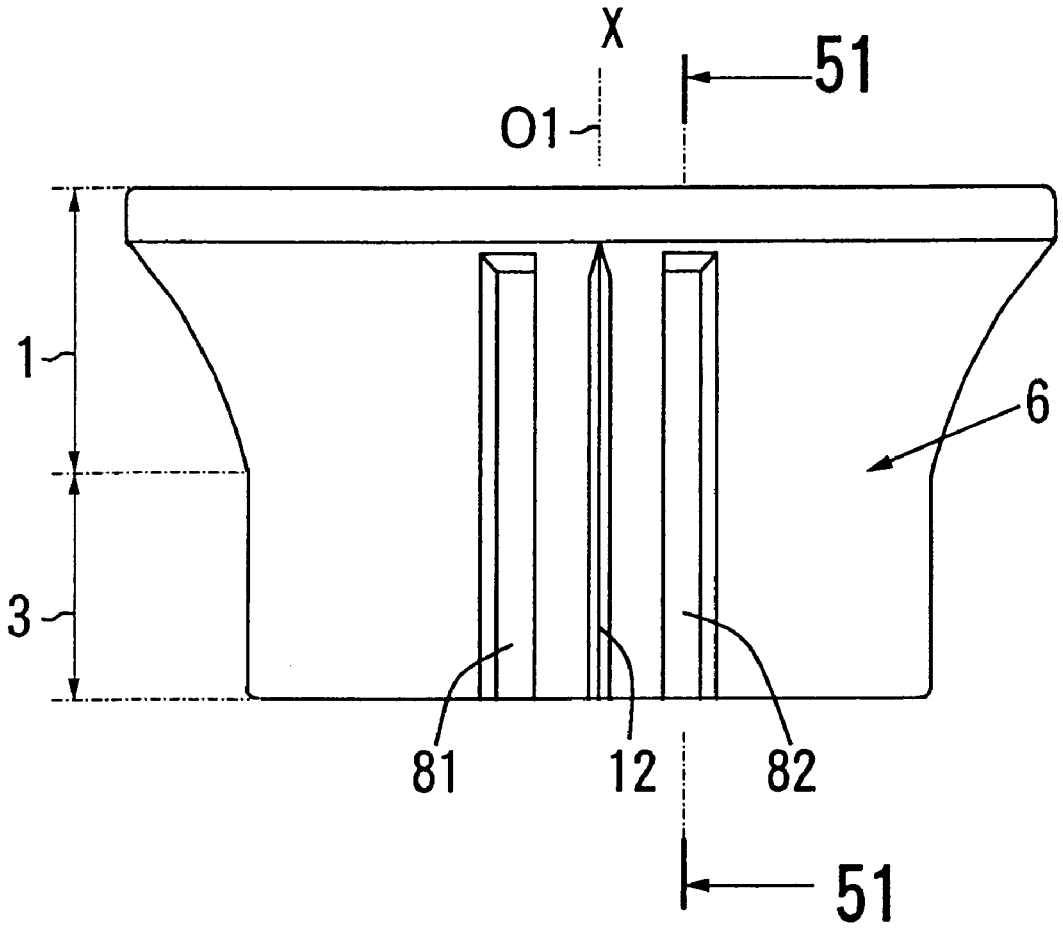
FIG. 47 is a front view of yet another embodiment of the deflecting yoke core according to the present invention.
Figure 48:
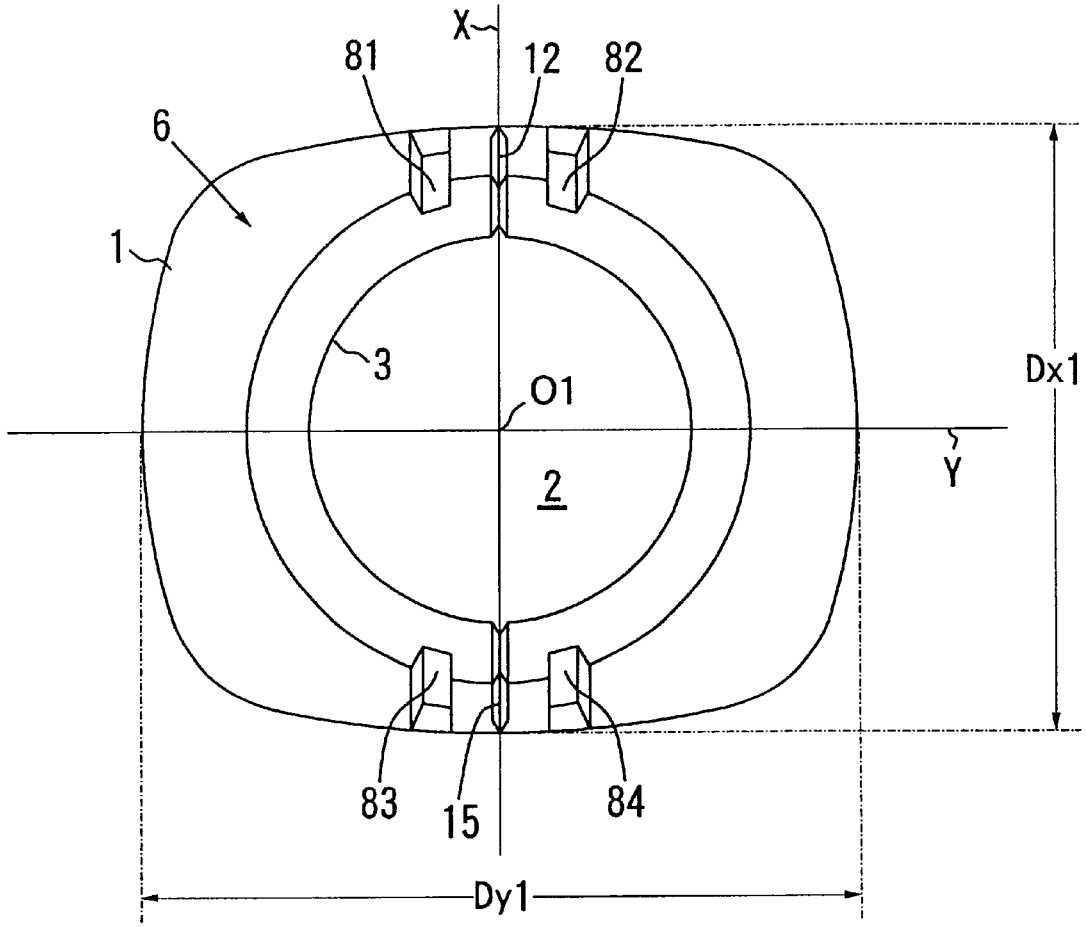
FIG. 48 is a bottom view of the deflecting yoke core shown in FIG. 47.
Figure 49:
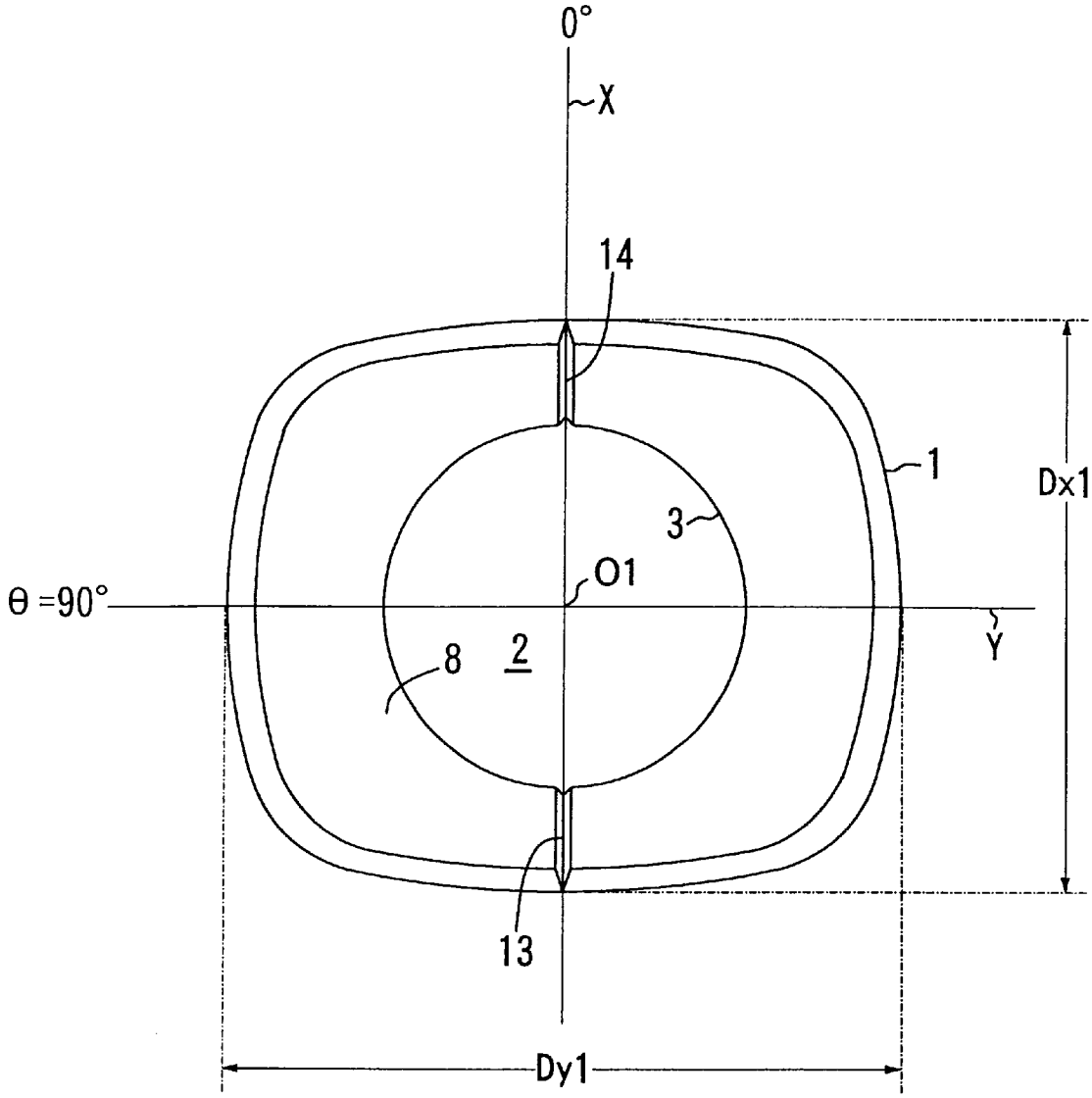
FIG. 49 is a plan view of the deflecting yoke core shown in FIGS. 47 and 48.
Figure 50:
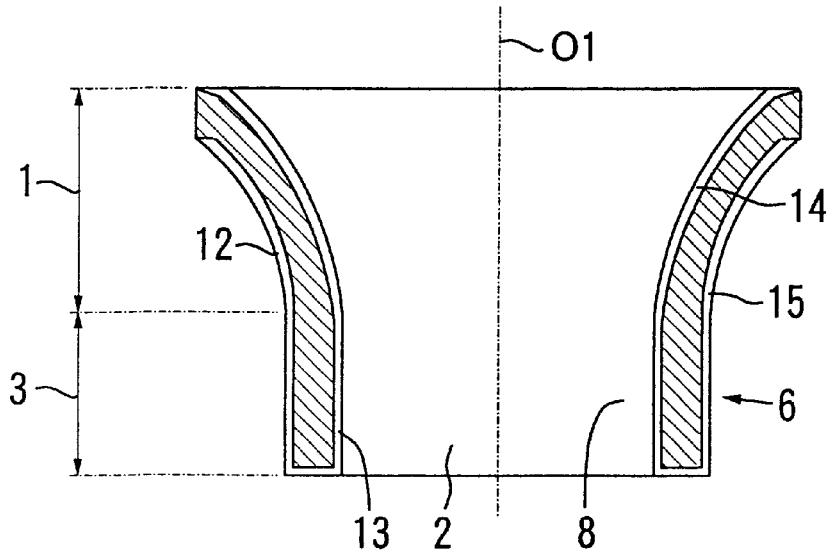
FIG. 50 is a cross-sectional view taken along the minor axis X in FIG. 47.
Figure 51:
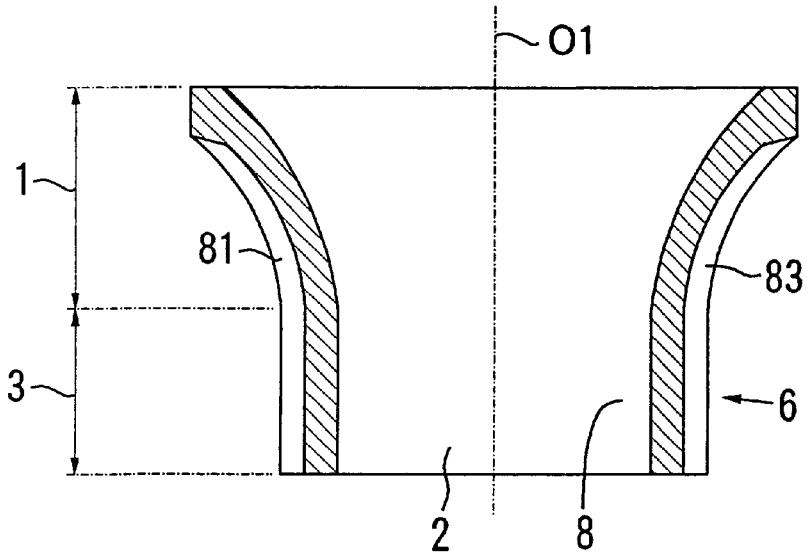
FIG. 51 is a cross-sectional view taken along line 51—51 in FIG. 47.

FIG. 47 is a front view of yet another embodiment of the deflecting yoke core according to the present invention, FIG. 48 is a bottom view of the deflecting yoke core shown in FIG. 47, and FIG. 49 is a plan view of the deflecting yoke core in FIG. 47. FIG. 50 is a cross-sectional view taken along the minor axis X in FIG. 47, and FIG. 51 is a cross-sectional view taken along line 51—51 in FIG. 47. In the figures, the same reference numerals are assigned to components identical to those in FIGS. 1 and 2 to preclude the necessity for a repeated explanation thereof.

In the figures, dividing grooves 12 to 15 extending in the direction of the core axis O1 are provided at core surfaces roughly on the minor axis X. These core surfaces include an outer circumferential surface 6 and an inner circumferential surface 8. The position of the minor axis X corresponds to the position at which the density of the magnetic flux attributable to the horizontal deflection magnetic field is the lowest, whereas the position of the major axis Y corresponds to the position at which the density of the magnetic flux attributable to the horizontal deflection magnetic field is the highest. According to the present invention, clip grooves 81 to 84 are provided at the outer circumferential surface 6 on two sides of the minor axis X.

More specifically, the clip grooves 81 to 84 are provided at the outer circumferential surface 6 at one end and also at another end of the minor axis X in the embodiment. In even more specific terms, the clip grooves 81 and 82 are provided at the outer circumferential surface 6 at two sides of the minor axis X at one end of the minor axis X, whereas the clip grooves 83 and 84 are provided at the outer circumferential surface 6 at two sides of the minor axis X at the other end of the minor axis X. The clip grooves 81 to 84 in the figures are each constituted as a linear groove extending in the direction of the core axis O1. The clip grooves 81 to 84 are made to open at the opening end edge constituting the external edge of the neck portion 3. The clip grooves 81 to 84 may have a depth set at 2 mm and a width set at 4 mm, for instance.

Figure 52:
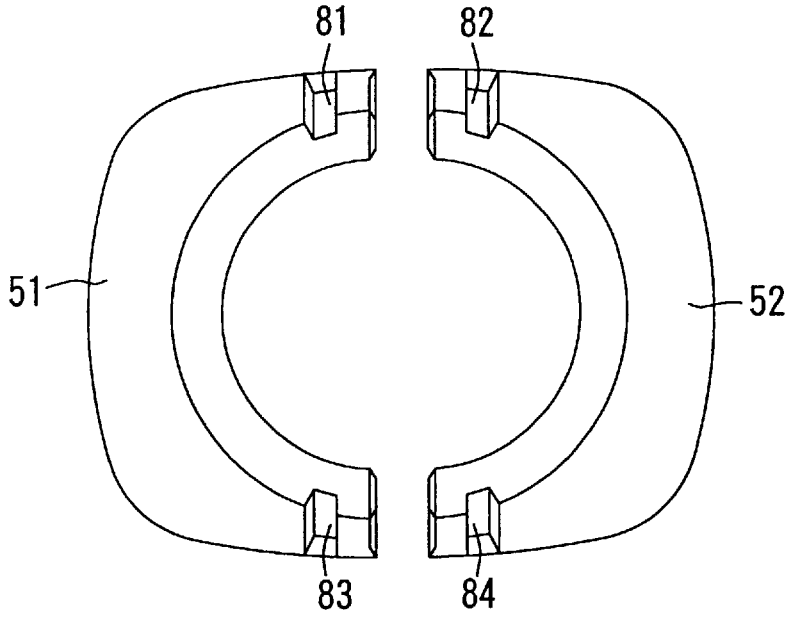
FIG. 52 is a bottom view showing core pieces obtained by dividing the deflecting yoke core shown in FIGS. 47 to 51.

A deflecting yoke is formed with the deflecting yoke core described above by first dividing the deflecting yoke core along the dividing grooves 12 to 15 as shown in FIG. 52 to divide the deflecting yoke core into core pieces 51 and 52.

Then, a separator, a vertical deflection coil and a horizontal deflection coil are provided at the core pieces 51 and 52 before fitting together the core pieces 51 and 52. The horizontal deflection coil is provided so as to ensure that the density of the magnetic flux is the lowest at the minor axis X where the dividing grooves 12 to 15 are provided. The vertical deflection coil creates a vertical deflection magnetic field which intersects at a right angle the horizontal deflection magnetic field created by the horizontal deflection coil. The horizontal deflection coil and the vertical deflection coil may each be constituted of a saddle-type coil.

Figure 53:
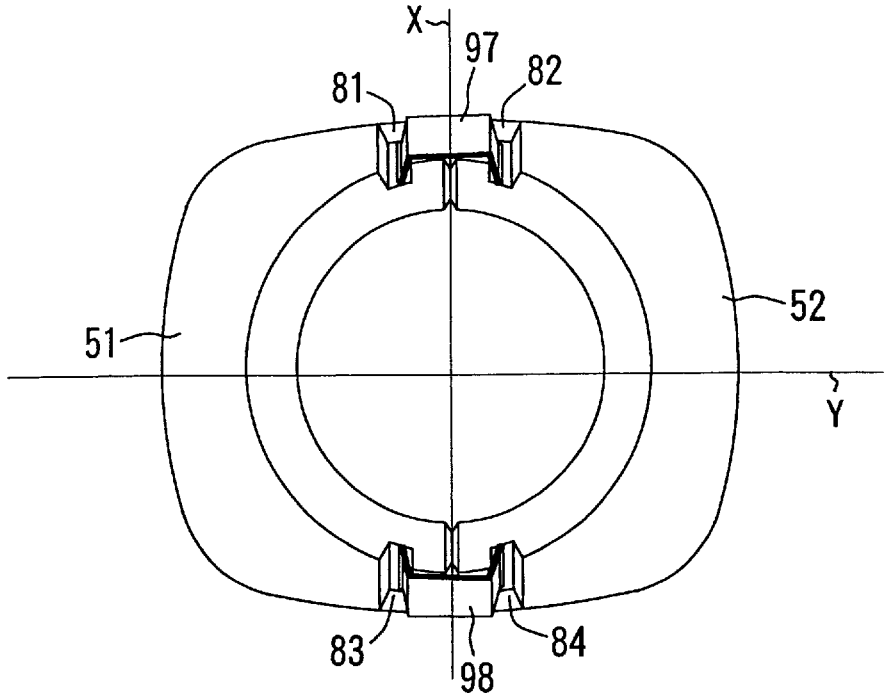
FIG. 53 is a bottom view showing a state in which the core pieces in FIG. 52 are coupled by utilizing clips.

The core pieces 51 and 52 may be fitted together by hooking a clip 97 at the area between the clip grooves 81 and 82 and hooking another clip 98 at the area between the clip grooves 83 and 84, as shown in FIG. 53. It is to be noted that the separator, the vertical deflection coil and the horizontal deflection coil are omitted in FIG. 53.

As explained earlier, the density of the magnetic flux attributable to the horizontal deflection magnetic field assumes the lowest value near the minor axis X corresponding to the 0° reference angle when a vertical deflection magnetic field and a horizontal deflection magnetic field are created in a deflecting yoke with the deflecting yoke core.

According to the present invention, the dividing grooves 12 to 15 are provided to extend along the direction of the core axis O1, roughly on the minor axis X at which the density of the magnetic flux attributable to the horizontal deflection magnetic field is the lowest. Thus, the adverse effect of the presence of the dividing grooves 12 to 15 on the density of the magnetic flux attributable to the horizontal deflection magnetic field is minimized, thereby achieving reductions in the core loss and the quantity of heat generated at the core.

Since the dividing grooves 12 to 15 extend linearly and open at the opening end edge of the neck portion 3 in the embodiment, the core constituted by molding magnetic powder such as ferrite powder or magnetic metal powder can be rapped out smoothly.

In addition, since the dividing grooves 12 to 15 are provided at positions facing opposite each other at the outer circumferential surface and the inner circumferential surface, the core constituted of a magnetic powder molding can be divided with ease. Furthermore, since the dividing groove 12 (15) provided at the outer circumferential surface and the dividing groove 13 (14) provided at the inner circumferential surface are made continuous to each other via a linking groove formed at the opening end surface of the neck portion 3, the core can be divided with further ease. The core division is even further facilitated by forming the dividing grooves 12 to 15 in a V-shape.

In a deflecting yoke core with an outer shape of the funnel portion at an opening end having a short diameter along the minor axis X and a long diameter along the major axis Y, the core density is normally low near the minor axis X due to the structure of the molding die. The deflecting yoke core according to the present invention includes clip grooves 81 to 84 formed at the outer circumferential surface 6. Thus, when molding the deflecting yoke core through pressurization by using magnetic powder such as ferrite powder, the molding die having projecting portions corresponding to the clip grooves 81 to 84 may be used to pressurize the magnetic powder with the projecting portions during the molding process, so that the core density is increased around the clip grooves 81 to 84 corresponding to the projecting portions.

In addition, since the clip grooves 81 to 84 are provided at the outer circumferential surface 6 on two sides of the minor axis X, the core density is ultimately increased near the minor axis X. As a result, the core strength is increased near the minor axis X, to prevent the core from becoming chipped.

Furthermore, since the core density increases near the minor axis X as described above, a more uniform core density distribution is achieved. Thus, the deflecting yoke core according to the present invention shrinks uniformly and it does not become deformed readily during the baking process.

Moreover, the core density is increased around the clip grooves 81 to 84, which are provided on the two sides of the minor axis X. Consequently, the core density ultimately increases near the minor axis X in the deflecting yoke core according to the present invention.

In the embodiment, the clip grooves 81 to 84 are each constituted as a linear groove extending in the direction of the core axis O1. By adopting this mode, the deflecting yoke core molded by using magnetic powder or the like can be easily rapped out along the direction of the core axis O1 (tube axis) after the molding process.

Figure 54:
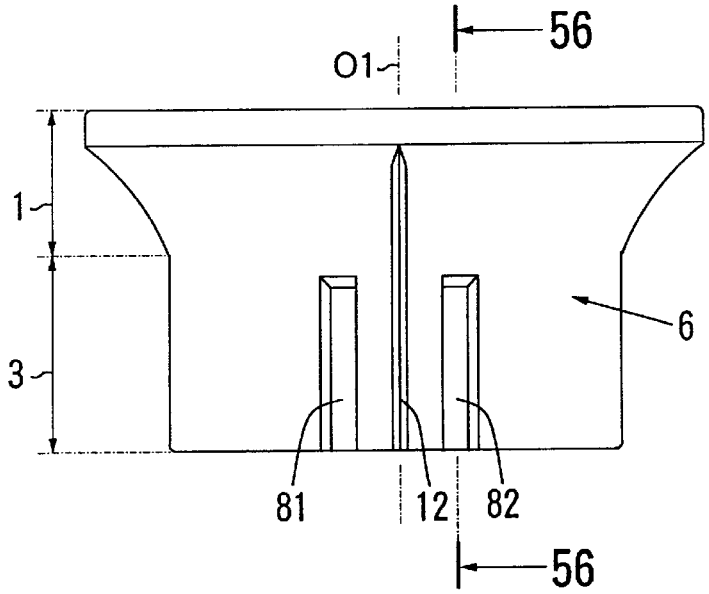
FIG. 54 is a front view of yet another embodiment of the deflecting yoke core according to the present invention.
Figure 55:
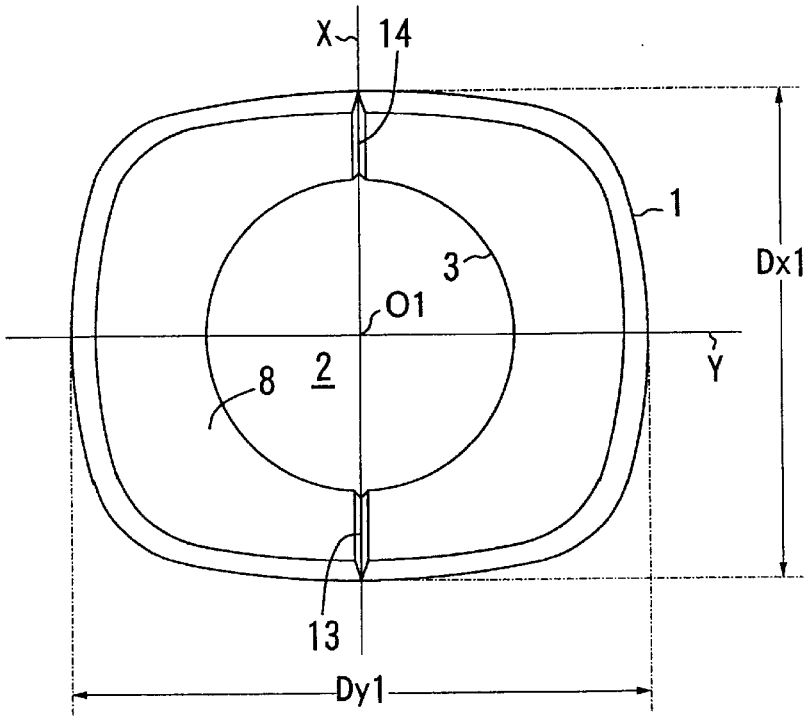
FIG. 55 is a plan view of the deflecting yoke core shown in FIG. 54.
Figure 56:
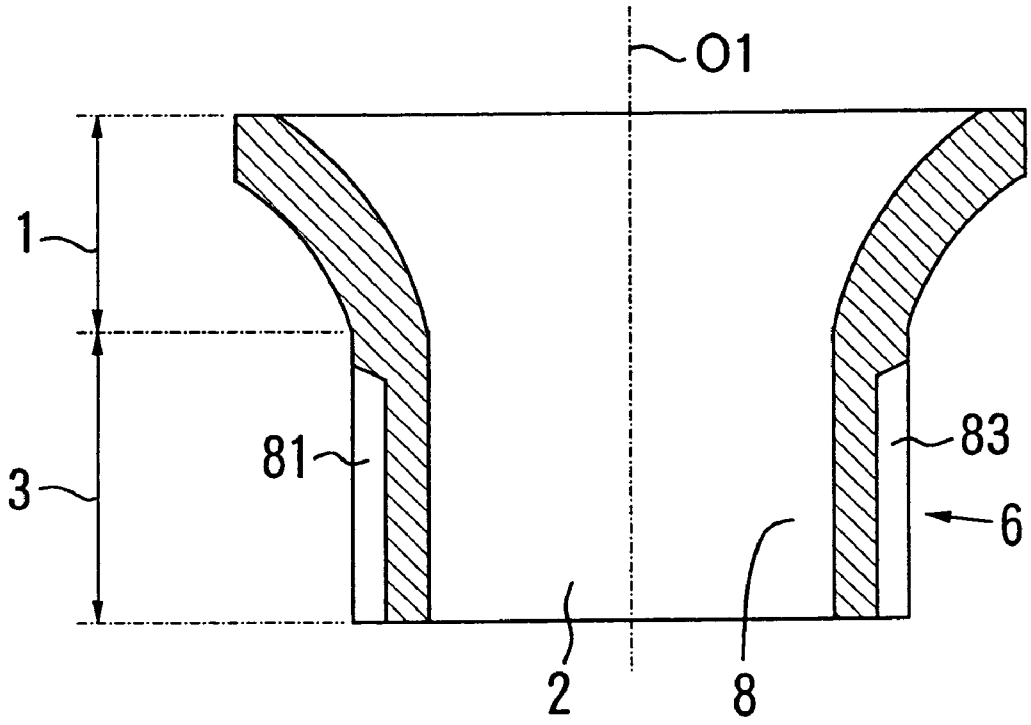
FIG. 56 is a cross-sectional view taken along line 56—56 in FIG. 54.

FIG. 54 is a front view of yet another embodiment of the deflecting yoke core according to the present invention, FIG. 55 is a plan view of the deflecting yoke core shown in FIG. 54, and FIG. 56 is a cross-sectional view taken along line 56—56 in FIG. 54. In the figures, the same reference numerals are assigned to components identical to those shown in FIGS. 47 to 49 to preclude the necessity for a repeated explanation thereof.

In the embodiment shown in FIGS. 54 to 56, the length of the neck portion 3 along the core axis O1 is larger than the length of the funnel portion 1 along the core axis O1. Dividing grooves 12 to 15 extending in the direction of the core axis O1 are provided at the core surface near the minor axis X and clip grooves 81 to 84 are provided at the outer circumferential surface 6 on two sides of the minor axis X. The clip grooves 81 to 84 are not provided at the outer circumferential surface 6 at the funnel portion 1 but only at the outer circumferential surface 6 at the neck portion 3.

Figure 57:
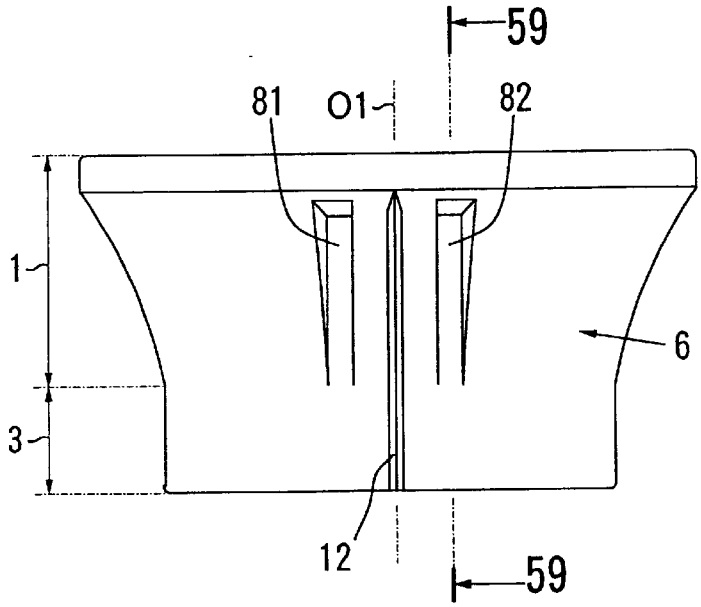
FIG. 57 is a front view of yet another embodiment of the deflecting yoke core according to the present invention.
Figure 58:
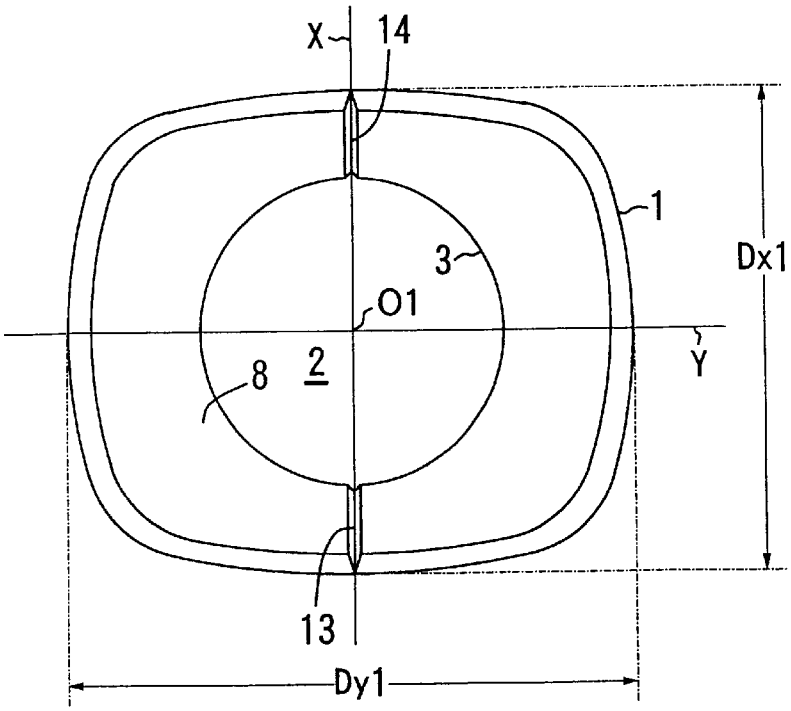
FIG. 58 is a plan view of the deflecting yoke core shown in FIG. 57.
Figure 59:
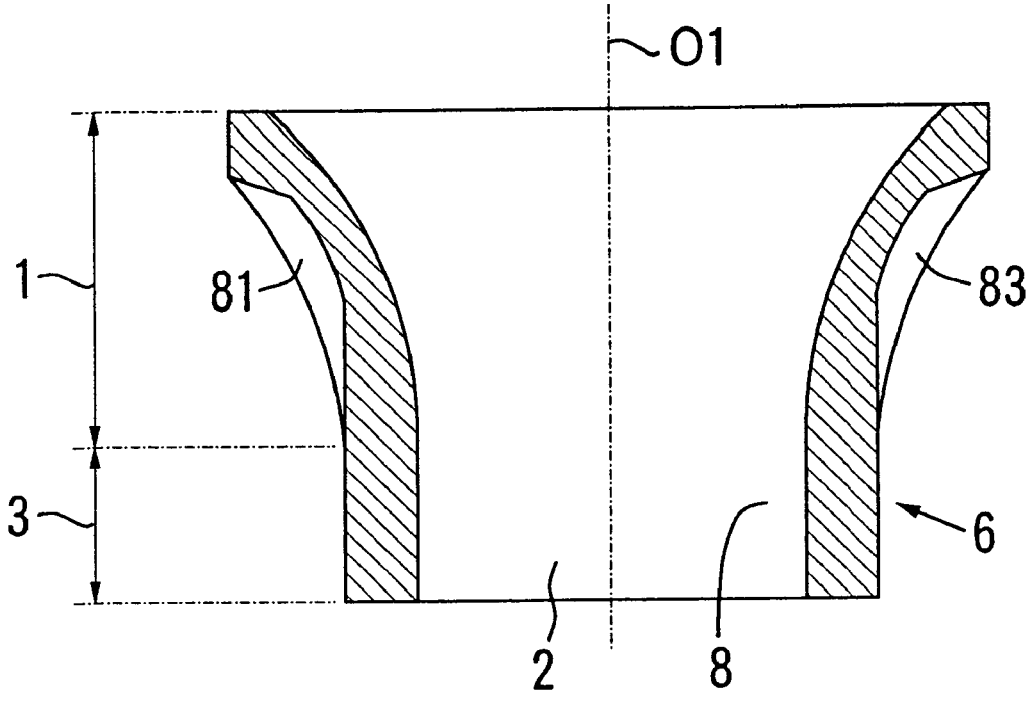
FIG. 59 is a cross-sectional view taken along line 59—59 in FIG. 57.

FIG. 57 is a front view of yet another embodiment of the deflecting yoke core according to the present invention, FIG. 58 is a plan view of the deflecting yoke core shown in FIG. 57, and FIG. 59 is a cross-sectional view taken along line 59—59 in FIG. 57. In the figures, the same reference numerals are assigned to components identical to those shown in FIGS. 54 to 56 to preclude the necessity for a repeated explanation thereof. In the embodiment, the length of the neck portion 3 along the core axis O1 is smaller than the length of the funnel portion 1 along the core axis O1.

In the embodiment shown in FIGS. 57 to 59, too, dividing grooves 12 to 15 extending in the direction of the core axis O1 are provided at the core surface roughly on the minor axis X and clip grooves 81 to 84 are provided at the outer circumferential surface 6 on two sides of the minor axis X. The clip grooves 81 to 84 are not provided at the outer circumferential surface 6 at the neck portion 3 but only at the outer circumferential surface 6 at the funnel portion 1.

Figure 60:
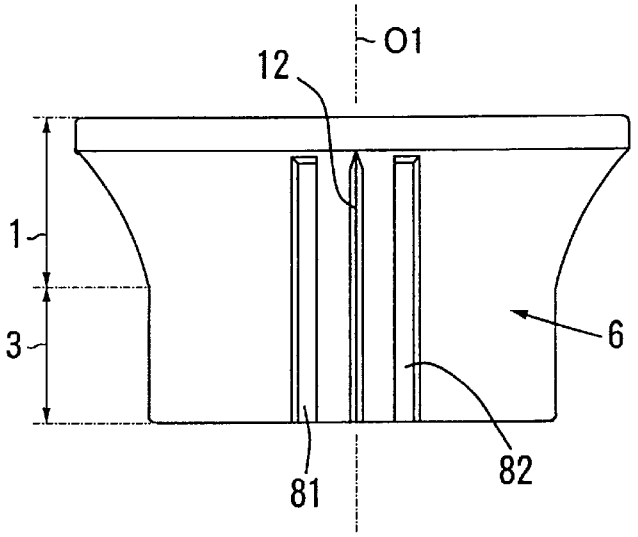
FIG. 60 is a front view of yet another embodiment of the deflecting yoke core according to the present invention.
Figure 61:
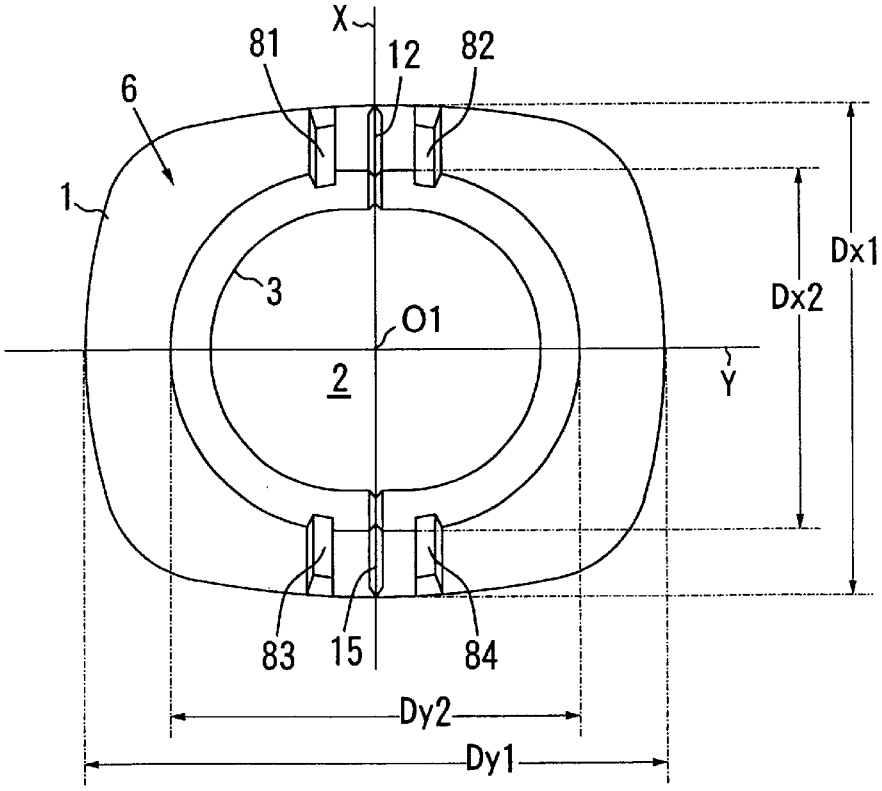
FIG. 61 is a bottom view of the deflecting yoke core shown in FIG. 60.
Figure 62:
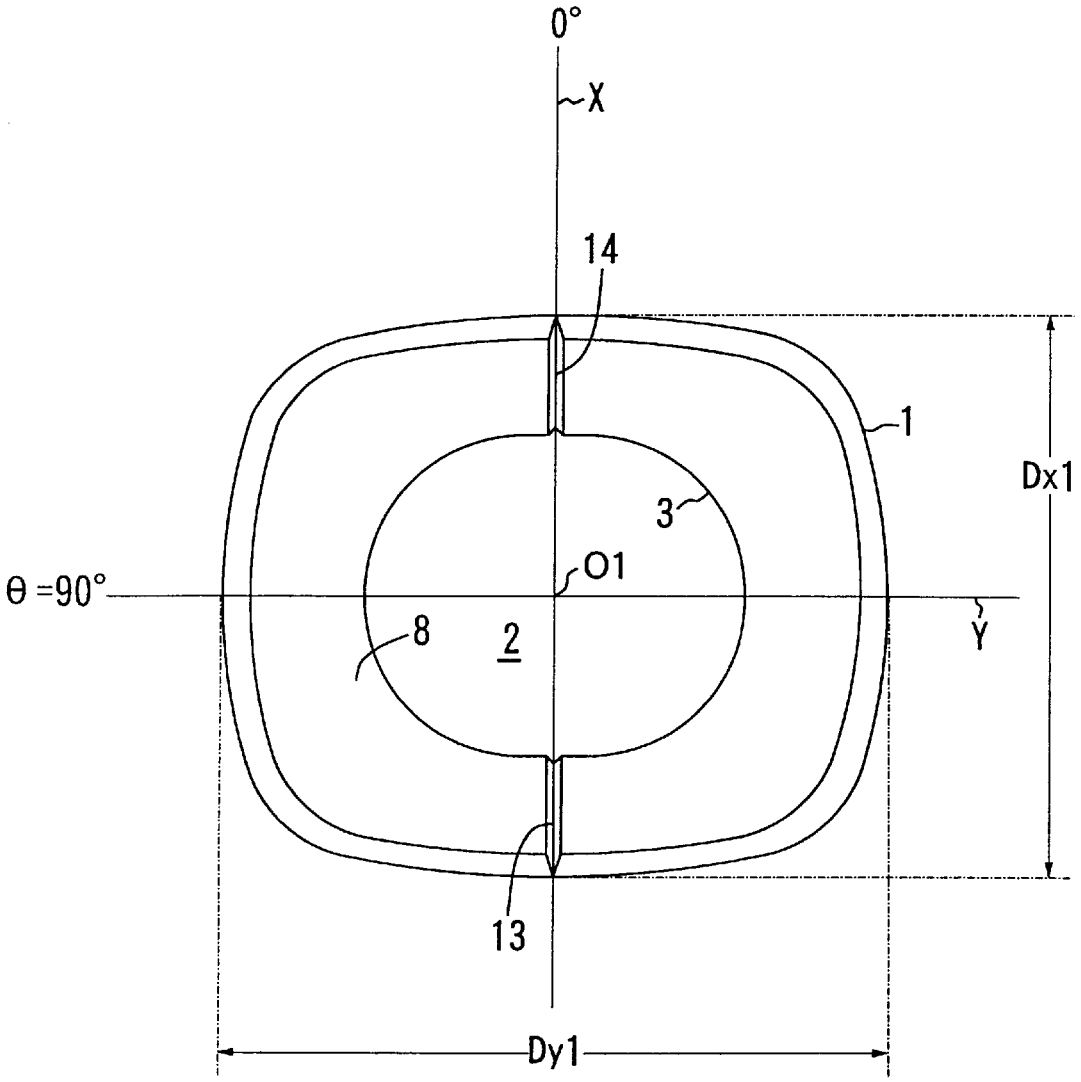
FIG. 62 is a plan view of the deflecting yoke core shown in FIG. 60.

FIG. 60 is a front view of yet another embodiment of the deflecting yoke core according to the present invention, FIG. 61 is a bottom view of the deflecting yoke core shown in FIG. 60, and FIG. 62 is a plan view of the deflecting yoke core shown in FIG. 60. In the figures, the same reference numerals are assigned to components identical to those shown in FIGS. 41 to 43 to preclude the necessity for a repeated explanation thereof. In the embodiment shown in FIGS. 60 to 62, too, dividing grooves 12 to 15 extending in the direction of the core axis O1 are provided at the core surface near the minor axis X and clip grooves 81 to 84 are provided at the outer circumferential surface 6 on two sides of the minor axis X.

In all the embodiments presented in FIGS. 54 to 62 explained above, the dividing grooves 12 to 15 are provided at the core surface near the minor axis X. In other words, since they are set at positions at which the adverse effect of their presence on the density of the magnetic flux attributable to the horizontal deflection magnetic field is minimized, reductions in the core loss and the quantity of heat generated at the core are achieved.

In addition, in all the embodiments, the clip grooves 81 to 84 are provided at the outer circumferential surface 6 on the two sides of the minor axis X. Thus, core chipping is prevented and deformation does not occur readily during the baking process.

Figure 63:
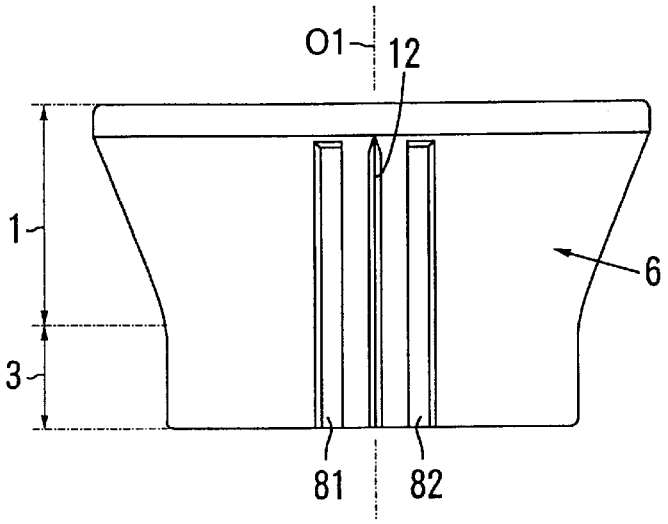
FIG. 63 is a front view of yet another embodiment of the deflecting yoke core according to the present invention.
Figure 64:
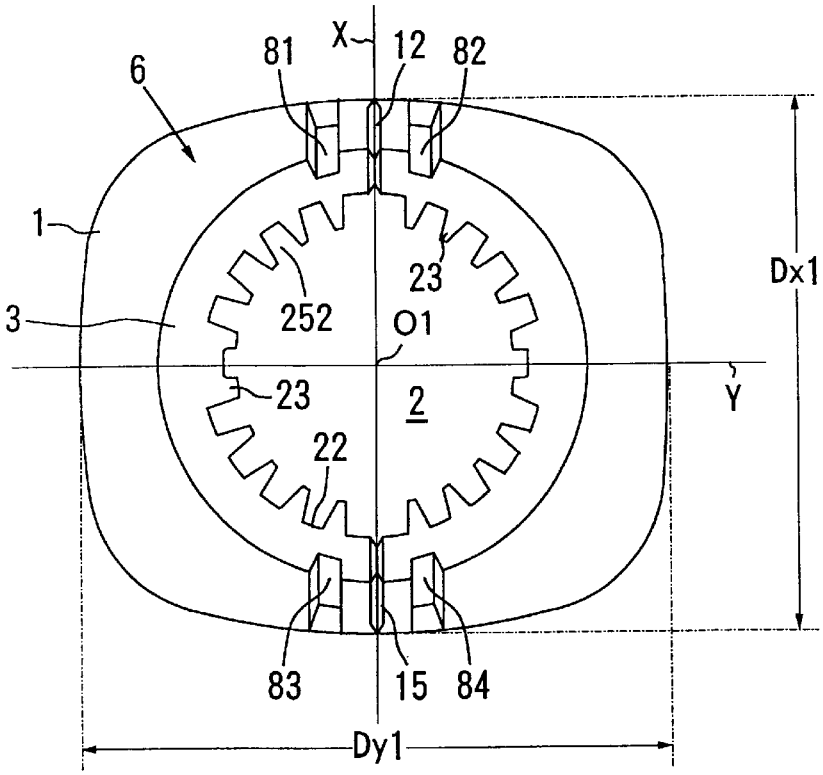
FIG. 64 is a bottom view of the deflecting yoke core shown in FIG. 63.
Figure 65:
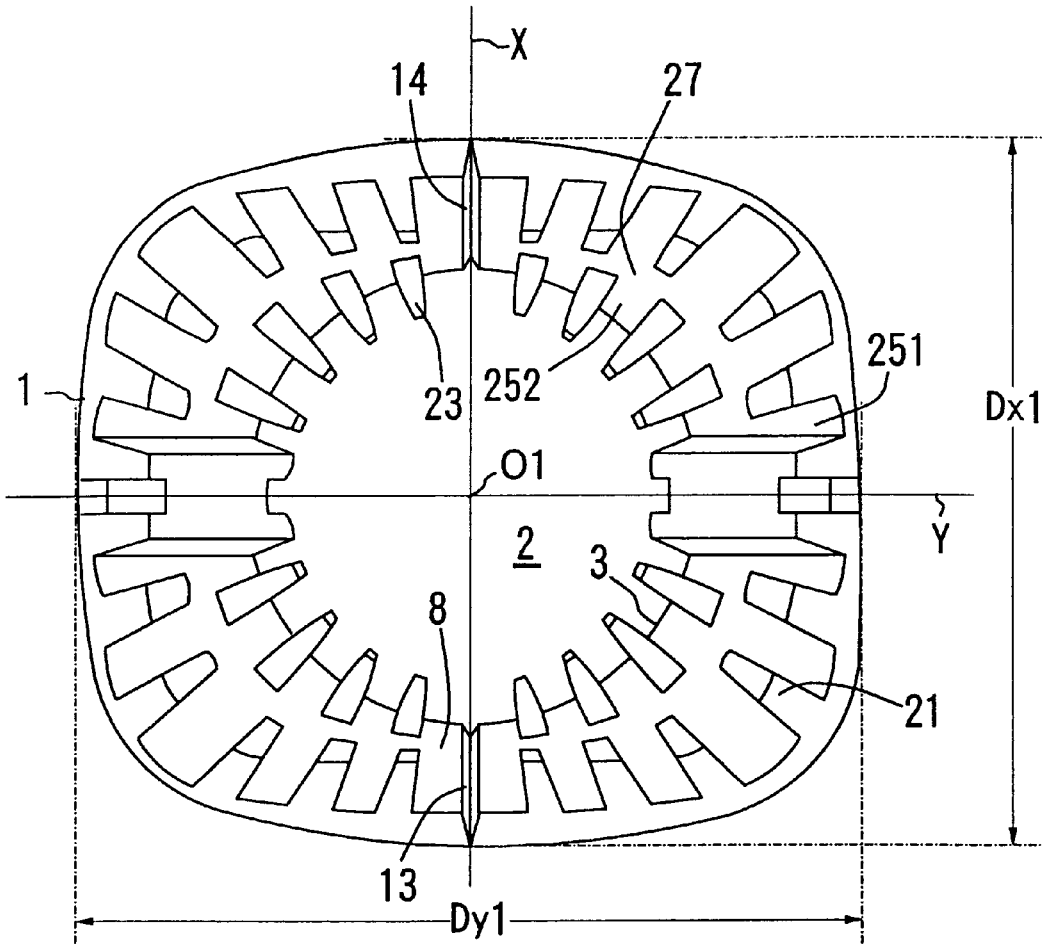
FIG. 65 is a plan view of the deflecting yoke core shown in FIG. 63.

FIG. 63 is a front view of yet another embodiment of the deflecting yoke core according to the present invention, FIG. 64 is a bottom view of the deflecting yoke core shown in FIG. 63, and FIG. 65 is a plan view of the deflecting yoke core shown in FIG. 63. Since the basic structure adopted in the deflecting yoke core shown in FIGS. 63 to 65 and the resulting advantages are the same as those explained earlier in reference to FIGS. 15 to 18, a repeated explanation is omitted.

In the embodiment presented in FIGS. 63 to 65, too, the dividing grooves 12 to 15 are provided at the core surface near the minor axis X. In other words, since they are set at positions at which the adverse effects of their presence on the density of the magnetic flux attributable to the horizontal deflection magnetic field is minimized, reductions in the core loss and the quantity of heat generated at the core are achieved.

In addition, clip grooves 81 to 84 are provided at the outer circumferential surface 6 on two sides of the minor axis X. Thus, core chipping is prevented and deformation does not occur readily during the baking process, as in the embodiments illustrated in FIGS. 47 to 62.

Furthermore, core saturation may be prevented when a horizontal deflection magnetic field and a vertical deflection magnetic field are created in a deflecting yoke constituted of any of the deflecting yoke cores shown in FIGS. 47 to 65 and deflection coils by ensuring that the core sectional areas along a plane parallel to and passing through a core axis O1 are largest within an angular range of 30° to 65° measured around the core axis O1 from a 0° reference angle at the minor axis X, as explained earlier.

Figure 66:
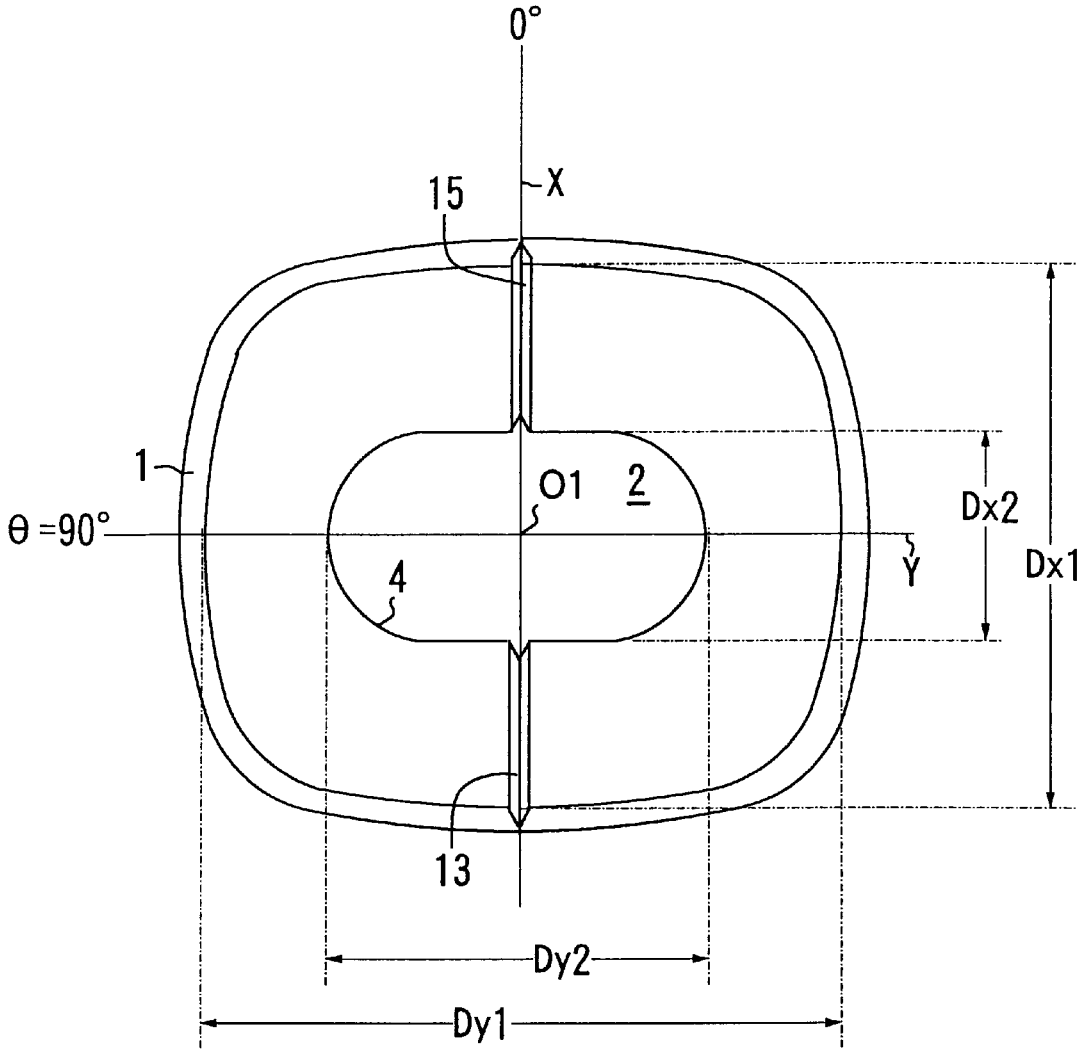
FIG. 66 is a plan view of yet another embodiment of the deflecting yoke core according to the present invention.
Figure 67:
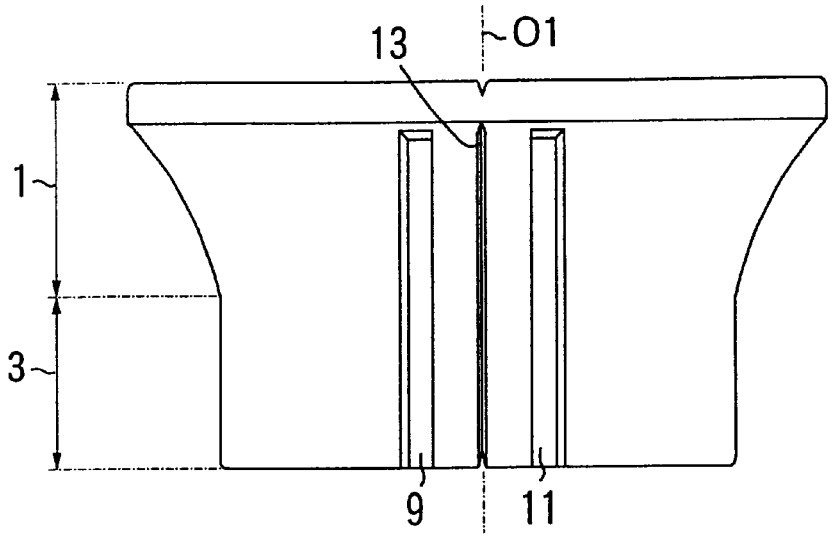
FIG. 67 is a front view of the deflecting yoke core shown in FIG. 66.
Figure 68:
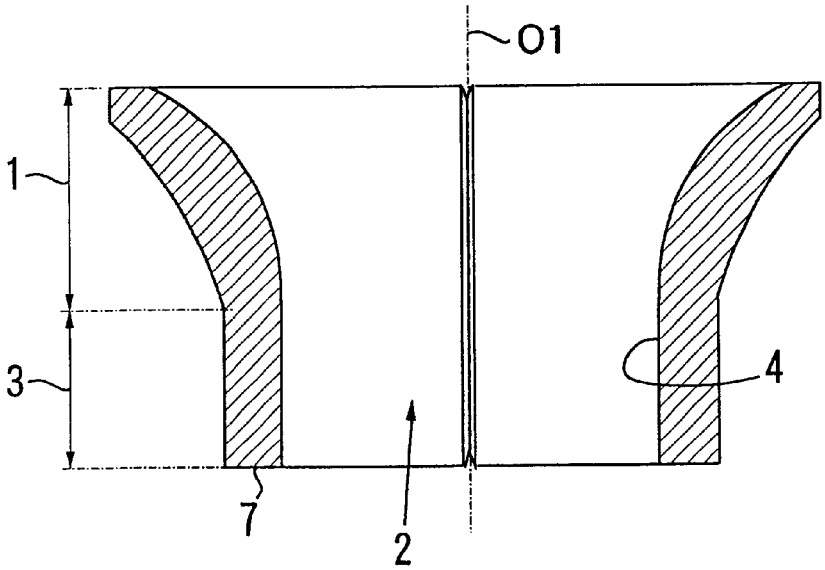
FIG. 68 is a cross-sectional front view of the deflecting yoke core shown in FIGS. 66 and 67.

FIG. 66 is a plan view showing yet another embodiment of the deflecting yoke core according to the present invention, FIG. 67 is a front view of the deflecting yoke core shown in FIG. 66, and FIG. 68 is a cross-sectional front view of the deflecting yoke core shown in FIG. 66.

The embodiment illustrated in FIGS. 66 to 68 has a hole 2 extending from the opening end of the neck portion 3 to the opening end of the funnel portion 1. The hole 2 at the funnel portion 1 widens toward the opening end of the funnel portion 1. The hole 2 assumes a curved shape over the entire circumference viewed at the opening end of the funnel portion 1. The hole 2 at the funnel portion 1 achieves a shape having a short diameter Dx1 along the minor axis X and a long diameter Dy1 along the major axis Y. The short diameter Dx1 and the long diameter Dy1 achieve a relationship expressed as Dy1>Dx1. The hole 2 at the neck portion 3 achieves a shape having a short diameter Dx2 along the minor axis X and a long diameter Dy2 along the major axis Y. The short diameter Dx2 and the long diameter Dy2 achieve a relationship expressed as Dy2>Dx2.

More specifically, the hole 2 at the opening end of the funnel portion 1 achieves a quadrilateral shape with two arched sides facing opposite each other over the minor axis X being longer than two arched sides facing opposite each other over the major axis Y. The hole 2 at the opening end of the neck portion 3 assumes a shape achieved by connecting two arched sides facing opposite each other over the major axis Y with two linear sides facing opposite each other over the minor axis X. The neck portion 3 may assume an oval-like shape or the like, instead. The minor axis X and the major axis Y pass through the core axis O1 and intersect each other at a right angle.

The hole 2 extends along the direction of the core axis O1 over an appropriate axial length while retaining a roughly constant shape at the neck portion 3, until its inner surface 4 becomes continuous to the funnel portion 1. The inner surface of the funnel portion 1 is continuous to the inner surface 4 of the neck portion 3 and widens toward the opening end of the funnel portion 1.

Figure 69:
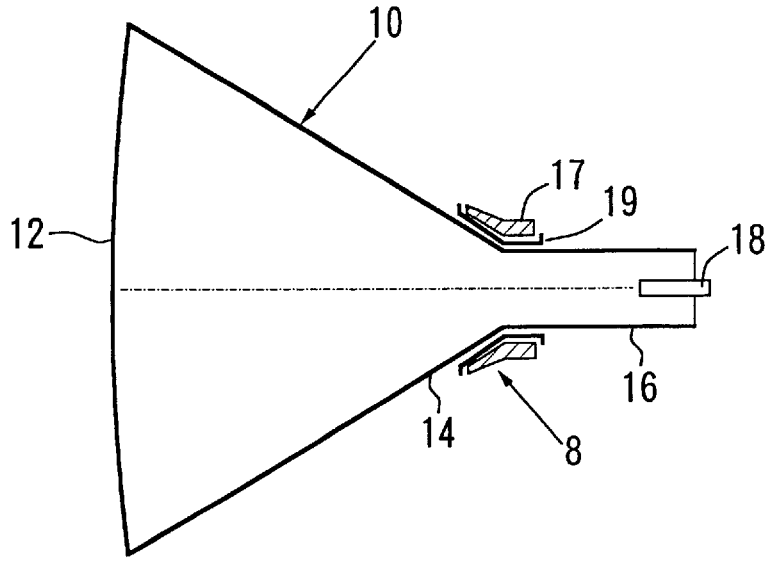
FIG. 69 schematically illustrates a state in which a deflecting yoke constituted with the deflecting yoke core shown in FIGS. 66 to 68 is mounted at a cathode ray tube.

FIG. 69 schematically illustrates a deflecting yoke 8 constituted by using the deflecting yoke core shown in FIGS. 66 to 68, which is mounted at a cathode ray tube 10. The cathode ray tube 10 includes a display panel 12, a funnel 14, a neck 16 and electron guns 18. The deflecting yoke 8 is mounted between the funnel 14 and the neck 16.

The deflecting yoke 8 is constituted by providing deflection coils 19 supported by a separator (not shown) at a deflecting yoke core 17 according to the present invention. The deflection yoke coils 19 include a horizontal deflection coil and a vertical deflection coil. The cathode ray tube 10 is a color television image receiver cathode ray tube and includes three electron guns 18 provided in an in-line arrangement.

Figure 70:
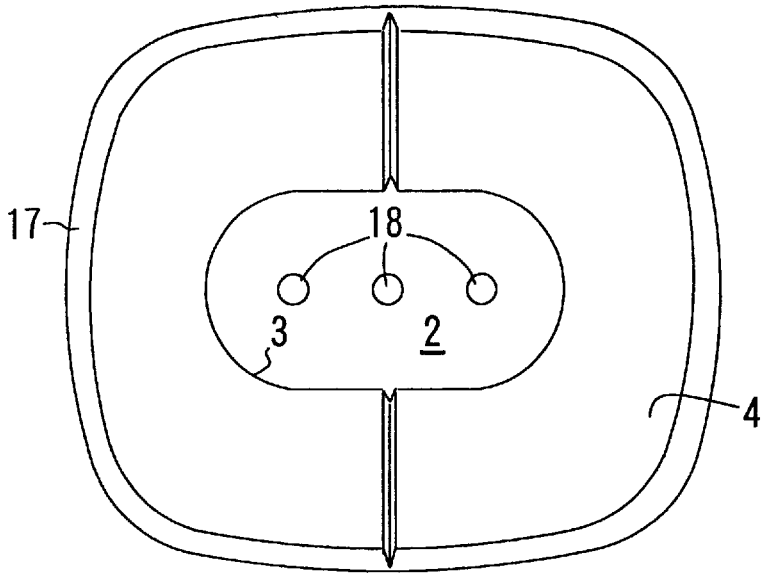
FIG. 70 illustrates the relationship between the deflecting yoke core shown in FIGS. 66 to 68 and electron guns.

FIG. 70 illustrates the relationship between the deflecting yoke core 17 according to the present invention and the three electron guns 18 corresponding to the three primary colors. The deflection coils, the separator and the like are not included in the illustration for simplification. As explained earlier, the core 17 according to the present invention achieves a shape having a long diameter along a major axis Y and a short diameter along a minor axis X at the neck portion 3 as well as at the funnel portion 1, and thus, it is ideal in application in a color television image receiver having the three electron guns 18 corresponding to the three primary colors provided in an in-line arrangement.

Furthermore, two indented grooves 9 and 11 are provided at the outer circumferential surface near the minor axis X, with a dividing groove 13 provided between the indented grooves 9 and 11. The dividing groove 13 is formed in a V-shape roughly on the minor axis X. As shown in FIGS. 69 and 70, the deflecting yoke 8 is assembled by first dividing the deflecting yoke core 17 along the dividing groove 13 and then providing the separator and the deflection coils 19. Next, the two core pieces that have been separated are fitted together with a clip (not shown) hooked at the area between the indented grooves 9 and 11.

When a horizontal deflection magnetic field and a vertical deflection magnetic field are created in the deflecting yoke 8 constituted of the deflecting yoke core 17 provided with the deflection coils 19 as shown in FIG. 69, the density of the core internal magnetic flux attributable to the resulting combined deflection magnetic field is not consistent within the core 17 and is the highest within an angular range of 30° to 65° measured around the core axis O1 from a 0° reference angle set at the minor axis X. For this reason, the core 17 may become saturated over the area where the density of the magnetic flux is high. The two means that may be effectively adopted to prevent such saturation have already been explained.

Figure 71:
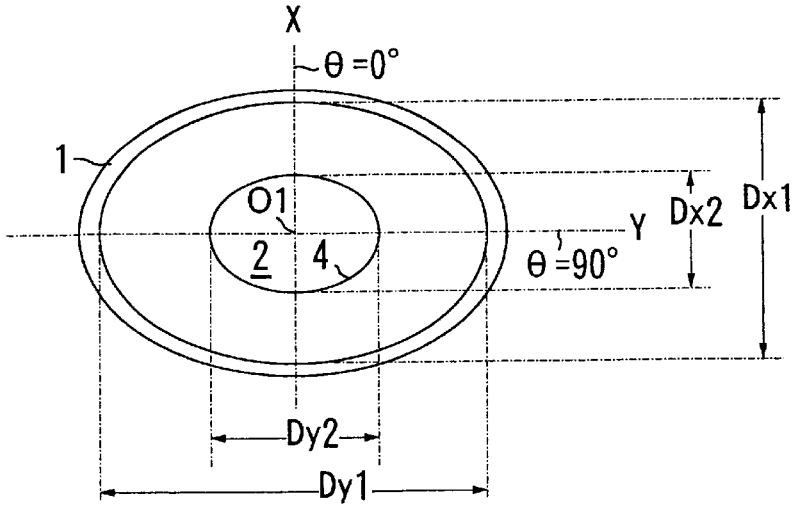
FIG. 71 is a plan view of yet another embodiment of the deflecting yoke core according to the present invention.
Figure 72:
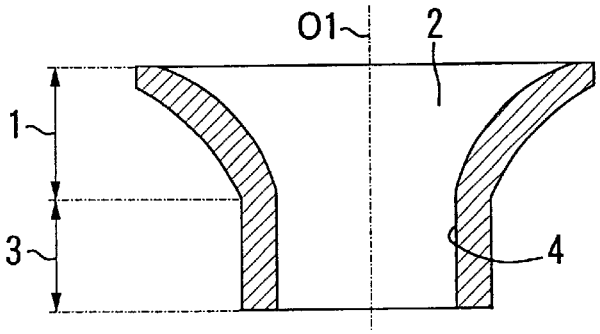
FIG. 72 is a cross-sectional view of the deflecting yoke core shown in FIG. 71 taken along the major axis Y.
Figure 73:
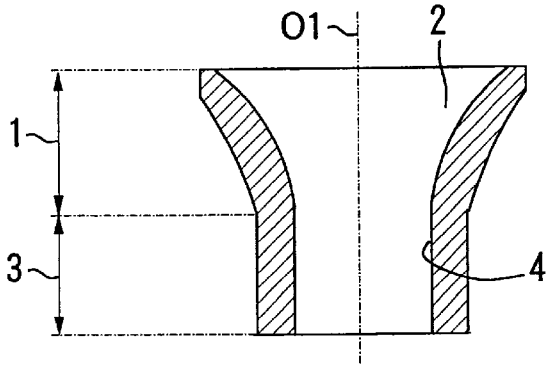
FIG. 73 is a cross-sectional view of deflecting yoke core shown in FIG. 71 taken along the minor axis X.

FIG. 71 is a plan view of yet another embodiment of the deflecting yoke core according to the present invention, FIG. 72 is a cross-sectional view taken along the major axis Y of the deflecting yoke core shown in FIG. 71, and FIG. 73 is a cross-sectional view taken along the minor axis X of the deflecting yoke core shown in FIG. 71. In this embodiment, the opening end surface at the funnel portion 1 and the opening end surface at the neck portion 3 are both formed in an oval shape. This embodiment is also ideal in an application in a color television image receiver having three electron guns corresponding to the three primary colors provided in an in-line arrangement. Although a detailed explanation is omitted, the same principles for preventing magnetic saturation as those explained earlier apply with regard to the core sectional areas and the core density.

Figure 74:
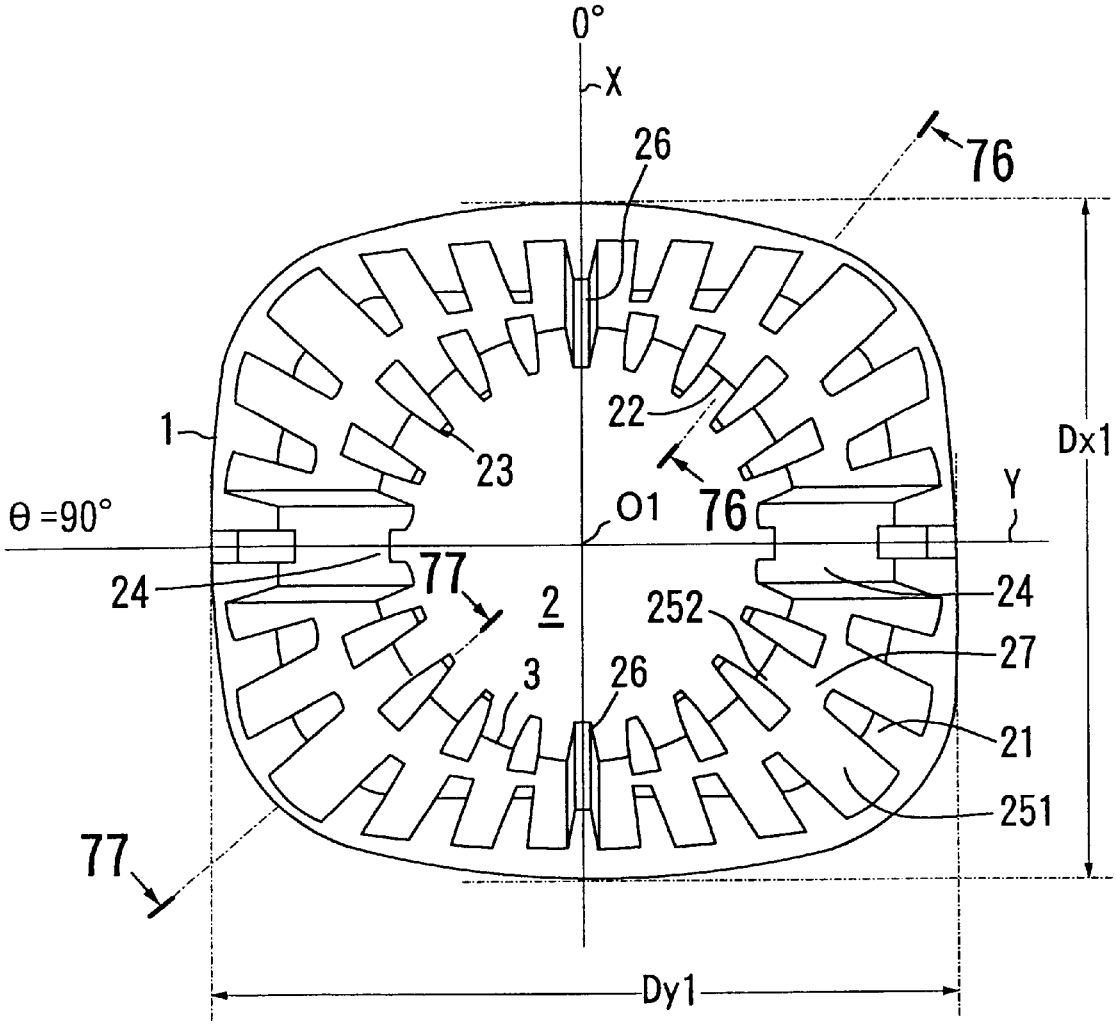
FIG. 74 is a plan view of yet another embodiment of the deflecting yoke core according to the present invention.
Figure 75:
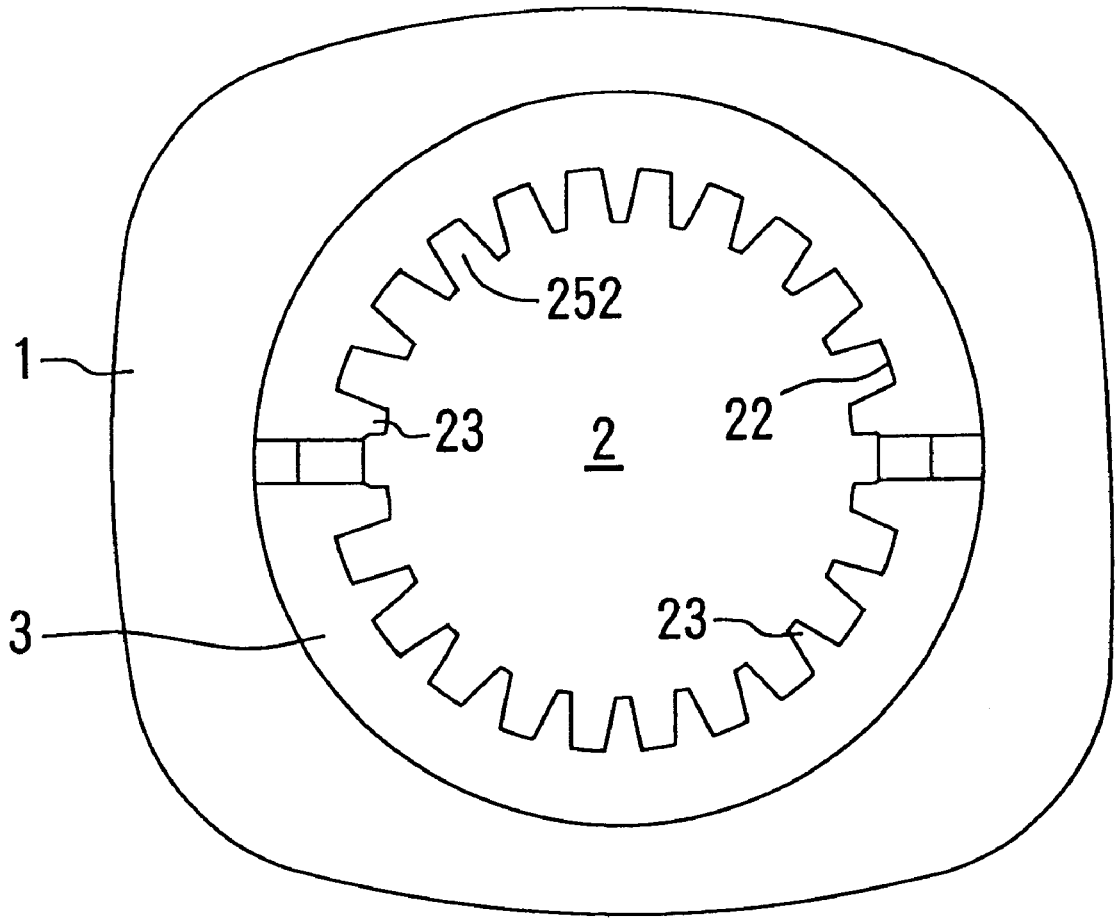
FIG. 75 is a bottom view of the deflecting yoke core shown in FIG. 74.
Figure 76:
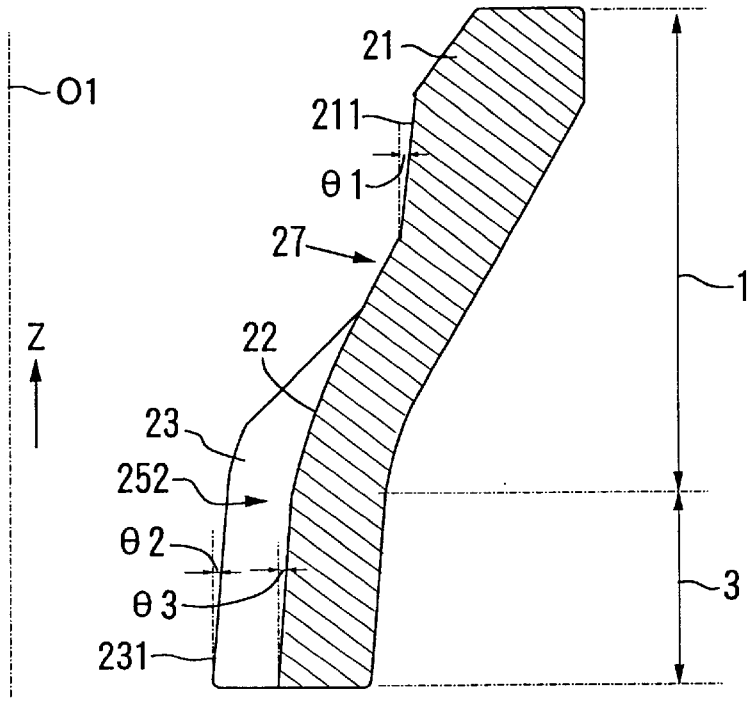
FIG. 76 is an enlarged partial cross-sectional view taken along line 76—76 in FIG. 74.
Figure 77:
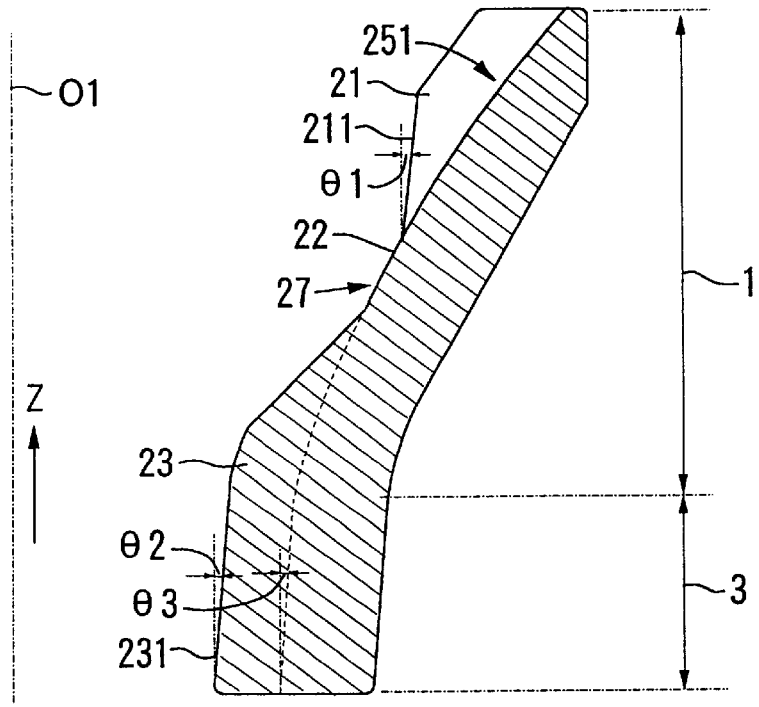
FIG. 77 is an enlarged partial cross-sectional view taken along line 77—77 in FIG. 74.

FIG. 74 is a plan view of yet another embodiment of the deflecting yoke core according to the present invention, FIG. 75 is a bottom view of the deflecting yoke core shown in FIG. 74, FIG. 76 is an enlarged cross-sectional view taken along line 76—76 in FIG. 74, and FIG. 77 is an enlarged cross-sectional view taken along line 77—77 in FIG. 74. Since the basic structure adopted in the deflecting yoke core shown in FIGS. 74 to 77 and the resulting advantages are the same as those explained earlier in reference to FIGS. 15 to 18, a repeated explanation is omitted.

A plurality of projecting portions 21 and a plurality of projecting portions 23 provided at a core inner surface 22 of the deflecting yoke core 17 are both provided over four areas separated from one another by a plurality of continuous projecting portions 24 provided at positions facing opposite each other and a plurality of continuous projecting portions 26 provided at positions facing opposite each other. In other words, two projecting portions 24 are provided at positions facing opposite each other and two projecting portions 26 are provided at positions facing opposite each other.

A surface 211 of each projecting portion 21 faces opposite the core axis O1 and inclines at an angle θ1 to recede from the core axis O1 along the direction Z from the neck portion 3 toward the funnel portion 1. A surface 231 of each projecting portion 23 faces opposite the core axis O1 and inclines at an angle θ2 to recede from the core axis O1 along the direction Z from the neck portion 3 toward the funnel portion 1. In addition, the core inner surface 22 inclines at an angle θ3 to recede from the core axis O1. Although no specific explanation is given, a similar structure is adopted at other core surfaces as well.

The projecting portions 21 and 23 are provided in a radial pattern along the core inner surface 22, with the surfaces 211 and 231 facing opposite the core axis O1 inclining at the angles θ1 and θ2 to recede from the core axis O1 along the direction Z from the neck portion 3 toward the funnel portion 1. Thus, the deflecting yoke core molded by using magnetic powder can be rapped out easily with a high degree of reliability along the direction of the core axis O1. Next, this point is explained in reference to FIGS. 78 to 80. The method illustrated in FIGS. 78 to 80 may be adopted in a standard application in which a deflecting yoke core is molded by using magnetic powder.

Figure 78:
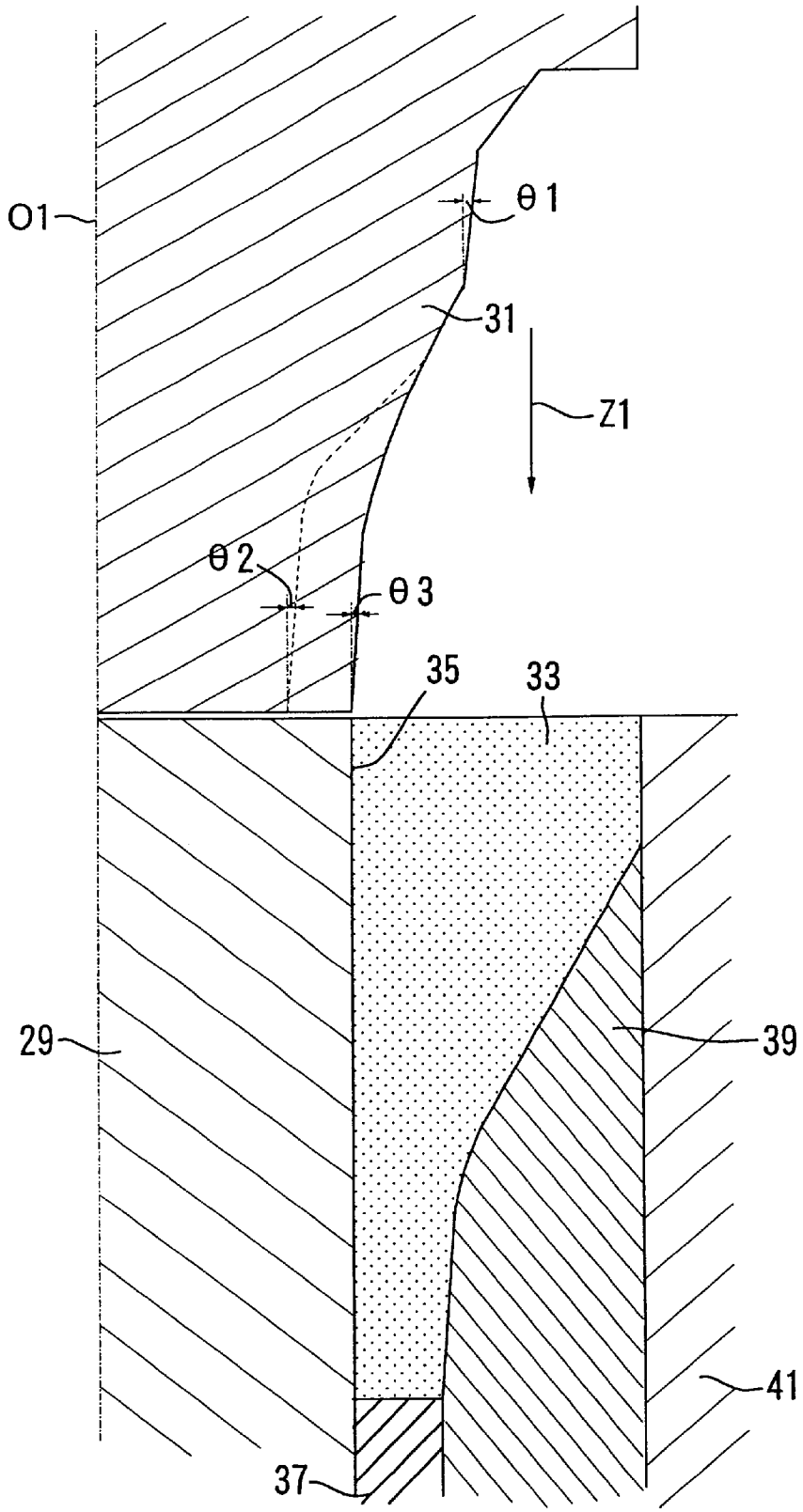
FIG. 78 illustrates a molding step implemented to manufacture the deflecting yoke core shown in FIGS. 74 to 77.

First, as shown in FIG. 78, magnetic powder 33 is charged into a cavity 35 formed by lower dies 29, 37, 39 and 41. At an upper die 31, gradients are provided at angles θ1, θ2 and θ3 along the direction Z1 along which the upper die 31 moves parallel to the core axis O1. The angles θ1, θ2 and θ3 roughly match the angle of inclination θ1 at the projecting portions 21 in the funnel portion 1, the angle of inclination θ2 at the projecting portions 23 in the neck portion 3 and the angle of inclination θ3 at the core inner surface 22 (see FIGS. 76 and 77), respectively.

Figure 79:
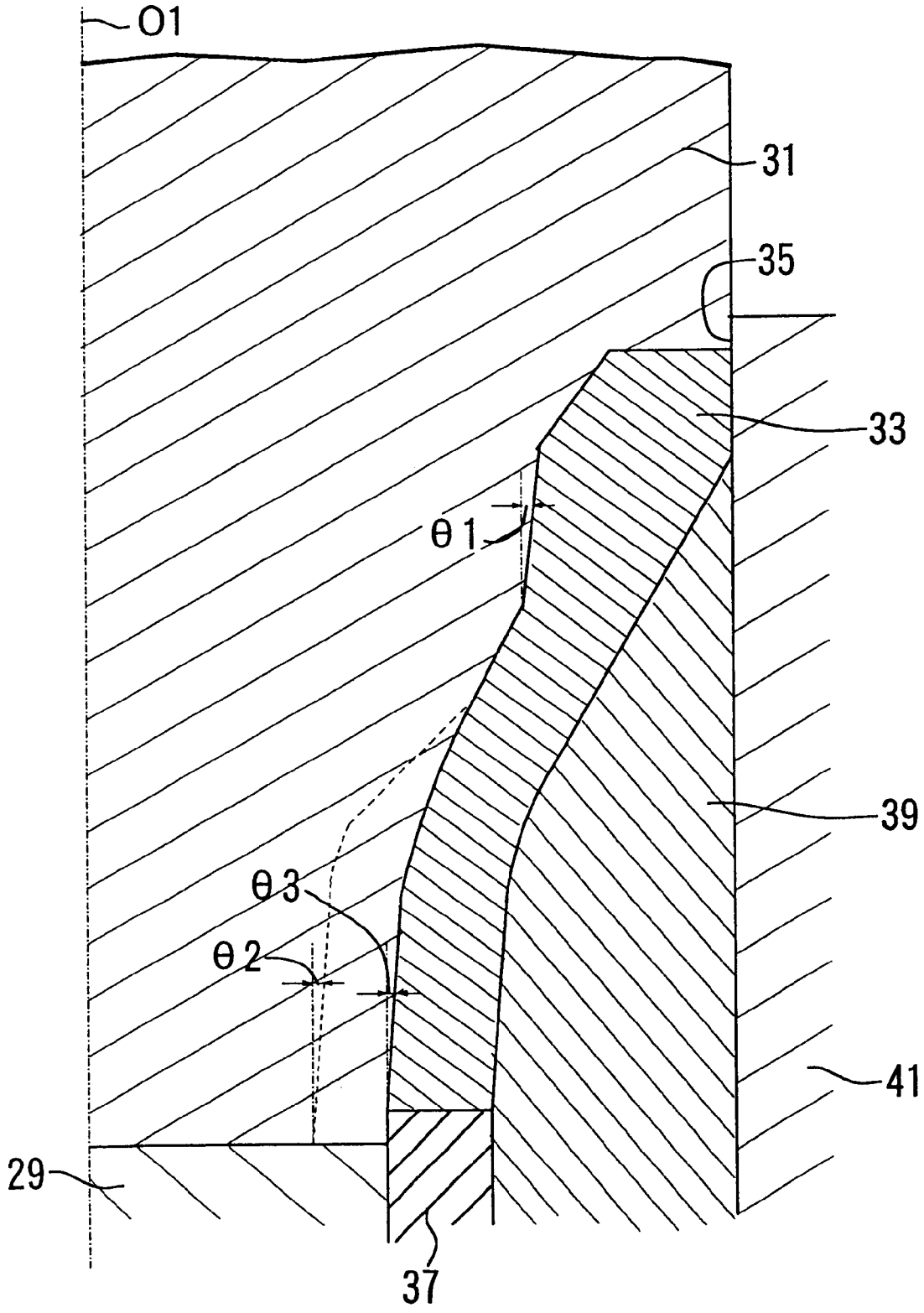
FIG. 79 shows a molding step implemented after the step shown in FIG. 78.

Then, by moving the upper die 31 along the direction indicated by the arrow Z1, the upper die 31 is interlocked with the lower dies 29, 37, 39 and 41 to pressurize the magnetic powder 33. Thus, as shown in FIG. 79, a deflecting yoke core having the projecting portions 21 achieving the angle of inclination θ1, the projecting portions 23 achieving the angle of inclination θ2 and the core inner surface 22 achieving the angle of inclination θ3 is molded.

Figure 80:
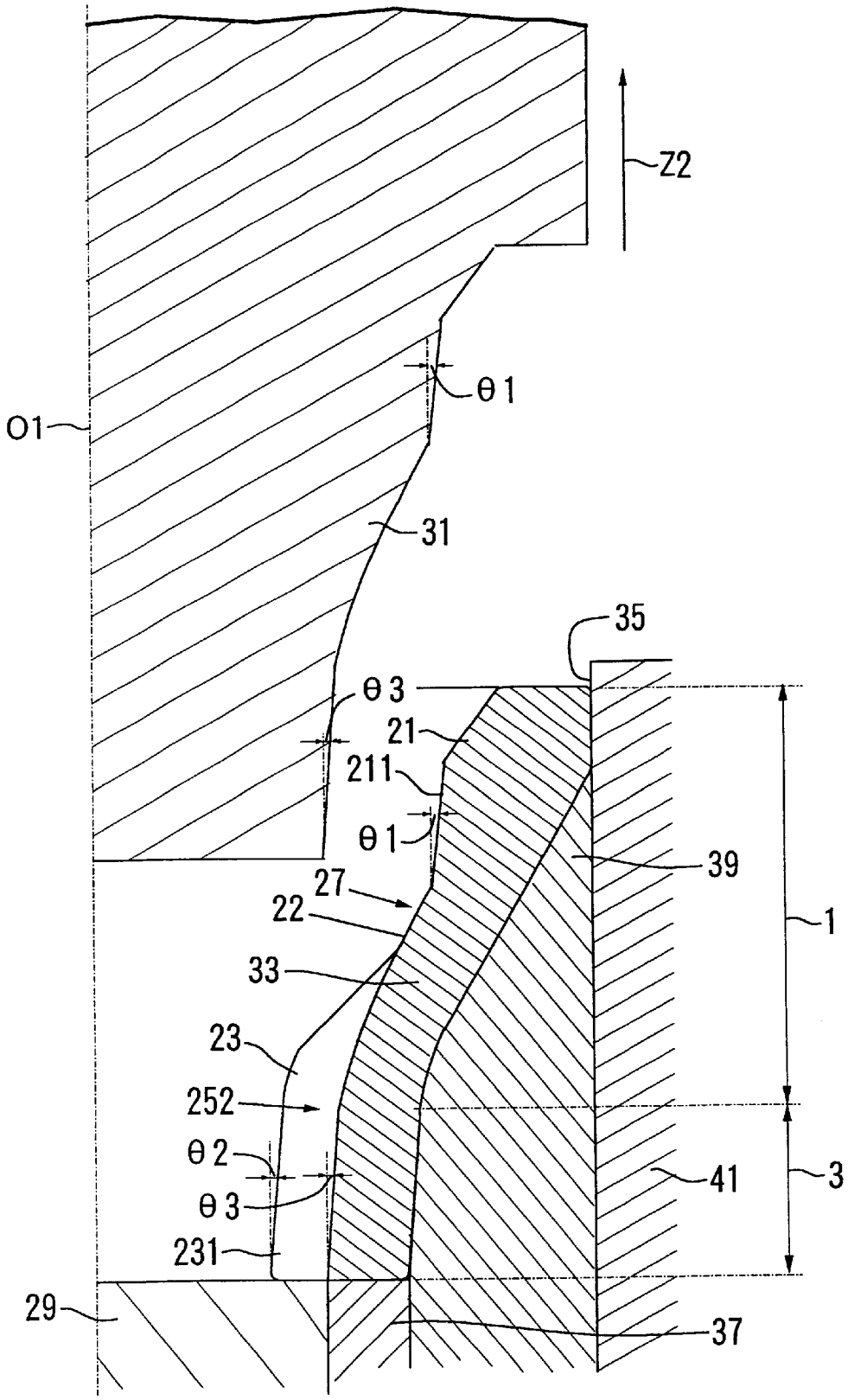
FIG. 80 shows a molding step implemented after the step shown in FIG. 79.

Next, as shown in FIG. 80, the upper die 31 is moved along the direction indicated by the arrow Z2 parallel to the core axis O1 to rap out the core. Since the plurality of projecting portions 21 and 23 in the molded core are provided in a radial pattern along the core inner surface 22 and their surfaces 211 and 231 face opposite the core axis O1 and incline at the angles θ1 and θ2 to recede from the core axis O1 along the direction Z2 which is parallel to the core axis O1 along which the core is rapped out, the core can be rapped out easily with a high degree of reliability. The same principle applies with regard to the core inner surface 22 and other surfaces.

Figure 81:
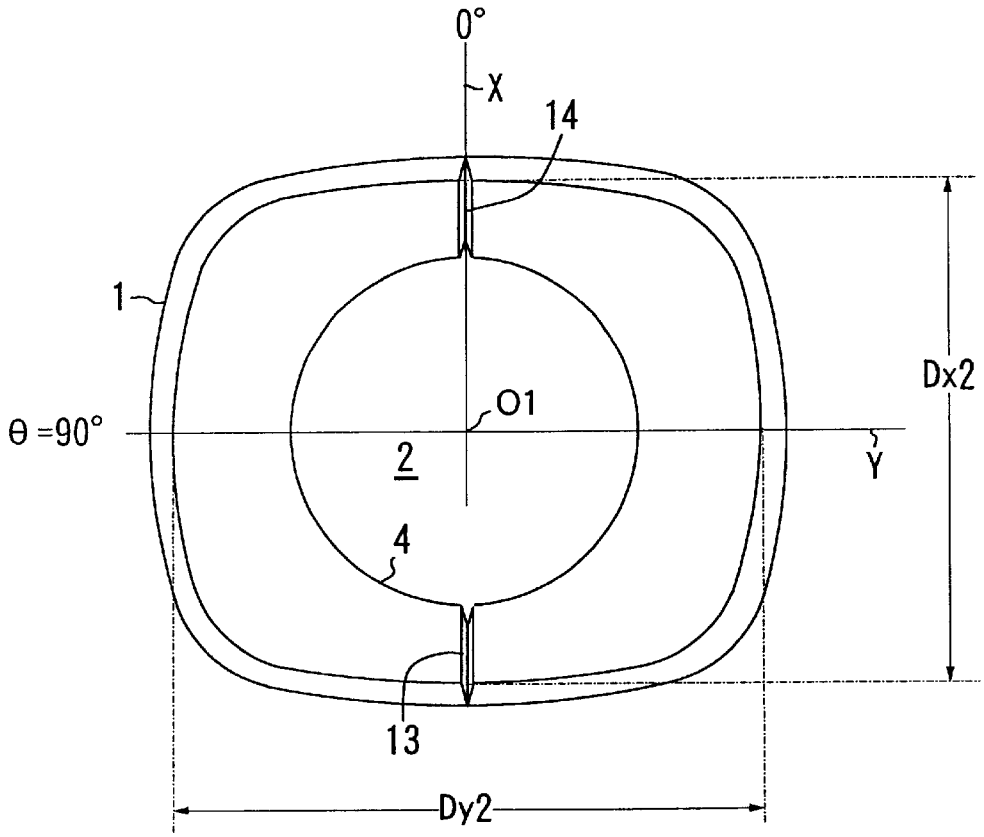
FIG. 81 is a plan view of yet another embodiment of the deflecting yoke core according to the present invention.
Figure 82:
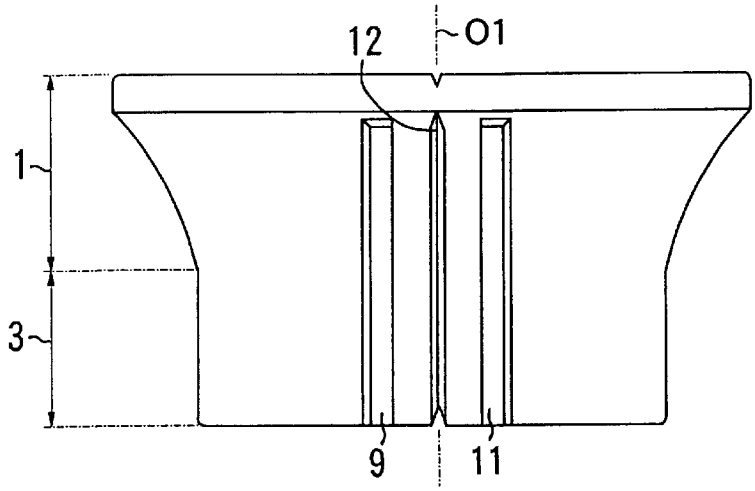
FIG. 82 is a front view of the deflecting yoke core shown in FIG. 81.
Figure 83:
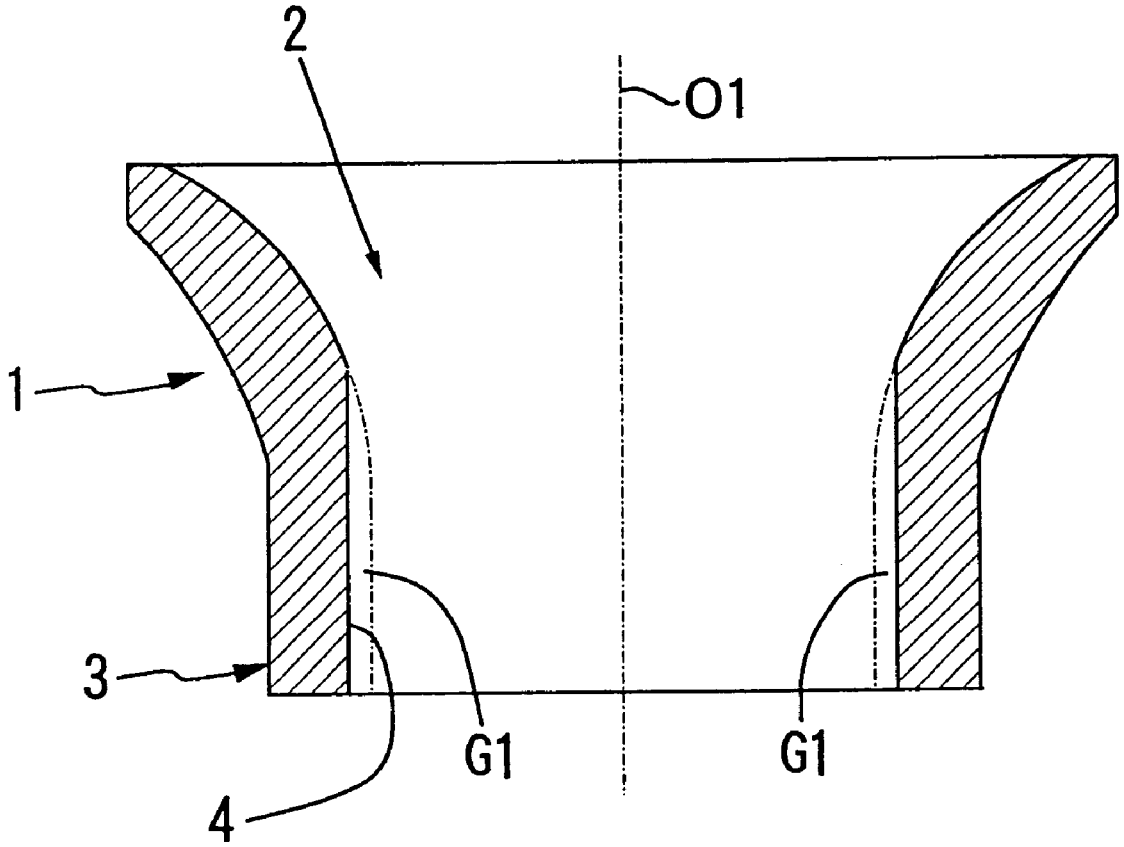
FIG. 83 is a cross-sectional front view of the deflecting yoke core shown in FIGS. 81 and 82.

FIG. 81 is plan view of yet another embodiment of the deflecting yoke core according to the present invention, FIG. 82 is a front view of the deflecting yoke core shown in FIG. 81, and FIG. 83 is a cross-sectional front view of the deflecting yoke core shown in FIG. 81. Since the shapes of the opening ends at the neck portion 3 and the funnel portion 1 adopted in the deflecting yoke core in FIGS. 81 and 82 are similar to those in the embodiment shown in FIGS. 1 and 2, a repeated explanation is omitted by assigning the same reference numerals to components identical to those in FIGS. 1 and 2.

In FIGS. 81 and 82, the inner surface of the hole 2 at the neck portion 3 constitutes a ground surface 4. The area G1 indicated by the one-point chain line in FIG. 83 is the grinding margin that is ground off. As a result, the inner surface of the hole 2 constituted of the ground surface 4 achieves a high degree of a surface smoothness and a high degree of dimensional accuracy.

Figure 84:
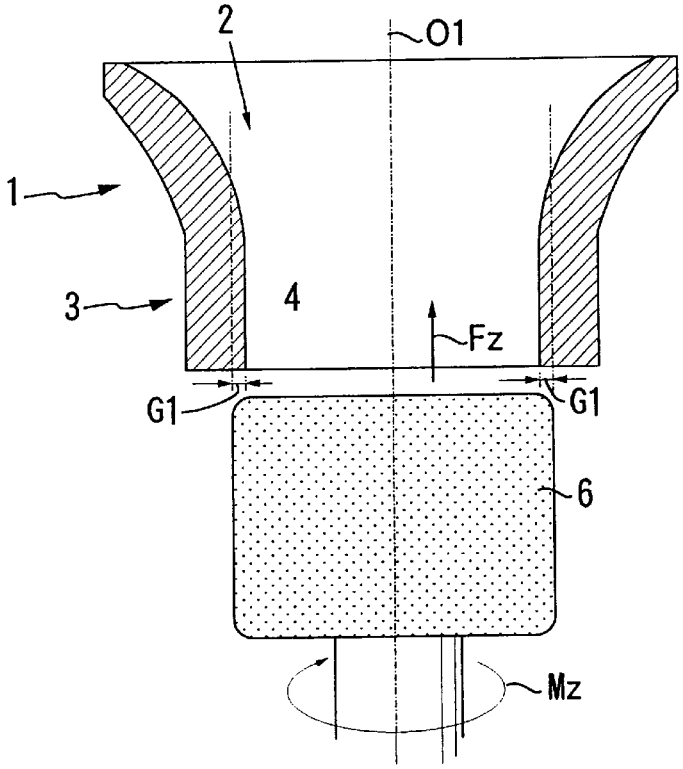
FIG. 84 illustrates a method adopted to grind the inner surface of the hole when manufacturing the deflecting yoke core shown in FIGS. 81 to 83.
Figure 85:
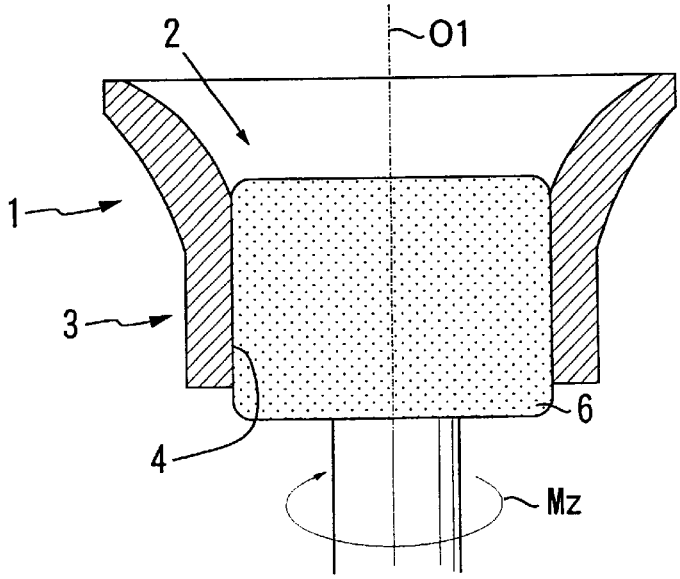
FIG. 85 also illustrates the method adopted to grind the inner surface of the hole when manufacturing the deflecting yoke core shown in FIGS. 81 to 83.

FIGS. 84 and 85 show a method that may be adopted when grinding the inner surface of the hole 2. As shown in the figures, the inner surface of the hole 2, which is formed in a circular shape at the neck portion 3 where it is ground can be ground with ease with a grinding margin G1 by, for instance, utilizing a grinding tool 6 such as a rotary grindstone, rotating the grinding tool 6 along the direction indicated by the arrow Mz and moving the grinding tool 6 along the direction indicated by the arrow Fz. Through this process, the inner surface of the hole 2 becomes the ground surface 4 achieving a high degree of surface smoothness and a high degree of dimensional accuracy. The core may be rotated instead of rotating the grinding tool 6. The core may be rotated either unidirectionally or bidirectionally in such a case.

Figure 86:
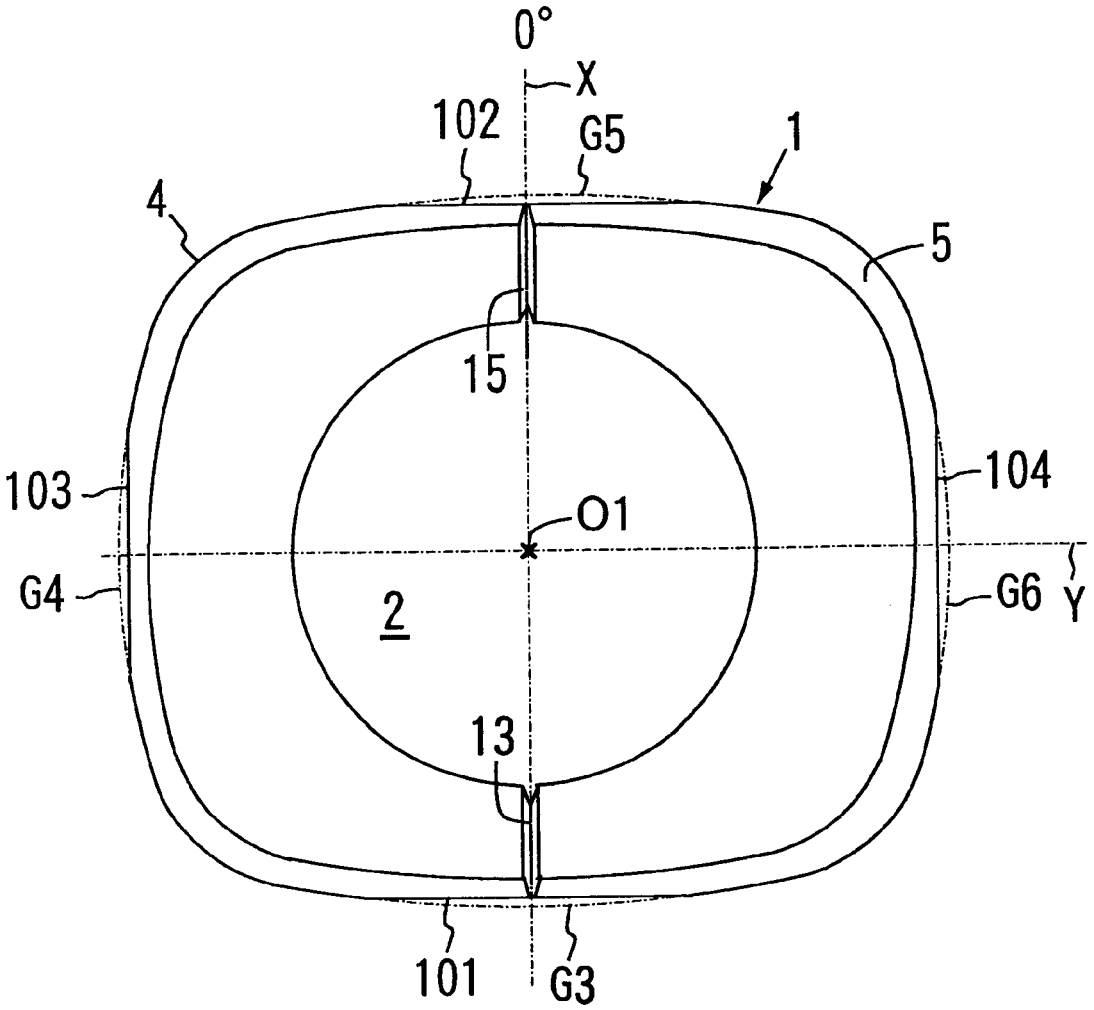
FIG. 86 is a plan view showing an example in which the external circumferential surface of the deflecting yoke core shown in FIGS. 81 to 83 is ground at the funnel portion.

Since the dimensional accuracy of the hole 2 at the neck portion 3 is improved through the grinding process described above, the core axis O1 which is the central axis of the hole 2 can be set with a high degree of accuracy. This, in turn, makes it possible to surface-grind the outer surface at the funnel portion 1 relative to the core axis O1, as shown in FIG. 86, so that flat surface areas 101 to 104 obtained by grinding the outer surface can be used for reference when positioning the core relative to the separator. Thus, the core can be positioned highly accurately relative to the separator, and ultimately, the core can be positioned with a high degree of accuracy relative to the cathode ray tube. While FIG. 86 presents an example in which there are four ground flat surfaces 101 to 104 achieved by grinding the outer surface with grinding margins G3 to G6, the number of the ground flat surfaces 101 to 104 is arbitrary. There may be four or fewer ground flat surfaces, e.g., one to three ground flat surfaces, or there may be four or more ground flat surfaces.

Figure 87:
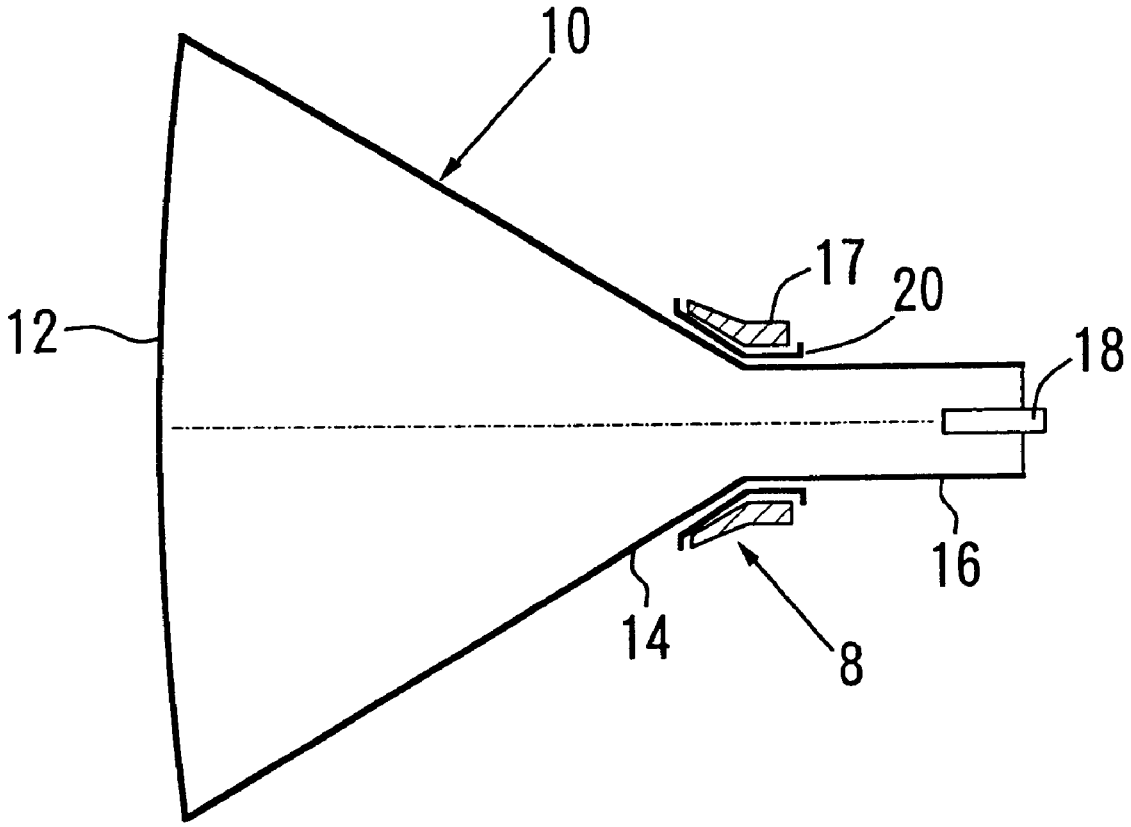
FIG. 87 schematically illustrates a state in which a deflecting yoke constituted with the deflecting yoke core shown in FIGS. 81 to 83 is mounted at a cathode ray tube.

FIG. 87 schematically illustrates a state in which a deflecting yoke constituted with the deflecting yoke core shown in FIGS. 81 to 83 is mounted at a cathode ray tube 10. The cathode ray tube 10 is provided with a display panel 12, a funnel 14, a neck 16 and electron guns 18. The deflecting yoke 8 includes a core 17 according to the present invention and a separator 20 and is mounted between the funnel 14 and the neck 16. The separator 20, which includes a horizontal deflection coil and a vertical deflection coil (not shown), is provided at the core 17.

Since the core 17 according to the present invention has a circular hole 2 at the neck portion 3 with the inner surface of the hole 2 constituted of the ground surface 4 at the neck portion 3 as shown in FIGS. 81 to 83, the dimensional accuracy at the neck portion 3 is improved.

In addition, as shown in FIG. 86, after the inner surface of the hole 2 is ground, the outer surface of the funnel portion 1 is surface-ground relative to the core axis O1 matching the central axis of the hole 2 and the ground flat surfaces 101 to 104 obtained by grinding the outer surface can be used for reference when positioning the core relative to the separator 20. As a result, the core 17 can be positioned relative to the separator 20 with a high degree of accuracy. Consequently, the deflecting yoke 8 constituted by using the core 17 according to the present invention can be mounted at the cathode ray tube 10 with great accuracy.

Figure 88:
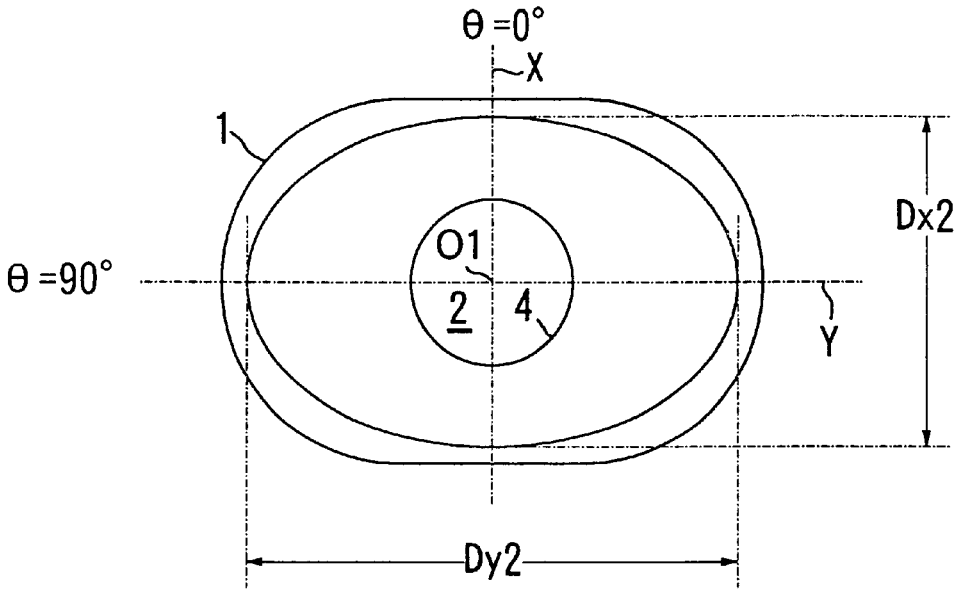
FIG. 88 is a plan view of yet another embodiment of the deflecting yoke core according to the present invention.
Figure 89:
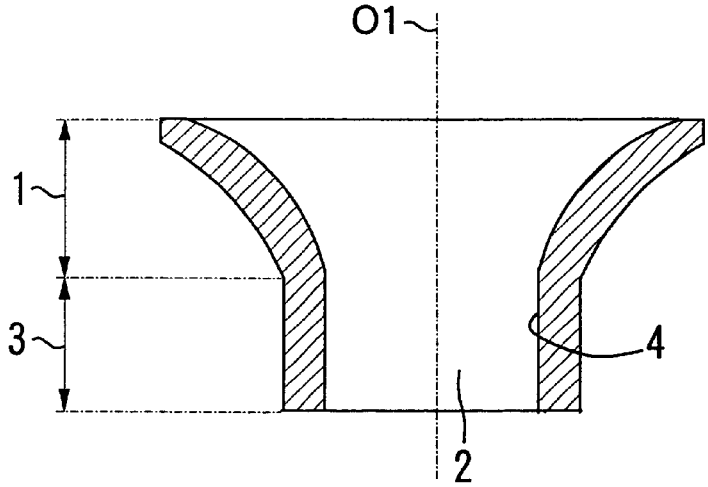
FIG. 89 is a cross-sectional front view of the deflecting yoke core shown in FIG. 88.

FIG. 88 is a plan view of yet another embodiment of the deflecting yoke core according to the present invention and FIG. 89 is a cross-sectional front view of the deflecting yoke core shown in FIG. 88. The hole 2 in this embodiment is formed in an oval shape at the funnel portion 1. The hole 2 is formed in a circular shape at the neck portion 3, with its inner surface constituting the ground surface 4. Thus, an improvement in the dimensional accuracy is achieved at the neck portion 3. Consequently, a deflecting yoke 8 constituted of the core 17 in this embodiment can be mounted with a high degree of accuracy at a cathode ray tube (see FIG. 87).

Figure 90:
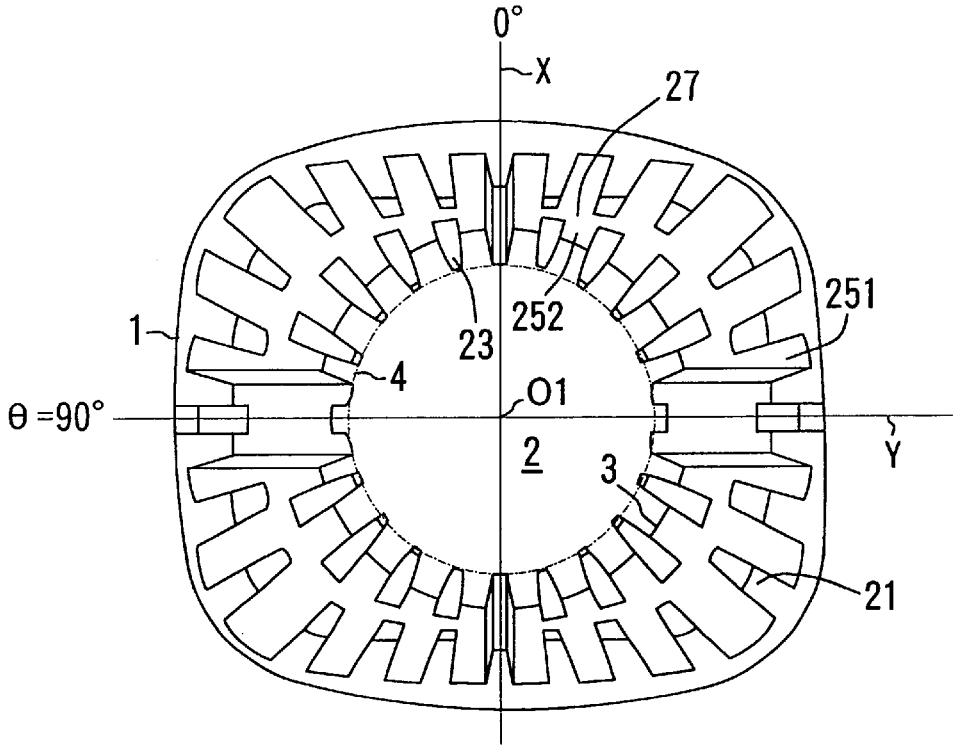
FIG. 90 is a plan view of yet another embodiment of the deflecting yoke core according to the present invention.
Figure 91:
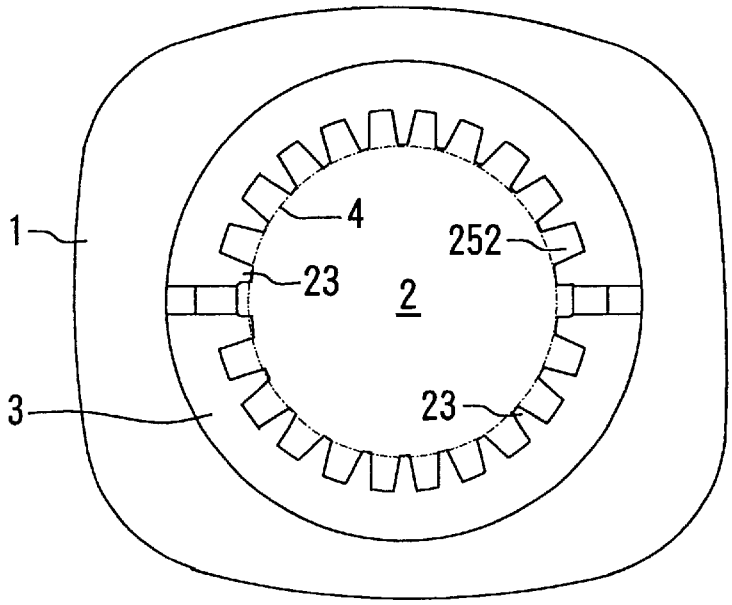
FIG. 91 is a bottom view of the deflecting yoke core shown in FIG. 90.

FIG. 90 is a plan view of a deflecting yoke core according to the present invention and FIG. 91 is a bottom view of the deflecting yoke core shown in FIG. 90. Since the basic structure adopted in the deflecting yoke core shown in FIGS.

90 and 91 and the resulting advantages are the same as those explained earlier in reference to FIGS. 15 to 18, a repeated explanation is omitted.

In the embodiment shown in FIGS. 90 and 91, the end surfaces of projecting portions 23 at the neck portion 3 are set on the circumference of a circle and the end surfaces of the projecting portions 23 each form a ground surface 4 so that a high degree of dimensional accuracy is achieved at the neck portion 3.

Figure 92:
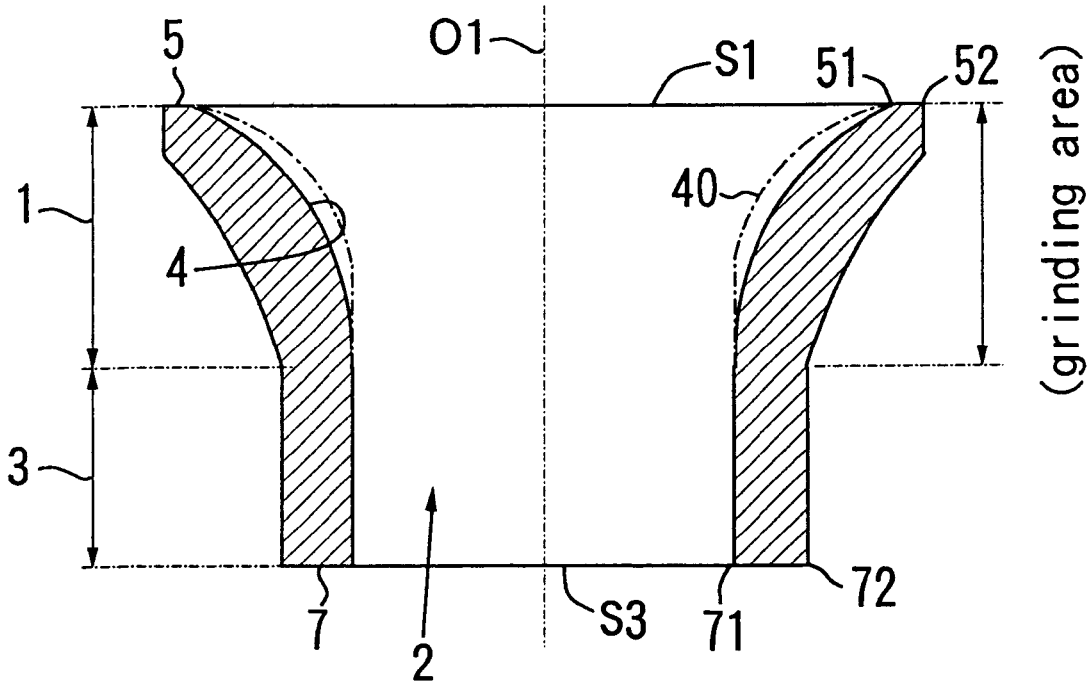
FIG. 92 is a cross-sectional view illustrating another method adopted to grind the deflecting yoke core.

FIG. 92 is a cross-sectional view of yet another embodiment of the deflecting yoke core according to the present invention. In this embodiment, the inner surface 4 at the funnel portion 1 which is continuous to the inner edge 51 of the opening end surface 5 is ground. As a result, the inner surface 4 at the funnel portion 1 achieves a high degree of surface smoothness and a high degree of dimensional accuracy through grinding.

Since the inner surface 4 at the funnel portion 1 that is ground is a curved surface that widens from the neck portion 3 toward an opening end surface S1, it cannot be ground by using a rotary grindstone. A curved surface such as this may be effectively ground by, for instance, employing an NC (numerically controlled) grinder (not shown). Other means for grinding that may be adopted include an abrasive belt. Next, a method that may be adopted in conjunction with such an abrasive belt is explained.

Figure 93:
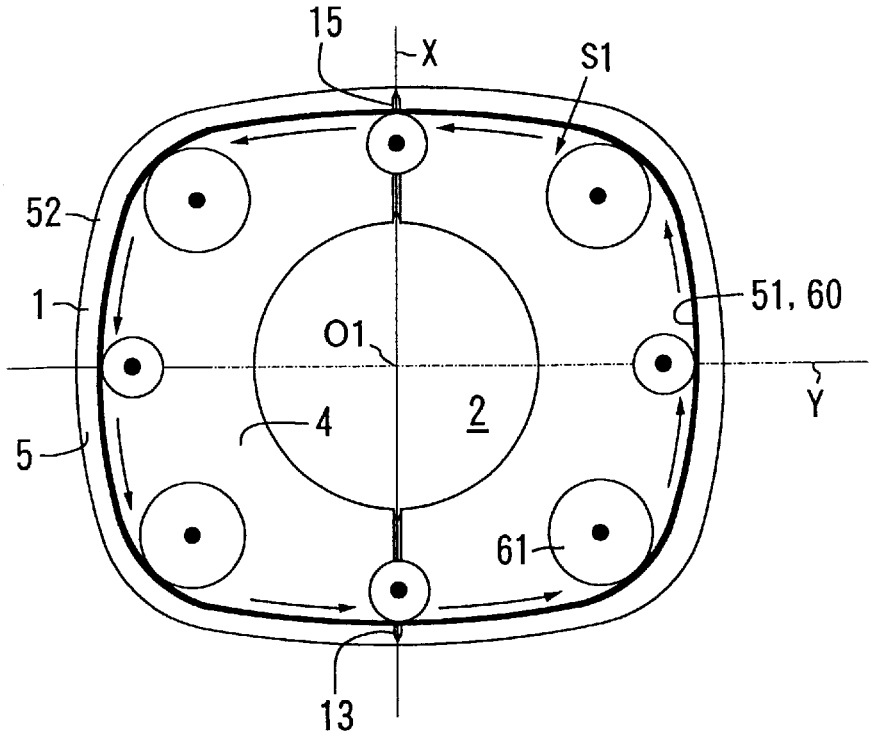
FIG. 93 is a plan view schematically illustrating a method adopted to grind the inner surface of the funnel portion.
Figure 94:
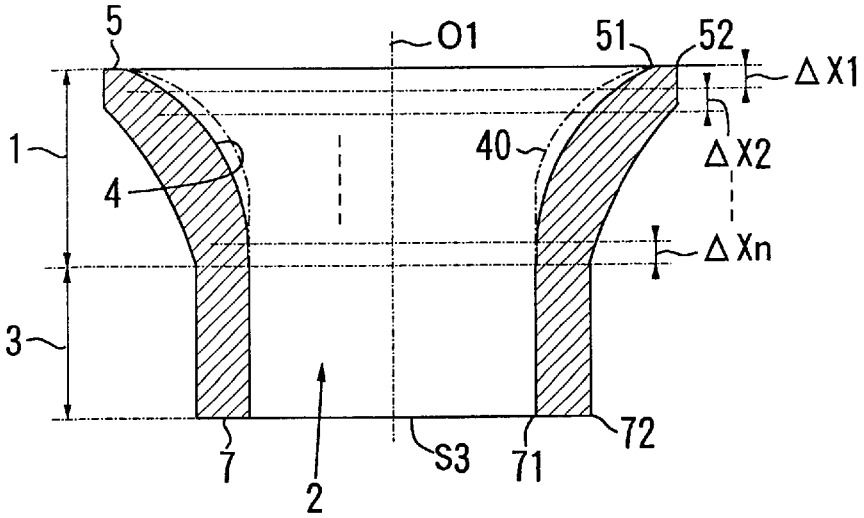
FIG. 94 is a cross-sectional view schematically illustrating the method adopted to grind the inner surface of the funnel portion.

FIGS. 93 and 94 schematically illustrate an abrading method that utilizes an abrasive belt. As shown in FIG. 93, an abrasive belt 60 is set on rotating rollers 61 each of which apply tension to the abrasive belt 60 so as to allow the abrasive belt 60 to come in contact with the curved surface to be ground. As the rollers 61 are rotated in this state, the abrasive belt 60 moves to grind the contact area of the inner surface 4 which is in contact with the abrasive belt 60.

As shown in FIG. 94, the width of the abrasive belt 60 is set in correspondence to the size of areas ΔX1 to ΔXn achieved by dividing the inner surface 4 into small areas, and the grinding process described above is sequentially executed at each of the individual areas ΔX17, . . . ΔXn. The inner surface 4 at the funnel portion 1, which has been ground through this process, becomes a ground surface achieving a high degree of surface smoothness and a high degree of dimensional accuracy.

Although not shown, the inner surface at the neck portion 3 may be ground as well. In this case, the dimensional accuracy at the neck portion 3 as well as the dimensional accuracy at the funnel portion 1 improves, to realize a further improvement in the assembly accuracy with which the deflecting yoke is mounted at a cathode ray tube. The neck portion 3 may be ground by employing an NC (numerically controlled) grinder, an abrasive belt or the like as in the funnel portion 1, or if the hole at the neck portion 3 is formed in a circular shape, the inner surface at the neck portion 3 may be ground with a rotary grinder.

Figure 95:
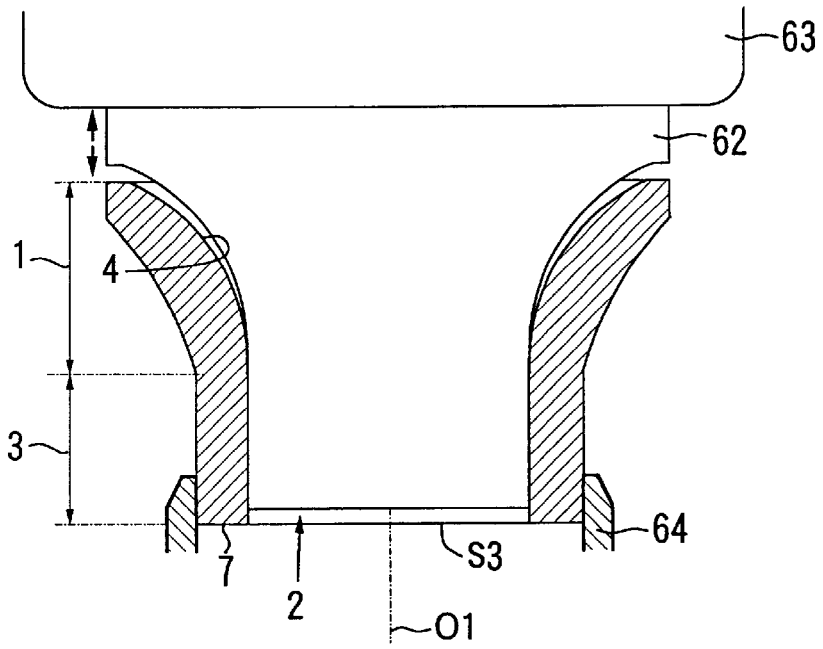
FIG. 95 is a cross-sectional view illustrating another method adopted to grind the deflecting yoke core.

FIG. 95 is a cross-sectional front view illustrating a grinding method other than the grinding method shown in FIGS. 93 and 94. In this method, a vibrating grinder is employed to grind the inner surface of the core. The vibrating grinder includes a grinder unit 62 and a drive unit 63. The grinder unit 62 is formed in a three-dimensional shape in conformance to the shape of the inner surface of the core and is linked at one end thereof to the drive unit 63 so as to vibrate along the direction of the core axis O1. Next the grinding process is explained.

First, the end of the core at the neck portion 3 is secured with a jig 64. Next, the grinder unit 62 of the vibrating grinder is inserted through the opening end at the funnel portion 1, and the drive unit 63 is started up to vibrate the grinder unit 62. As a result, the inner surface of the core having been ground by the grinder unit 62 through this process becomes a ground surface achieving a high degree of dimensional accuracy.

Figure 96:
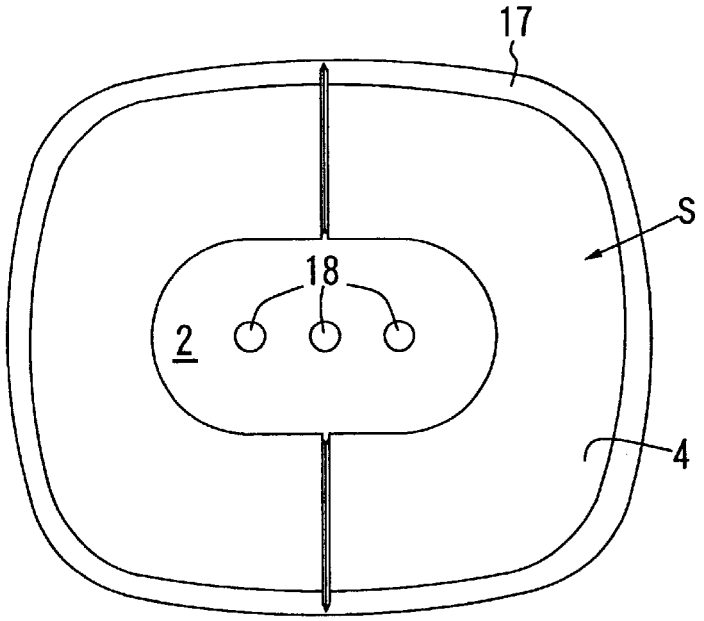
FIG. 96 presents another embodiment of a deflecting yoke core.

FIG. 96 illustrates another embodiment of the deflecting yoke core. The hole 2 in the deflecting yoke core 17 in the figures is formed in an oval-like shape at the neck portion 3, to facilitate application in an in-line type cathode ray tube. The inner surface 4 at the funnel portion 1 is ground. Thus, an improvement is achieved in the dimensional accuracy at the funnel portion 1 in the deflecting yoke core 17, which, in turn, improves the accuracy with which the deflecting yoke is mounted at the cathode ray tube.

In addition, the deflecting yoke core 17 in FIG. 96 having the hole 2 that widens from the neck portion 3 toward the funnel portion 1 with the hole 2 formed in an oval shape at the neck portion 3 is ideal in application in a color television image receiver cathode ray tube having three electron guns 18 provided in an in-line arrangement and a wide display panel.

Figure 97:
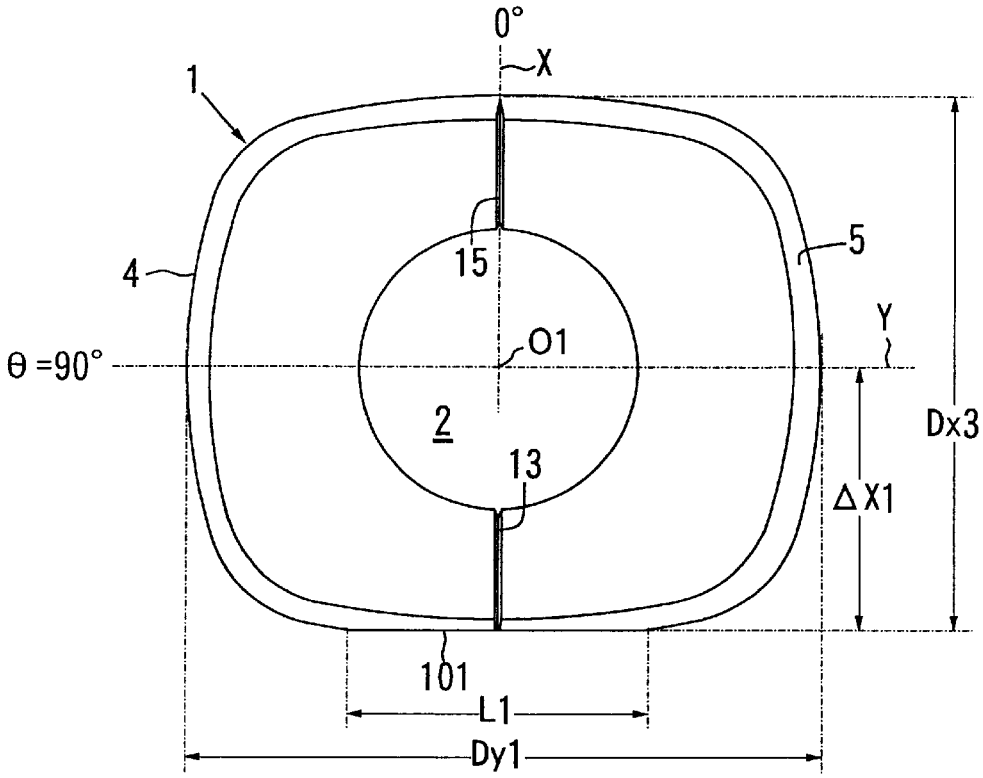
FIG. 97 is a plan view of yet another embodiment of the deflecting yoke core according to the present invention.
Figure 98:
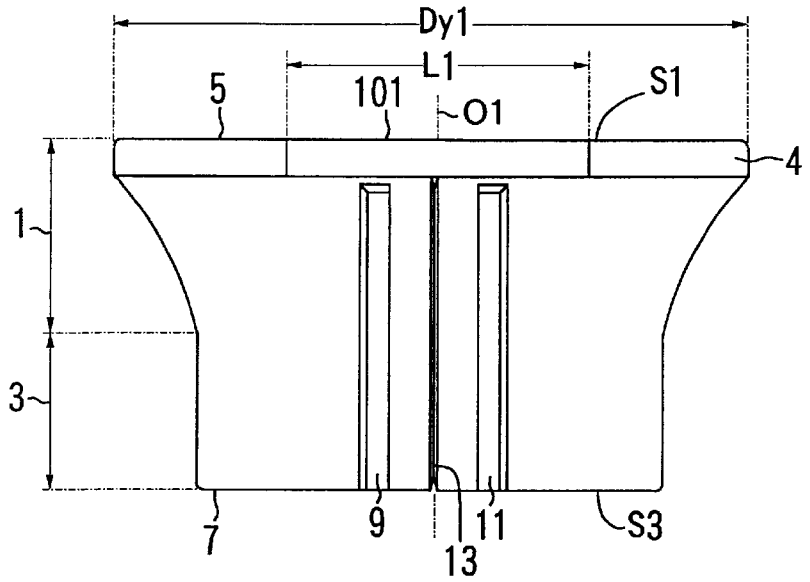
FIG. 98 is a front view of the deflecting yoke core shown in FIG. 97.
Figure 99:
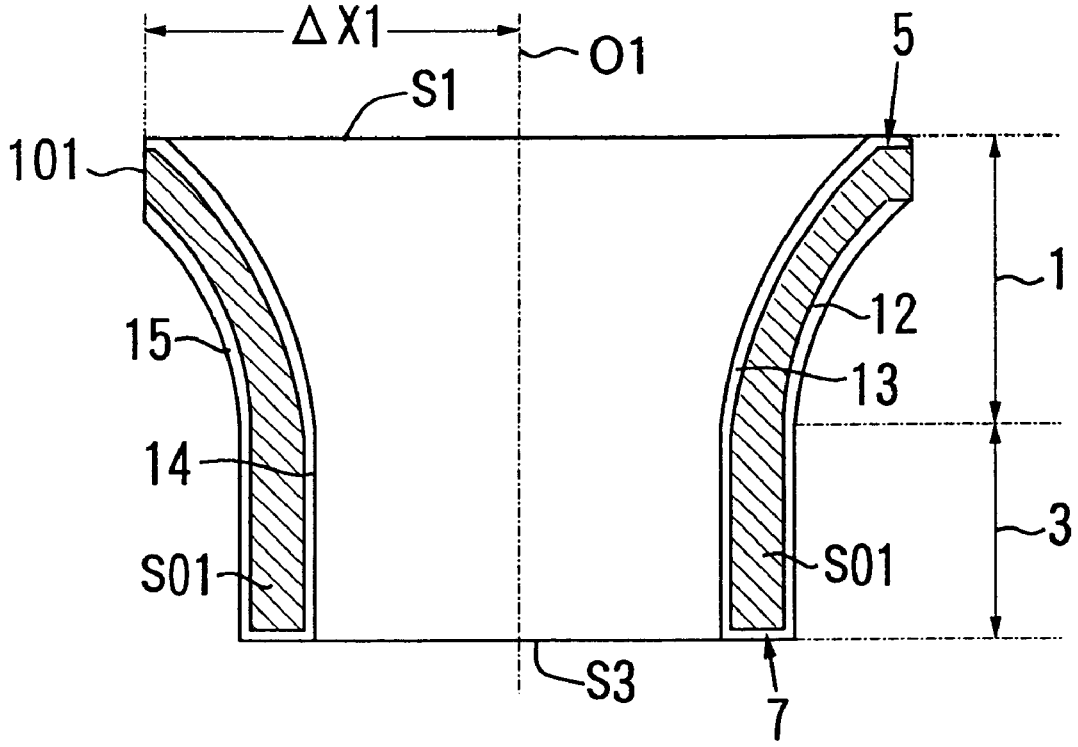
FIG. 99 is a cross-sectional view of the deflecting yoke core shown in FIGS. 97 and 98.

FIG. 97 is a plan view of yet another embodiment of the deflecting yoke core according to the present invention, FIG. 98 is a front view of the deflecting yoke core shown in FIG. 97 and FIG. 99 is a cross-sectional view. Since the shapes of the opening ends at the neck portion 3 and the funnel portion 1 in the deflecting yoke core shown in FIGS. 97 to 99 are identical to those adopted in the embodiment in FIGS. 1 and 2, a repeated explanation is omitted by assigning the same reference numerals to components identical to those in FIGS. 1 and 2.

In the embodiment, the hole 2 is formed in a roughly quadrilateral shape at an opening end 5 at the funnel portion 1, and is formed in a circular shape at an opening end 7 at the neck portion 3. However, the shape of the hole 2 at the opening end 7 at the neck portion 3 may be oval, roughly quadrilateral or the like, instead.

The funnel portion 1 includes a ground flat surface 101 at the outer surface 4 continuous to the opening end 5. In the embodiment, the ground flat surface 101 extends parallel to the core axis O1 and is set apart from the core axis O1 by a distance ΔX1.

The ground flat surface 101 is formed by grinding the external surface 4 at the funnel portion 1. The dimensions of the ground flat surface 101 change depending upon how deep the outer surface 4 at the funnel portion 1 is ground. It is desirable that the length L1 of the ground flat surface 101 and the long diameter Dy1 achieve a relationship expressed as $0.1 \leqq (L1/Dy1) < 1$.

There may be two or more ground flat surfaces formed at the outer surface 4. In addition, the grinding process should be implemented by utilizing a grinding wheel, a rotary grindstone or the like.

Figure 100:
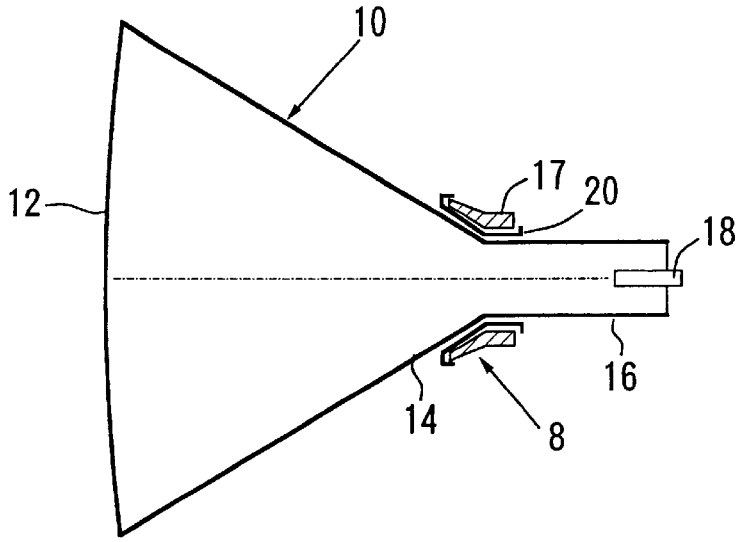
FIG. 100 schematically illustrates a state in which a deflecting yoke constituted with the deflecting yoke core according to the present invention is mounted at a cathode ray tube.

FIG. 100 schematically illustrates a state in which a deflecting yoke constituted with the deflecting yoke core according to the present invention is mounted at a cathode ray tube 10. The cathode ray tube 10 is provided with a display panel 12, a funnel 14, a neck 16 and electron guns 18. The deflecting yoke 8 includes a core 17 according to the present invention and a separator 20 and is provided between the funnel 14 and the neck 16. The separator 20, which includes a horizontal deflection coil and a vertical deflection coil (not shown), is provided at the core 17.

Figure 101:
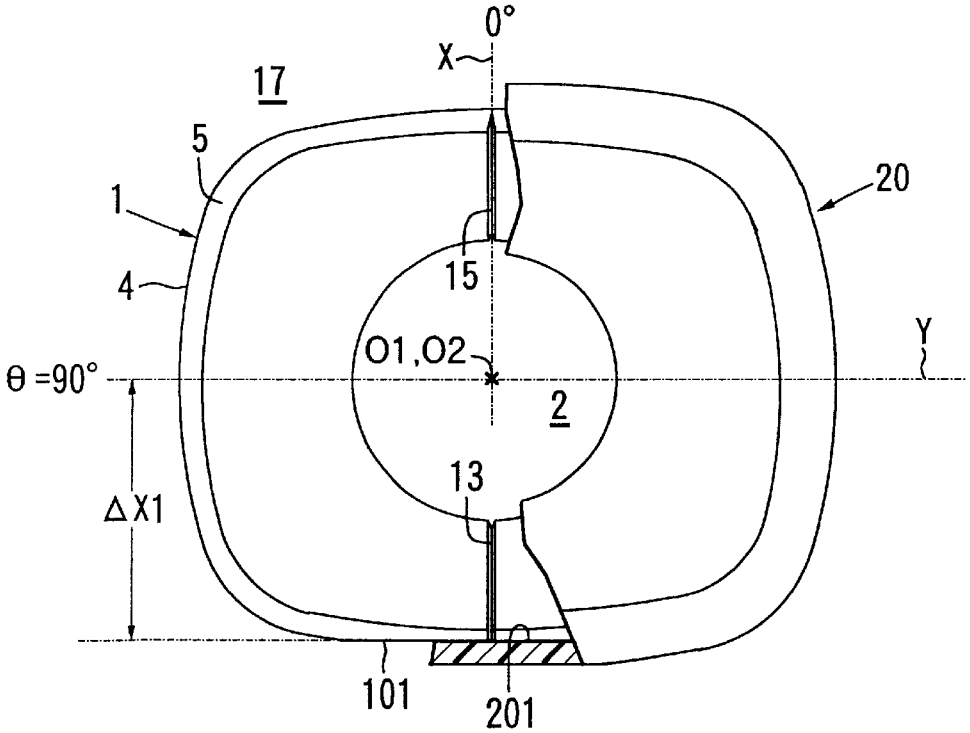
FIG. 101 illustrates the relationship that should be achieved when the separator and the deflecting yoke core are assembled.

FIG. 101 illustrates the relationship achieved by the separator and the deflecting yoke core in assembly. In the figure, the cathode ray tube is not shown. As shown in FIG. 101, the separator 20 includes a flat surface 201 which can be used as a reference surface and is set apart from the tube axis O2 of the cathode ray tube by a distance ΔX1.

The core 17 has an outer shape that widens from the neck portion 3 toward the funnel portion 1, with the outer shape of the funnel portion 1 at the opening end 5 having a short diameter along the minor axis X and a long diameter along the major axis Y. A core assuming such a structure and adopted in a color television image receiver cathode ray tube having a wide display panel improves the deflection efficiency.

In addition, the core 17 includes a ground flat surface 101 at the external circumferential surface 4 continuous to the opening end 5 at the funnel portion 1. By assembling the core 17 achieving this structure with the separator 20 so that the ground flat surface 101 is set on the flat surface 201, the core axis O1 of the core 17 can be easily aligned with the tube axis 02 of the cathode ray tube. As a result, it becomes possible to implement accurate positioning of the deflecting yoke core 17 relative to the cathode ray tube with ease.

Figure 102:
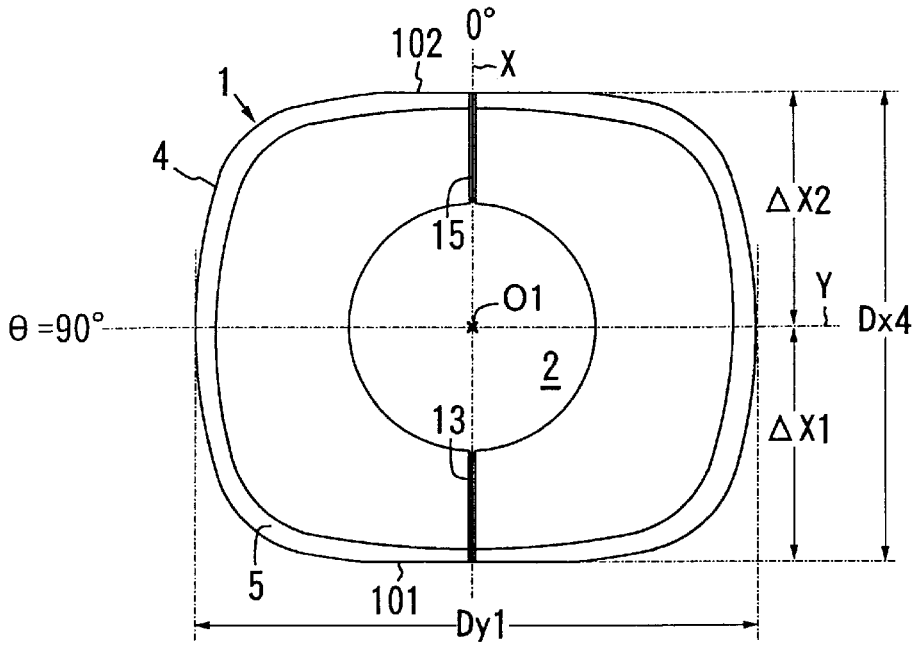
FIG. 102 is a plan view of yet another embodiment of the deflecting yoke core according to the present invention.

FIG. 102 is a plan view of yet another embodiment of the deflecting yoke core according to the present invention. The embodiment in FIG. 102 includes ground flat surfaces 101 and 102 formed at the outer surface 4. The ground flat surfaces 101 and 102 are provided at positions facing opposite each other (near the minor axis X), viewed from the opening end 5, with the ground flat surface 101 set apart from the core axis O1 by a distance ΔX1 and the ground flat surface 102 set apart from the core axis O1 by a distance ΔX2. In addition, at the funnel portion 1, the short diameter Dx4 along the minor axis X and the long diameter Dy1 along the major axis Y have a relationship expressed as; Dy1>Dx4 in the embodiment.

In this embodiment, the two ground flat surfaces 101 and 102 can be used as reference surfaces when the core is assembled with the separator. As a result, the core can be positioned relative to the cathode ray tube with an even higher degree of accuracy.

Although not shown, the ground flat surfaces 101 and 102 may be formed at positions facing opposite each other (near the major axis Y) viewed from the opening end 5, instead. Alternatively, the ground flat surfaces 101 and 102 may be formed over angular distance of approximately 90° from each other.

Figure 103:
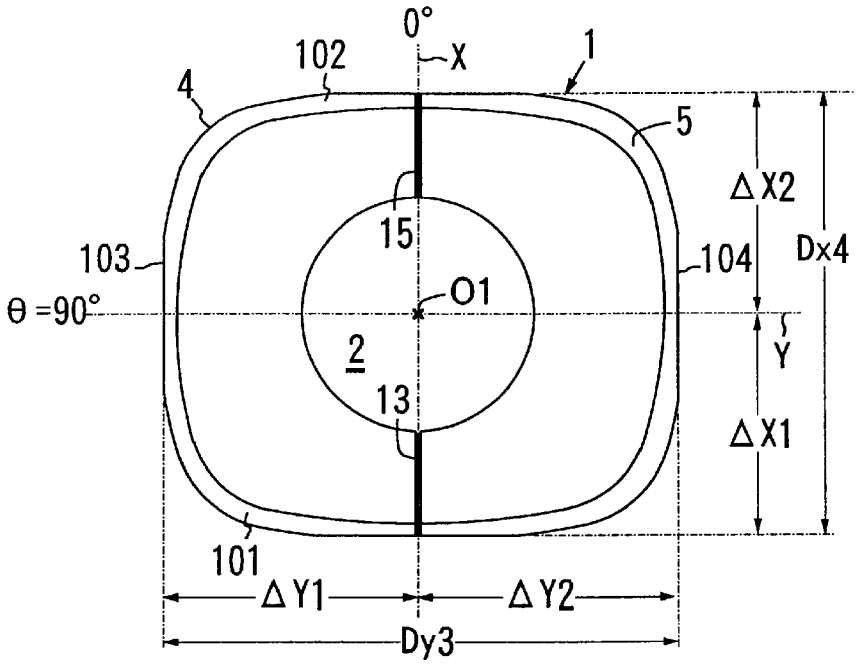
FIG. 103 is a plan view of yet another embodiment of the deflecting yoke core according to the present invention.

FIG. 103 is a plan view of yet another embodiment of the deflecting yoke core according to the present invention. The embodiment in FIG. 103 includes ground flat surfaces 101 to 104 formed at the outer surface 4. The ground flat surfaces 101 and 102 are provided at positions facing opposite each other (near the minor axis X), viewed from the opening end 5, with the ground flat surface 101 set apart from the core axis O1 by a distance ΔX1 and the ground flat surface 102 set apart from the core axis O1 by a distance ΔX2. The ground flat surfaces 103 and 104 are provided at positions facing opposite each other (near the major axis Y), viewed from the opening end 5, with the ground flat surface 103 set apart from the core axis O1 by a distance ΔY1 and the ground flat surface 104 set apart from the core axis O1 by a distance ΔY2.

In addition, at the funnel portion 1, the short diameter Dx4 along the minor axis X and the long diameter Dy3 along the major axis Y have a relationship expressed as Dy3>Dx4 in the embodiment.

In this embodiment, the core can be assembled with the separator by using the four ground flat surfaces 101 to 104 as reference surfaces. Thus, an even higher degree of accuracy is achieved in positioning the core relative to the cathode ray tube, compared to the embodiment shown in FIG. 97 and the embodiment shown in FIG. 102.

Figure 104:
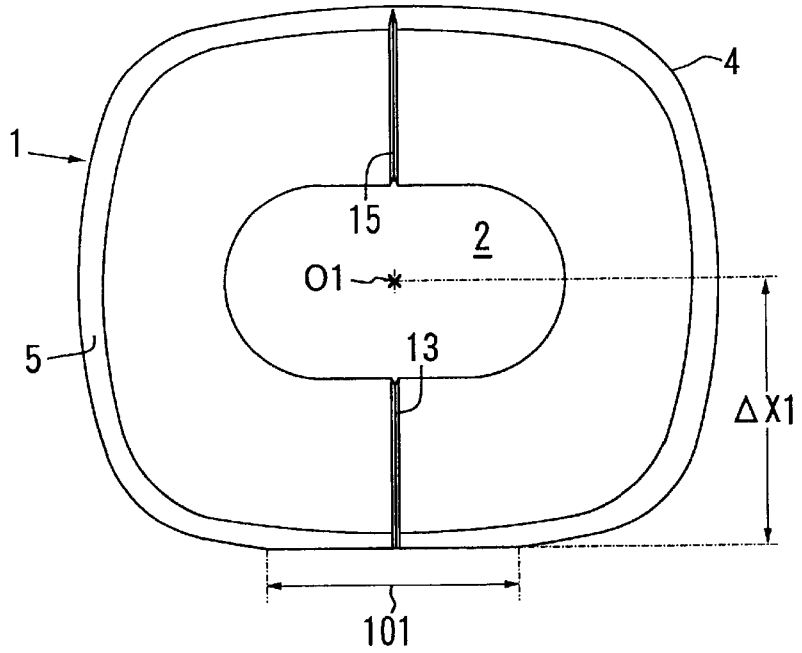
FIG. 104 is a plan view of yet another embodiment of the deflecting yoke core according to the present invention.

FIG. 104 is a plan view of yet another embodiment of the deflecting yoke core according to the present invention. In the embodiment in FIG. 104, the hole 2 is formed in an elliptic-like shape at the opening end 7 of the neck portion 3.

Figure 105:
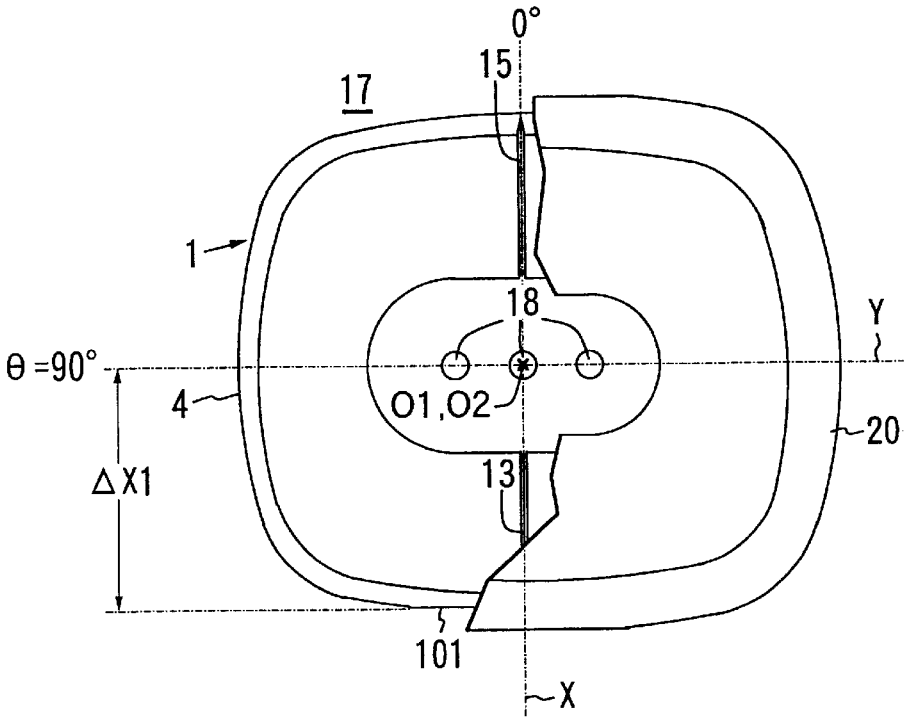
FIG. 105 illustrates the relationship that should be achieved when the deflecting yoke core, the separator and the cathode ray tube are assembled together.

FIG. 105 shows the relationship between the deflecting yoke core, the separator and the cathode ray tube in assembly. In the figure, the cathode ray tube is a color television image receiver cathode ray tube having three electron guns 18 corresponding to the three primary colors provided in a linear arrangement (referred to as an in-line type cathode ray tube). The core 17 in FIG. 104 is ideal in application in such an in-line type cathode ray tube.

Figure 106:
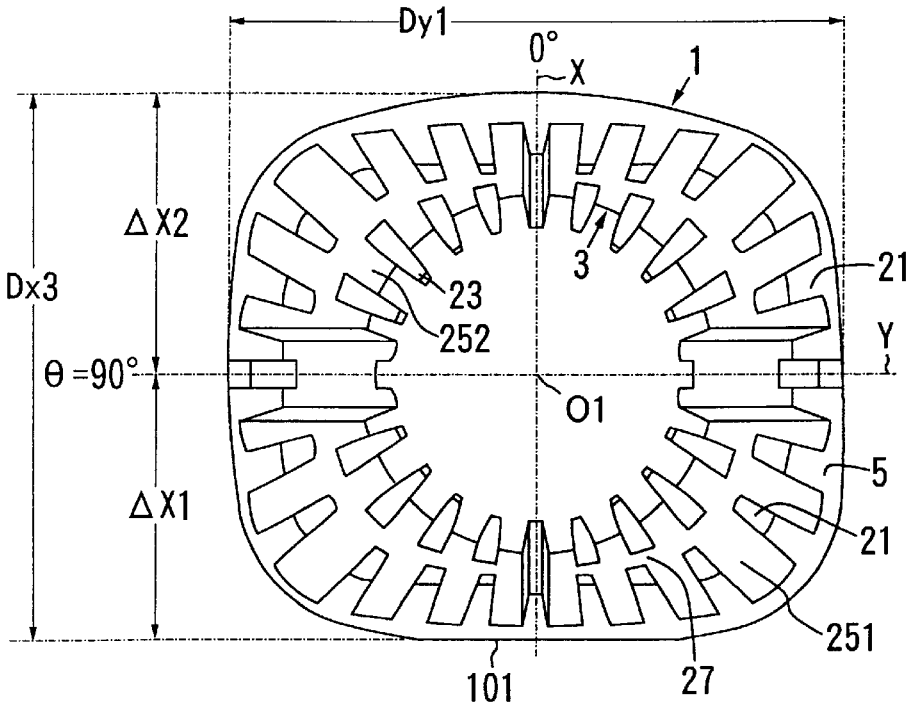
FIG. 106 is a plan view of yet another embodiment of the deflecting yoke core according to the present invention.
Figure 107:
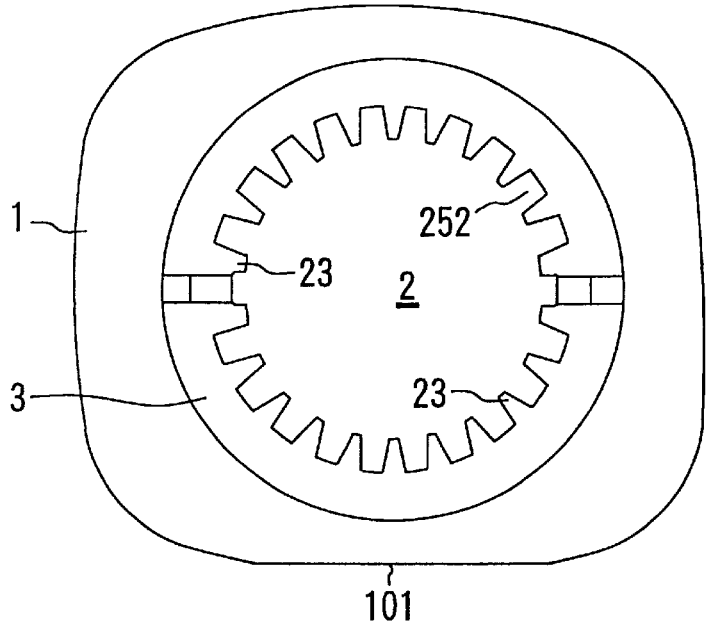
FIG. 107 is a bottom view of the deflecting yoke core shown in FIG. 106.

FIG. 106 is a plan view of a deflecting yoke core according to the present invention and FIG. 107 is a bottom view of the deflecting yoke core shown in FIG. 106. Since the basic structure adopted in the deflecting yoke core in FIGS. 106 and 107 and the resulting advantages are the same as those explained earlier in reference to FIGS. 15 to 18, a repeated explanation is omitted. While only one ground surface 101 is provided near the minor axis X in the figures, two or more ground surfaces may be provided instead.

Figure 108:
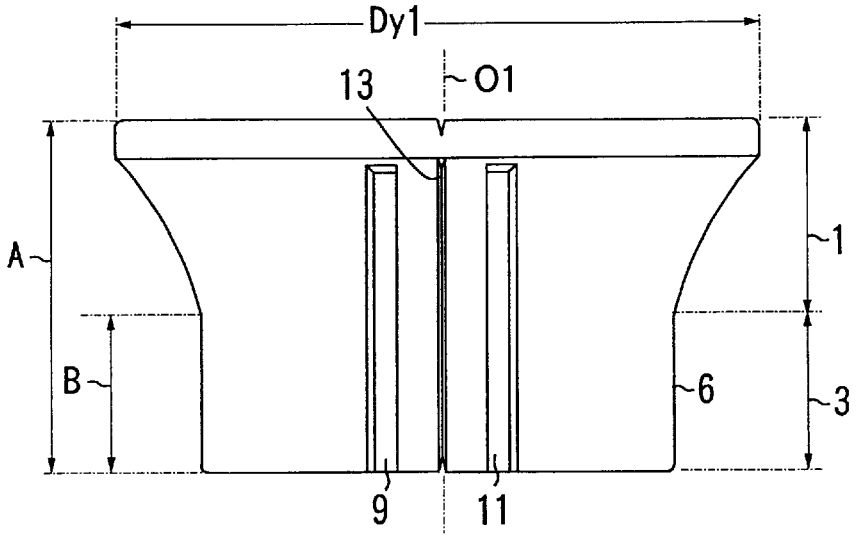
FIG. 108 is a front view of yet another embodiment of the deflecting yoke core according to the present invention.
Figure 109:
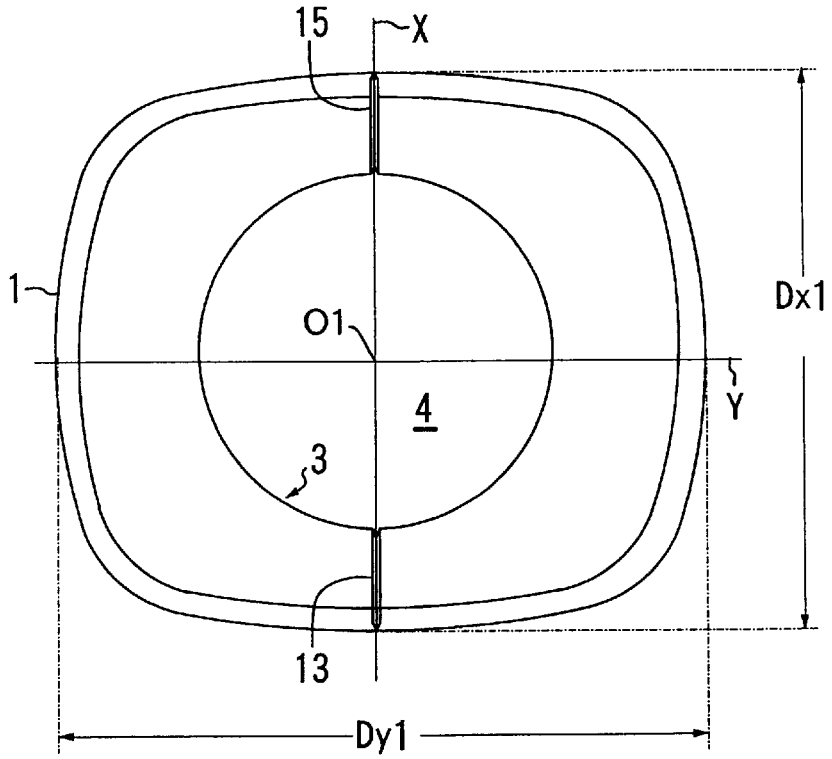
FIG. 109 is a plan view of the deflecting yoke core shown in FIG. 108.
Figure 110:
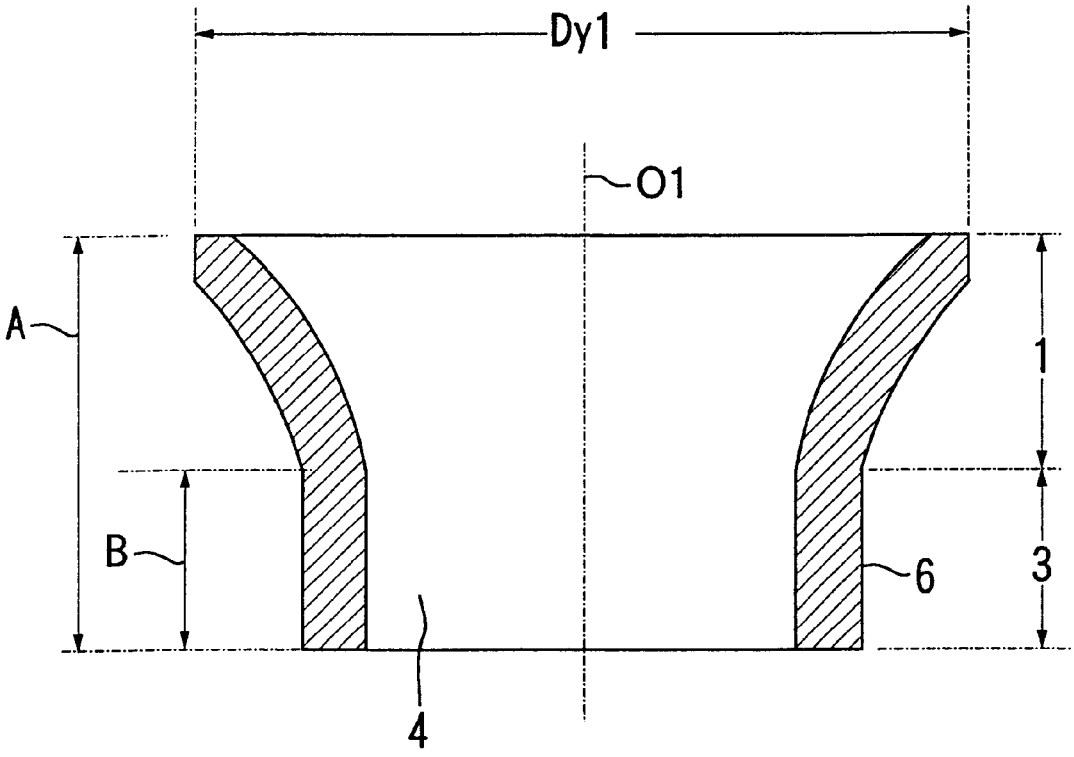
FIG. 110 is a cross-sectional front view of the deflecting yoke core shown in FIG. 108.

FIG. 108 is a front view of yet another embodiment of the deflecting yoke core according to the present invention, FIG. 109 is a plan view of the deflecting yoke core shown in FIG. 108, and FIG. 110 is a cross-sectional front view of the deflecting yoke core shown in FIG. 108. Since the shapes of the opening ends at the neck portion 3 and the funnel portion 1 in the deflecting yoke core in FIGS. 108 to 110 are identical to those assumed in the embodiment in FIGS. 1 and 2, a repeated explanation is omitted by assigning the same reference numerals to components identical to those in FIGS. 1 and 2.

The deflecting yoke core in FIGS. 108 to 110 is characterized in that 5 mm≦B≦(A/2)mm is satisfied with B representing the length of the neck portion 3 along the core axis O1 and A representing the entire core length which is the sum of the length B and the length of the funnel portion 1 along the core axis O1. This feature achieves a very significant effect when abrading the inner surface of the deflecting yoke core, for instance. This point is now explained in reference to FIGS. 111 and 112.

Figure 111:
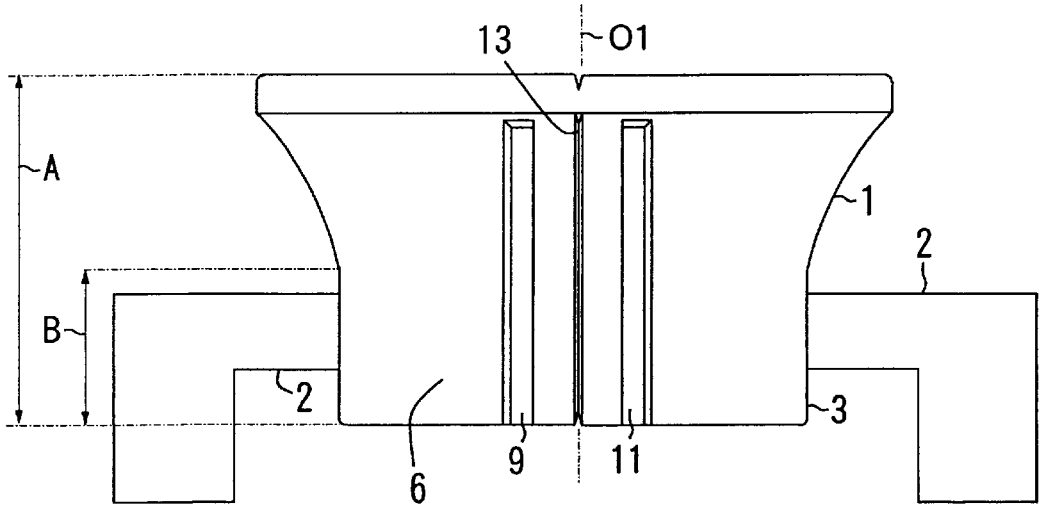
FIG. 111 is a front view illustrating the deflecting yoke core shown an FIGS. 108 to 110 held with a holding member of a processing machine.
Figure 112:
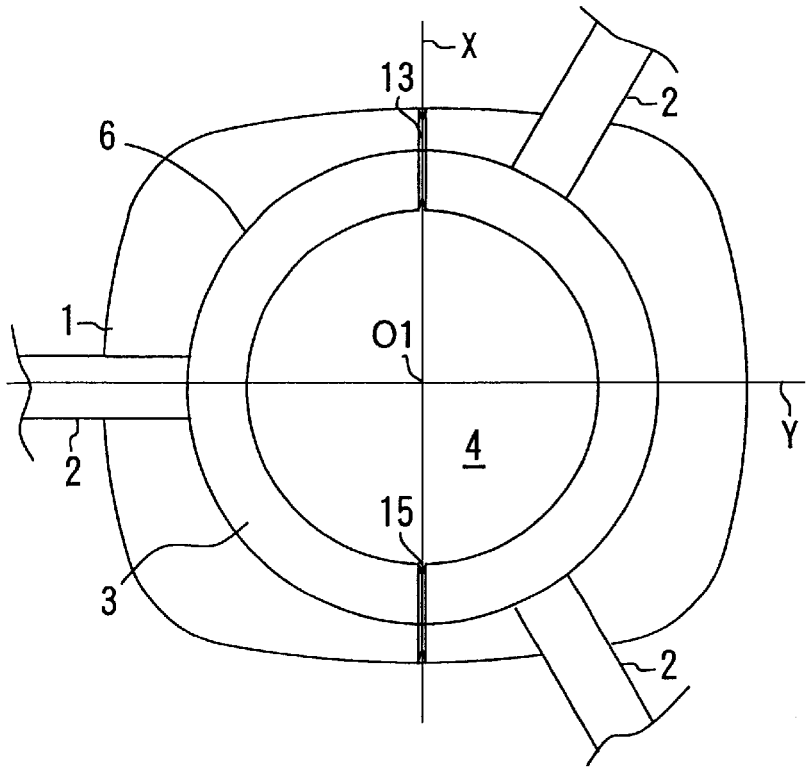
FIG. 112 is a bottom view of the holding state illustrated in FIG. 111.

FIG. 111 is a front view of a processing machine holding a deflecting yoke core and FIG. 112 is a bottom view of the processing machine shown in FIG. 111. The neck portion 3 is held at a plurality of positions by a holding unit 2 of the processing machine. In the embodiment shown in the figures, the circular external circumferential surface 6 of the neck portion 3 is held at three positions by the holding unit 2. In this state, necessary areas including the inner surface of the neck portion 3 and the like are machined by using an abrading unit (not shown). The core held by the holding unit 2 may be rotated around a fixed abrading unit in this process.

In addition, if the external circumferential surface 6 has a shape other than a circular shape, the positions at which the holding unit 2 and the number of holding positions should be changed in conformance to the shape of the outer circumferential surface 6. Although not shown, the entire external circumferential surface 6 at the neck portion 3 may be held so as to enclose the outer circumferential surface 6 in its entirety, instead.

If the length B of the neck portion 3 along the core axis O1 is less than 5 mm, the holding unit 2 of the processing machine cannot hold the neck portion 3 securely enough, and thus, it becomes difficult to machine the inner surface 4 of the deflecting yoke core. As a result, the neck portion 3 held by the holding unit 2 of the processing machine cannot withstand the grinding frictional resistance or withstand the weight of the deflecting yoke core, resulting in falling of the core, or a chip or a crack to occur.

If, on the other hand, the length B of the neck portion 3 along the core axis O1 is 5 mm or larger (B≧5 mm), a large enough contact area is assured for the holding unit 2 of the processing machine and the external circumferential surface 6 of the neck portion 3 and, as a result, the neck portion 3 can be held in a fully stable manner, thereby preventing falling of the core, or a chip or a crack to occur. Thus, since the neck portion 3 can be held in a stable manner, the inner surface of the deflecting yoke core can be machined with a high degree of accuracy. This ultimately makes it possible to obtain a deflecting yoke capable of accurately controlling electron beams in a cathode ray tube and achieving good deflection sensitivity.

As long as the length B of the neck portion 3 along the core axis O1 is equal to or greater than 5 mm and equal to or smaller than (A/2) mm, problems related to heat generation and magnetic saturation do not arise. Once the length B of the neck portion 3 along the core axis O1 exceeds (A/2) mm, the sectional area of the funnel portion 1 becomes too small, resulting in problems related to heat generation and magnetic saturation. The funnel portion 1 and the neck portion 3 may assume various shapes and structures.

In addition, core saturation may be prevented when a horizontal deflection magnetic field and a vertical deflection magnetic field are created in a deflecting yoke constituted of the deflecting yoke core shown in FIGS. 108 to 112 and deflection coils by ensuring that the core sectional areas along a plane parallel to and passing through a core axis O1 are largest within an angular range of 30° to 65° measured around the core axis O1 from a 0° reference angle at the minor axis X, as explained earlier. In addition, it is obvious that the principle explained in reference to the embodiment in FIGS. 108 to 112 may be adopted in the deflecting yoke core structured as illustrated in FIGS. 15 to 18.

INDUSTRIAL APPLICABILITY

As explained above, the following advantages are achieved by the present invention.

(a) A deflecting yoke core with which magnetic saturation is prevented by optimizing the relationship between the core sectional area and the density of the core internal magnetic flux distribution is provided.

(b) A deflection yoke core which does not become chipped is provided.

(c) A deflecting yoke core which does not become deformed readily during the baking process is provided.

(d) A deflecting yoke core with which the core loss is minimized and the quantity of heat generated at the core is reduced is provided.

(e) A deflecting yoke core having a shape optimized for application in an in-line type cathode ray tube having three electron guns corresponding to the three primary colors provided in a linear arrangement is provided.

(f) A deflecting yoke core that affords a higher degree of freedom in the coil arrangement and makes it possible to improve the deflection sensitivity, the distortion characteristics, the convergence characteristics and the like through a magnetic field distribution adjustment is provided.

(g) A deflection yoke core that can be rapped out along the core axis in a reliable manner is provided.

(h) A deflecting yoke core having the opening end surface of the funnel portion formed in a non-circular shape and the hole at the neck portion formed in a circular shape that achieves a high degree of dimensional accuracy is provided.

(i) A deflecting yoke core that achieves a high degree of dimensional accuracy to improve the accuracy with which it is assembled into a cathode ray tube is provided.

(j) A deflecting yoke core that facilitates accurate positioning of the core relative to the cathode ray tube is provided.

(k) A deflecting yoke core that assures a sufficient volume to achieve required characteristics and can be held in a stable manner during a machining process is provided.

What is claimed is:

1. A deflecting yoke core to be mounted between a neck and a funnel of a cathode ray tube, comprising:

a hole extending from an opening end of a neck portion to an opening end of a funnel portion, said hole at said funnel portion widening toward said opening end of said funnel portion, and an outer shape at said opening end of said funnel portion having a short diameter along a minor axis and a long diameter along a major axis, wherein:

core sectional areas along a plane parallel to and passing through a core axis are largest within an angular range of 30° to 65° measured around said core axis from a 0° reference angle at said minor axis.

2. A deflecting yoke core as in claim 1, wherein:

a plurality of projecting portions are provided in a radial pattern along an inner surface from said funnel portion toward said neck portion; and a plurality of grooves are formed between said plurality of projecting portions.

3. A deflecting yoke core as in claim 2, wherein:

said projecting portions are provided separately in said neck portion and said funnel portion.

4. A deflecting yoke core as in claim 1, wherein:

dividing grooves extending along said core axis are provided at a core surface near said minor axis.

5. A deflecting yoke core as in claim 4, wherein:

said dividing grooves extend linearly and open at an opening end edge of said neck portion.

6. A deflecting yoke core as in claim 4, wherein:

said dividing grooves are provided at positions facing opposite each other at an outer circumferential surface and an inner circumferential surface.

7. A deflecting yoke core as in claim 6, wherein:

said dividing grooves at said outer circumferential surface and said dividing grooves at said inner circumferential surface are continuous to each other at said opening end edge of said neck portion.

8. A deflecting yoke core as in claim 4, wherein:

said dividing grooves are V-shaped.

9. A deflecting yoke core as in claim 1, wherein:

dividing grooves extending along said core axis are provided at a core surface near said minor axis; and clip grooves are provided on two sides of said minor axis at an outer circumferential surface.

10. A deflecting yoke core, as in claim 9, wherein:

said dividing grooves are provided at said core surface at one end and another end of said minor axis; and said clip grooves are provided at said outer circumferential surface at said one end and said other end of said minor axis.

11. A deflecting yoke core as in claim 9, wherein:

said dividing grooves are provided at positions facing opposite each other at said outer circumferential surface and an inner circumferential surface.

12. A deflecting yoke core as in claim 9, wherein:

said clip grooves are each constituted of a linear groove extending along said core axis.

13. A deflecting yoke core as in claim 9, wherein:

an outer shape at said opening end of said neck portion is circular.

14. A deflecting yoke core as in claim 9, wherein:

an outer shape at said opening end of said neck portion has a short diameter along a minor axis and a long diameter along a major axis.

15. A deflecting yoke core as in claim 9, wherein:

said core is constituted of a molding formed from magnetic powder.

16. A deflecting yoke core formed as a tube to be mounted between a neck and a funnel of a cathode ray tube, comprising:

an outer circumferential surface at a funnel portion widening toward an opening end of said funnel portion, and an outer shape at said opening end of said funnel portion having a short diameter along a minor axis and a long diameter along a major axis, wherein:

at least one first indented portion is provided at said outer circumferential surface near said minor axis; and core sectional areas along a plane parallel to and passing through a core axis are largest within an angular range of 30° to 65° measured around said core axis from a 0° reference angle at said minor axis.

17. A deflecting yoke core as in claim 16, wherein:

said first indented portion is a linear groove extending along a core axis.

18. A deflecting yoke core as in claim 16, wherein:

said first indented portion is provided at said outer circumferential surface at two ends of said minor axis.

19. A deflecting yoke core as in claim 16, wherein:

at least two first indented portions are provided over a distance from each other at said outer circumferential surface at each end of said minor axis.

20. A deflecting yoke core as in claim 16, wherein:

at least one second indented portion is provided at said outer circumferential surface near said major axis.

21. A deflecting yoke core as in claim 16, wherein:

an outer shape at an opening end of a neck portion is circular.

22. A deflecting yoke core as in claim 16, wherein:

an outer shape at an opening end of a neck portion has a short diameter along a minor axis and a long diameter along a major axis.

23. A deflecting yoke core as in claim 16, wherein:

said core is constituted of a molding formed from magnetic powder.

24. A deflecting yoke core to be mounted between a neck and a funnel of a cathode ray tube, comprising:

a hole extending from an opening end of a neck portion to an opening end of a funnel portion, said hole at said funnel portion widening toward said opening end of said funnel portion, wherein:

said hole at said opening end of said funnel portion is curved along an entire circumference;

said hole at both said funnel portion and said neck portion has a short diameter along a minor axis and a long diameter along a major axis; and core sectional areas along a plane parallel to and passing through a core axis are largest within an angular range of 30° to 65° measured around said core axis from a 0° reference angle at said minor axis.

25. A deflecting yoke core formed as a tube to be mounted between a neck and a funnel of a cathode ray tube, comprising:

a plurality of projecting portions provided in a radial pattern along an inner surface from a neck portion toward a funnel portion, with a plurality of grooves formed between said plurality of projecting portions, wherein:

said projecting portions are provided separately in said neck portion and said funnel portion;

said projecting portions each include a surface facing opposite a core axis, said surface inclines over an increasingly greater distance from said core axis viewed along a direction extending from said neck portion toward said funnel portion;

an outer shape at an opening end of said funnel portion has a short diameter along a minor axis and a long diameter along a major axis; and core sectional areas along a plane parallel to and passing through said core axis are largest within an angular range of 30° to 65° measured around said core axis from a 0° reference angle at said minor axis.

26. A deflecting yoke core to be mounted between a neck and a funnel of a cathode ray tube, comprising:

a hole extending from an opening end of a neck portion to an opening end of a funnel portion, said hole at said funnel portion widening toward said opening end of said funnel portion, wherein:

said hole at said funnel portion has a short diameter along a minor axis and a long diameter along a major axis;

said hole at said neck portion has a circular shape and a ground inner surface; and core sectional areas along a plane parallel to and passing through a core axis are largest within an angular range of 30° to 65° measured around said core axis from a 0° reference angle at said minor axis.

27. A deflecting yoke core to be mounted between a neck and a funnel of a cathode ray tube, comprising:

a hole extending from an opening end of a neck portion to an opening end of a funnel portion, said hole at said funnel portion widening toward said opening end of said funnel portion, said hole at said funnel portion has a short diameter along a minor axis and a long diameter along a major axis, and a plurality of projecting portions provided in a radial pattern along an inner surface from said neck portion toward said funnel portion, with a plurality of grooves formed between said plurality of projecting portions, wherein:

end surfaces of said projecting portions in said neck portion are ground; and core sectional areas along a plane parallel to and passing through a core axis are largest within an angular range of 30° to 65° measured around said core axis from a 0° reference angle at said minor axis.

28. A deflecting yoke core as in claim 27, wherein:

said projecting portions are provided separately in said neck portion and said funnel portion.

29. A deflecting yoke core to be mounted between a neck and a funnel of a cathode ray tube, comprising:

a hole extending from an opening end of a neck portion to an opening end of a funnel portion, said hole at said funnel portion widening toward said opening end of said funnel portion, wherein:

said hole at least at said funnel portion has a short diameter along a minor axis and a long diameter along a major axis and a ground inner surface; and core sectional areas along a plane parallel to and passing through a core axis are largest within an angular range of 30° to 65° measured around said core axis from a 0° reference angle at said minor axis.

30. A deflecting yoke core as in claim 29, wherein:

said hole at said neck portion has a ground inner surface.

31. A deflecting yoke core as in claim 29, wherein:

said hole at said neck portion has a short diameter along a minor axis and a long diameter along a major axis.

32. A deflecting yoke core formed as a tube to be mounted between a neck and a funnel of a cathode ray tube, comprising:

an outer shape at a funnel portion widening toward an opening end of said funnel portion, wherein:

said outer shape at said opening end of said funnel portion has a short diameter along a minor axis and a long diameter along a major axis and includes at least one ground flat surface at an outer circumferential surface at said opening end of said funnel portion; and core sectional areas along a plane parallel to and passing through a core axis are largest within an angular range of 30° to 65° measured around said core axis from a 0° reference angle at said minor axis.

33. A deflecting yoke core as in claim 32, wherein:

two ground flat surfaces are provided at positions over an angular interval of approximately 90° or approximately 180° from each other.

34. A deflecting yoke core as in claim 32, wherein:

three or four ground flat surfaces are provided at positions over an angular interval of approximately 90° set for any two surfaces next to each other.

35. A deflecting yoke core formed as a tube to be mounted between a neck and a funnel of a cathode ray tube, comprising:

an outer shape at a funnel portion widening toward an opening end of said funnel portion, said outer shape at said opening end of said funnel portion having a short diameter along a minor axis and a long diameter along a major axis, wherein:

core sectional areas along a plane parallel to and passing through a core axis are largest within an angular range of 30° to 65° measured around said core axis from a 0° reference angle at said minor axis; and $5\ \text{mm} \leqq B \leqq A/2\ \text{mm}$ is satisfied, with A representing an entire length of said core along said core axis which is the sun of a length B of a neck portion along said core axis and a length of said funnel portion along said core axis.

36. A deflecting yoke core as in claim 35, wherein:

an outer shape at an opening end of said neck portion is circular.

37. A deflecting yoke core as in claim 35, wherein:

an outer shape at an opening end of said neck portion has a short diameter along a minor axis and a long diameter along a major axis.

38. A deflecting yoke core as in claim 35, wherein:

a plurality of projecting portions are provided in a radial pattern along an inner surface from said neck portion toward said funnel portion; and a plurality of grooves are formed between said plurality of projecting portions.

39. A deflecting yoke core to be mounted between a neck and a funnel of a cathode ray tube, comprising:

a hole extending from an opening end of a neck portion to an opening end of a funnel portion, said hole at said funnel portion widening toward said opening end of said funnel portion, and an outer shape at said opening end of said funnel portion having a short diameter along a minor axis and a long diameter along a major axis, wherein:

a core density at core sectional areas along a plane parallel to and passing through a core axis is largest within an angular range of 30° to 65° measured around said core axis from a 0° reference angle at said minor axis.

40. A deflecting yoke core as in claim 39, wherein:

a plurality of projecting portions are provided in a radial pattern along an inner surface from said funnel portion toward said neck portion; and a plurality of grooves are formed between said plurality of projecting portions.

41. A deflecting yoke core as in claim 40, wherein:

said projecting portions are provided separately in said neck portion and said funnel portion.

42. A deflecting yoke core as in claim 39, wherein:

dividing grooves extending along said core axis are provided at a core surface near said minor axis.

43. A deflecting yoke core as in claim 42, wherein:

said dividing grooves extend linearly and open at an opening end edge of said neck portion.

44. A deflecting yoke core as in claim 42, wherein:

said dividing grooves are provided at positions facing opposite each other at an outer circumferential surface and an inner circumferential surface.

45. A deflecting yoke core as in claim 44, wherein:

said dividing grooves at said outer circumferential surface and said dividing grooves at said inner circumferential surface are continuous to each other at said opening end edge of said neck portion.

46. A deflecting yoke core as in claim 42, wherein: said dividing grooves are V-shaped.

47. A deflecting yoke core as in claim 39, wherein:

dividing grooves extending along said core axis are provided at a core surface near said minor axis; and clip grooves are provided on two sides of said minor axis at an outer circumferential surface.

48. A deflecting yoke core as in claim 47, wherein:

said dividing grooves are provided at said core surface at one end and another end of said minor axis; and said clip grooves are provided at said outer circumferential surface at said one end and said other end of said minor axis.

49. A deflecting yoke core as in claim 47, wherein:

said dividing grooves are provided at positions facing opposite each other at said outer circumferential surface and an inner circumferential surface.

50. A deflecting yoke core as in claim 47, wherein:

said clip grooves are each constituted of a linear groove extending along said core axis.

51. A deflecting yoke core as in claim 47, wherein:

an outer shape at said opening end of said neck portion is circular.

52. A deflecting yoke core as in claim 47, wherein:

an outer shape at said opening end of said neck portion has a short diameter along a minor axis and a long diameter along a major axis.

53. A deflecting yoke core as in claim 47, wherein:

said core is constituted of a molding formed from magnetic powder.

54. A deflecting yoke core formed as a tube to be mounted between a neck and a funnel of a cathode ray tube, comprising:

an outer circumferential surface at a funnel portion widening toward an opening end of said funnel portion, and an outer shape at said opening end of said funnel portion having a short diameter along a minor axis and a long diameter along a major axis, wherein:

at least one first indented portion is provided at said outer circumferential surface near said minor axis; and a core density at core sectional areas along a plane parallel to and passing through a core axis is largest within an angular range of 30° to 65° measured around said core axis from a 0° reference angle at said minor axis.

55. A deflecting yoke core as in claim 54, wherein:

said first indented portion is a linear groove extending along a core axis.

56. A deflecting yoke core as in claim 54, wherein:

said first indented portion is provided at said outer circumferential surface at two ends of said minor axis.

57. A deflecting yoke core as in claim 54, wherein:

at least two first indented portions are provided over a distance from each other at said outer circumferential surface at each end of said minor axis.

58. A deflecting yoke core as in claim 54, wherein:

at least one second indented portion is provided at said outer circumferential surface near said major axis.

59. A deflecting yoke core as in claim 54, wherein:

an outer shape at an opening end of a neck portion is circular.

60. A deflecting yoke core as in claim 54, wherein:

an outer shape at an opening end of a neck portion has a short diameter along a minor axis and a long diameter along a major axis.

61. A deflecting yoke core as in claim 54, wherein:

said core is constituted of a molding formed from magnetic powder.

62. A deflecting yoke core to be mounted between a neck and a funnel of a cathode ray tube, comprising:

a hole extending from an opening end of a neck portion to an opening end of a funnel portion, said hole at said funnel portion widening toward said opening end of said funnel portion, wherein:

said hole at said opening end of said funnel portion is curved along an entire circumference;

said hole at both said funnel portion and said neck portion has a short diameter along a minor axis and a long diameter along a major axis; and a core density at core sectional areas along a plane parallel to and passing through a core axis is largest within an angular range of 30° to 65° measured around said core axis from a 0° reference angle at said minor axis.

63. A deflecting yoke core formed as a tube to be mounted between a neck and a funnel of a cathode ray tube, comprising:

a plurality of projecting portions provided in a radial pattern along an inner surface from a neck portion toward a funnel portion, with a plurality of grooves formed between said plurality of projecting portions, wherein:

said projecting portions are provided separately in said neck portion and said funnel portion;

said projecting portions each include a surface facing opposite a core axis, said surface inclines over an increasingly greater distance from said core axis viewed along a direction extending from said neck portion toward said funnel portion;

an outer shape at an opening end of said funnel portion has a short diameter along a minor axis and a long diameter along a major axis; and a core density at core sectional areas along a plane parallel to and passing through said core axis is largest within an angular range of 30° to 65° measured around said core axis from a 0° reference angle at said minor axis.

64. A deflecting yoke core to be mounted between a neck and a funnel of a cathode ray tube, comprising:

a hole extending from an opening end of a neck portion to an opening end of a funnel portion, said hole at said funnel portion widening toward said opening end of said funnel portion, wherein:

said hole at said funnel portion has a short diameter along a minor axis and a long diameter along a major axis;

said hole at said neck portion has a circular shape and a ground inner surface; and a core density at core sectional areas along a plane parallel to and passing through a core axis is largest within an angular range of 30° to 65° measured around said core axis from a 0° reference angle at said minor axis.

65. A deflecting yoke core to be mounted between a neck and a funnel of a cathode ray tube, comprising:

a hole extending from an opening end of a neck portion to an opening end of a funnel portion, said hole at said funnel portion widening toward said opening end of said funnel portion, said hole at said funnel portion has a short diameter along a minor axis and a long diameter along a major axis, and a plurality of projecting portions provided in a radial pattern along an inner surface from said neck portion toward said funnel portion, with a plurality of grooves formed between said plurality of projecting portions, wherein:

end surfaces of said projecting portions in said neck portion are ground; and a core density at core sectional areas along a plane parallel to and passing through a core axis are largest within an angular range of 30° to 65° measured around said core axis from a 0° reference angle at said minor axis.

66. A deflecting yoke core as in claim 65, wherein:

said projecting portions are provided separately in said neck portion and said funnel portion.

67. A deflecting yoke core to be mounted between a neck and a funnel of a cathode ray tube, comprising:

a hole extending from an opening end of a neck portion to an opening end of a funnel portion, said hole at said funnel portion widening toward said opening end of said funnel portion, wherein:

said hole at least at said funnel portion has a short diameter along a minor axis and a long diameter along a major axis and a ground inner surface; and a core density at core sectional areas along a plane parallel to and passing through a core axis is largest within an angular range of 30° to 65° measured around said core axis from a 0° reference angle at said minor axis.

68. A deflecting yoke core as in claim 67, wherein:

said hole at said neck portion has a ground inner surface.

69. A deflecting yoke core as in claim 67, wherein:

said hole at said neck portion has a short diameter along a minor axis and a long diameter along a major axis.

70. A deflecting yoke core formed as a tube to be mounted between a neck and a funnel of a cathode ray tube, comprising:

an outer shape at a funnel portion widening toward an opening end of said funnel portion, wherein:

said outer shape at said opening end of said funnel portion has a short diameter along a minor axis and a long diameter along a major axis and includes at least one ground flat surface at an outer circumferential surface at said opening end of said funnel portion; and a core density at core sectional areas along a plane parallel to and passing through a core axis is largest within an angular range of 30° to 65° measured around said core axis from a 0° reference angle at said minor axis.

71. A deflecting yoke core as in claim 70, wherein:

two ground flat surfaces are provided at positions over an angular interval of approximately 90° or approximately 180° from each other.

72. A deflecting yoke core as in claim 70, wherein:

three or four ground flat surfaces are provided at positions over an angular interval of approximately 90° set for any two surfaces next to each other.

73. A deflecting yoke core formed as a tube to be mounted between a neck and a funnel of a cathode ray tube, comprising:

an outer shape at a funnel portion widening toward an opening end of said funnel portion, said outer shape at said opening end of said funnel portion having a short diameter along a minor axis and a long diameter along a major axis, wherein:

a core density at core sectional areas along a plane parallel to and passing through a core axis is largest within an angular range of 30° to 65° measured around said core axis from a 0° reference angle at said minor axis; and $5\ \text{mm} \leqq B \leqq A/2\ \text{mm}$ is satisfied, with A representing an entire length of said core along said core axis which is the sum of a length B of a neck portion along said core axis and a length of said funnel portion along said core axis.

74. A deflecting yoke core as in claim 73, wherein:

an outer shape at an opening end of said neck portion is circular.

75. A deflecting yoke core as in claim 73, wherein:

an outer shape at an opening end of said neck portion has a short diameter along a minor axis and a long diameter along a major axis.

76. A deflecting yoke core as in claim 73, wherein:

a plurality of projecting portions are provided in a radial pattern along an inner surface from said neck portion toward said funnel portion; and a plurality of grooves are formed between said plurality of projecting portions.

77. A method for manufacturing a deflecting yoke core to be mounted between a neck and a funnel of a cathode ray tube, having a hole extending from an opening end of a neck portion to an opening end of a funnel portion, said hole at said funnel portion widening toward said opening end of said funnel portion, said hole at said funnel portion having a short diameter along a minor axis and a long diameter along a major axis, and said hole at said neck portion having a circular shape, with core sectional areas along a plane parallel to and passing through a core axis being largest within an angular range of 30° to 65° measured around said core axis from a 0° reference angle at said minor axis, comprising the steps of:

grinding the inner surface of said hole at said neck portion; and surface-grinding an outer circumferential surface at said opening end of said funnel portion after grinding said inner surface of said hole at said neck portion.

78. A method for grinding a deflecting yoke core to be mounted between a neck and a funnel of a cathode ray tube, having a hole extending from an opening end of a neck portion to an opening end of a funnel portion, said hole at said funnel portion widening toward said opening end of said funnel portion, and an outer shape at said opening end of said funnel portion having a short diameter along a minor axis and a long diameter along a major axis, with core sectional areas along a plane parallel to and passing through a core axis being largest within an angular range of 30° to 65° measured around said core axis from a 0° reference angle at said minor axis, comprising the step of:

grinding an inner surface of said core by using an NC grinder.

79. A method for grinding a deflecting yoke core to be mounted between a neck and a funnel of a cathode ray tube, having a hole extending from an opening end of a neck portion to an opening end of a funnel portion, said hole at said funnel portion widening toward said opening end of said funnel portion, and an outer shape at said opening end of said funnel portion having a short diameter along a minor axis and a long diameter along a major axis, with core sectional areas along a plane parallel to and passing through a core axis being largest within an angular range of 30° to 65° measured around said core axis from a 0° reference angle at said minor axis, comprising the step of:

grinding an inner surface of said core by rotating an abrasive belt.

80. A method for grinding a deflecting yoke core to be mounted between a neck and a funnel of a cathode ray tube, having a hole extending from an opening end of a neck portion to an opening end of a funnel portion, said hole at said funnel portion widening toward said opening end of said funnel portion, and an outer shape at said opening end of said funnel portion having a short diameter along a minor axis and a long diameter along a major axis, with core sectional areas along a plane parallel to and passing through a core axis being largest within an angular range of 30° to 65° measured around said core axis from a 0° reference angle at said minor axis, comprising the step of:

grinding an inner surface of said core by using a vibrating grinder.

81. A method for manufacturing a deflecting yoke core to be mounted between a neck and a funnel of a cathode ray tube, having a hole extending from an opening end of a neck portion to an opening end of a funnel portion, said hole at said funnel portion widening toward said opening end of said funnel portion, said hole at said funnel portion having a short diameter along a minor axis and a long diameter along a major axis, and said hole at said neck portion having a circular shape, with a core density at core sectional areas along a plane parallel to and passing through a core axis being largest within an angular range of 30° to 65° measured around said core axis from a 0° reference angle at said minor axis, comprising the steps of:

grinding the inner surface of said hole at said neck portion; and surface-grinding an outer circumferential surface at said opening end of said funnel portion after grinding said inner surface of said hole at said neck portion.

82. A method for grinding a deflecting yoke core to be mounted between a neck and a funnel of a cathode ray tube, having an hole extending from an opening end of a neck portion to an opening end of a funnel portion, said hole at said funnel portion widening toward said opening end of said funnel portion, and an outer shape at said opening end of said funnel portion having a short diameter along a minor axis and a long diameter along a major axis, with a core density at core sectional areas along a plane parallel to and passing through a core axis being largest within an angular range of 30° to 65° measured around said core axis from a 0° reference angle at said minor axis, comprising the step of:

grinding an inner surface of said core by using an NC grinder.

83. A method for grinding a deflecting yoke core to be mounted between a neck and a funnel of a cathode ray tube, having a hole extending from an opening end of a neck portion to an opening end of a funnel portion, said hole at said funnel portion widening toward said opening end of said funnel portion, and an outer shape at said opening end of said funnel portion having a short diameter along a minor axis and a long diameter along a major axis, with a core density at core sectional areas along a plane parallel to and passing through a core axis being largest within an angular range of 30° to 65° measured around said core axis from a 0° reference angle at said minor axis, comprising the step of:

grinding an inner surface of said core by rotating an abrasive belt.

84. A method for grinding a deflecting yoke core to be mounted between a neck and a funnel of a cathode ray tube, having a hole extending from an opening end of a neck portion to an opening end of a funnel portion, said hole at said funnel portion widening toward said opening end of said funnel portion, and an outer shape at said opening end of said funnel portion having a short diameter along a minor axis and a long diameter along a major axis, with a core density at core sectional areas along a plane parallel to and passing through a core axis being largest within an angular range of 30° to 65° measured around said core axis from a 0° reference angle at said minor axis, comprising the step of:

grinding an inner surface of said core by using a vibrating grinder.

* * * * *